US009561880B2

(12) United States Patent
Luburic

(10) Patent No.: US 9,561,880 B2
(45) Date of Patent: Feb. 7, 2017

(54) CONTAINER AND LID

(75) Inventor: Frano Luburic, Anaheim, CA (US)

(73) Assignee: BWAY Corporation, Atlanta, GA (US)

( * ) Notice: Subject to any disclaimer, the term of this patent is extended or adjusted under 35 U.S.C. 154(b) by 438 days.

(21) Appl. No.: 13/353,481

(22) Filed: Jan. 19, 2012

(65) Prior Publication Data

US 2013/0186897 A1 Jul. 25, 2013

(51) Int. Cl.

| | |
|---|---|
| ***B65D 17/40*** | (2006.01) |
| ***B65D 21/02*** | (2006.01) |
| ***B65D 71/00*** | (2006.01) |
| ***B65D 25/16*** | (2006.01) |
| ***B65D 25/32*** | (2006.01) |

(52) U.S. Cl.

CPC ..... *B65D 21/0222* (2013.01); *B65D 21/0233* (2013.01); *B65D 25/16* (2013.01); *B65D 25/32* (2013.01); *B65D 71/0088* (2013.01); *B65D 2101/0015* (2013.01); *B65D 2215/02* (2013.01); *B65D 2215/04* (2013.01); *B65D 2543/00027* (2013.01); *B65D 2543/0049* (2013.01); *B65D 2543/00194* (2013.01); *B65D 2543/00296* (2013.01); *B65D 2543/00379* (2013.01); *B65D 2543/00537* (2013.01); *B65D 2543/00555* (2013.01); *B65D 2543/00842* (2013.01)

(58) Field of Classification Search

CPC ..... B65D 21/0222; B65D 21/0233; B65D 71/0088; B65D 2543/00842; B65D 2543/00027; B65D 2543/00194; B65D 2543/00296; B65D 2543/00379; B65D 2543/0049; B65D 2543/00537; B65D 2543/00555; B65D 2101/0015; B65D 2215/02; B65D 2215/04

USPC ..... 220/276, 380, 23.6, 23.4, 268, 265, 266, 220/269, 270, 314, 324, 788, 833–835

See application file for complete search history.

(56) References Cited

U.S. PATENT DOCUMENTS

| | | | | |
|---|---|---|---|---|
| 3,944,115 | A * | 3/1976 | Moonan et al. | 220/802 |
| 4,024,976 | A * | 5/1977 | Acton | B65D 43/0212 215/224 |
| 4,878,595 | A * | 11/1989 | Uhlig | B65D 43/0239 206/807 |
| 4,998,622 | A * | 3/1991 | Drack | A47J 47/18 206/515 |
| 5,050,755 | A * | 9/1991 | Strawder | 220/23.4 |
| 5,052,574 | A * | 10/1991 | McKinnon | B65D 43/0212 215/254 |
| D407,929 | S * | 4/1999 | Woodring | D6/510 |
| 7,740,149 | B2 | 6/2010 | Luburic | |
| 7,926,674 | B2 * | 4/2011 | Luburic | B65D 21/0233 220/258.1 |

(Continued)

*Primary Examiner* — Jeffrey Allen

(74) *Attorney, Agent, or Firm* — Morris, Manning & Martin, LLP; Daniel E. Sineway, Esq.; R. Lee Strasburger, Esq.

(57) ABSTRACT

A container and lid assembly is described for storing or transporting contents therein. Embodiments provide a protective security feature in the container and lid assembly. In at least some aspects of the invention a container body is disclosed having an opening, and a lid body is configured to cover the opening of the container body to form an assembly. An extended bumper portion is disposed at a periphery of the container body and substantially at the opening, wherein the bumper portion comprises a removable tear strip integrated into the material of the bumper portion. The tear strip is configured to prevent access to security mechanism of the assembly.

22 Claims, 53 Drawing Sheets

(56) References Cited

U.S. PATENT DOCUMENTS

| | | | | |
|---|---|---|---|---|
| 7,946,441 | B2 | 5/2011 | Habitz et al. | |
| 2002/0148846 | A1* | 10/2002 | Luburic | 220/792 |
| 2004/0079757 | A1* | 4/2004 | Ciccone | 220/836 |
| 2005/0035125 | A1* | 2/2005 | Bae | 220/326 |
| 2007/0205197 | A1* | 9/2007 | Burney | 220/276 |
| 2007/0246469 | A1 | 10/2007 | Whitmore et al. | |
| 2008/0083768 | A1* | 4/2008 | Luburic | 220/810 |
| 2008/0149639 | A1* | 6/2008 | Luburic B65D | 21/0233 220/276 |
| 2009/0039051 | A1* | 2/2009 | Habitz et al. | 215/256 |
| 2009/0152280 | A1* | 6/2009 | Luburic | 220/669 |
| 2009/0173656 | A1* | 7/2009 | Furlong | 206/508 |
| 2011/0024421 | A1 | 2/2011 | Luburic | |

* cited by examiner

CONTAINER AND LID

BACKGROUND

Field of the Invention

The invention relates generally to storage vessels and, more particularly, containers and lids.

Related Art

In modern commerce and applications, containers are used in a vast array of applications, some more demanding than others.

To be economically and environmentally efficient, containers (like other manufactured items) need to use a minimum amount of material. Not only does this reduce the waste that results at the end of the container's useful life, it also reduces the costs of materials to manufacture the container, reduces the transportation costs that can be involved in using the container, and provides other benefits. For containers made from plastic or similar materials, the costs of materials and the costs of achieving ecological responsibility can be substantial.

On the other hand, many or even most containers require some degree of reliable structural integrity. Among other things, they may be stacked three or four (or more) high on pallets for storage and/or transportation, and there may be other pallets or objects stacked on top of those stacks.

Square, rectangular or other cornered containers can more efficiently use a given volume of space on a pallet and/or in a warehouse or retail store (as compared to conventional round plastic buckets). They can benefit from the foregoing reduction in material usage and can provide design and performance challenges as compared to non-cornered containers.

Design and performance characteristics for a container or other product also may be important with respect to material selection. For example, in certain applications, one material may be preferred or even required instead of another (e.g., polypropylene instead of polyethylene) in order to meet performance criteria (such as the ability to withstand anticipated vertical compression loads or other forces).

In addition, reducing the nonmaterial costs of manufacture also improves the economic and ecological considerations of making and using a given container. For example, to the extent that the energy requirements for making a given container can be reduced, the economic and environmental characteristics of the container and fabrication process are also improved. For applications and processes such as injection molding of plastic containers or other products, a lower injection pressure (to inject the plastic into a mold) can mean that less energy is needed to manufacture that product.

Accordingly, it is desirable to provide methods and apparatus for containers having sufficient strength and durability to withstand heavy loads and predictable storage and handling risks, while reducing costs and usage of materials and providing other benefits.

Containers (such as plastic injection-molded buckets or pails or the like) come in a wide variety of shapes and sizes. Commonly, these have generally flat and/or smooth curved sidewalls. Sometimes reinforcing ribs or other features are formed or provided on the exterior and/or interior of the container. In many applications, the containers are designed to be nestable and stackable. When the containers are filled, the stacking loads can be substantial, and the sidewalls typically have to be designed and tested to support and withstand certain threshold requirements (to avoid failure when they are dropped or stacked, etc.).

When sufficient force is exerted downwardly on such containers, the container can collapse or "fail." Commonly, this failure begins with or includes the weakest point of the container sidewall buckling in or out (toward or away from the inside of the container). Among other situations, such loading and buckling failures can occur when filled containers are stacked too high on top of each other. Even for unstacked single containers, however, sufficient force can cause such a failure.

Thus, there is a need to provide a container with improved strength and durability that can withstand heavy loads (such as weight imposed by stacking filled containers, or any other kind of force applied downwardly) without bending or crumpling.

In addition, containers may need to include provisions for being child resistant, for example, to prevent access to hazardous materials. Improved features may also be necessary in order to prevent unintentional access to container contents, such as in storing or transporting hazardous materials.

Tear strips have commonly been provided to enable relatively easy removal of lids from their associated containers. They can also provide some evidence of tampering with respect to the sealed container (e.g., whether the sealed container has been opened previously). Such tear strips have been provided within injection-molded lids, among others.

Within injection-molded lids, however, it can remain relatively difficult for a user to grasp the end of the tear strip to initiate removal of the tear strip. Simple tabs formed at the end of the tear strip remain relatively unsatisfactory in that regard, at least in comparison to the present invention. Other approaches do not provide a reusable lid to cover the container opening once the tear strip is removed, require more complicated molding, may be less capable of being stacked and nested (especially with other existing containers and lids), and have other shortcomings.

Accordingly, it is an object of this invention to provide an improved solution incorporating a tear strip combination.

SUMMARY OF THE INVENTION

It is, therefore, an object of the present invention to overcome the deficiencies of the prior art to include a container and lid assembly that will provide for functionality for storing products, address environmental concerns in manufacturing yet be sufficient for providing structural integrity to perform at a high level in service. Advantages of the present invention also include practical features for integrating components for storage and transport while providing tamper resistant features.

In accordance with a disclosed exemplary embodiment, a container and lid is provided that, in at least some aspects of the invention, comprises a container body having an opening, a lid body configured to cover the opening of the container body to form an assembly, and an extended bumper portion at a periphery of the container body and substantially at the opening, wherein the bumper portion comprises a removable tear strip integrated into the material of the bumper portion. The tear strip is configured to prevent access to a security mechanism of the assembly.

In accordance with another disclosed exemplary embodiment, a container is provided that, in at least some aspects of the invention, comprises a container body having an opening and an extended bumper portion at a periphery of the container body and substantially at the opening. The bumper portion is configured to receive a lid body configured to cover the opening of the container body to form an assembly, wherein the bumper portion comprises a removable tear strip integrated into the material of the bumper portion and wherein the tear strip is configured to prevent access to a security mechanism of the assembly.

In yet another disclosed exemplary embodiment, a lid is provided that, in at least some aspects of the invention, comprises a lid body configured to cover an opening of a container body, a pivoting portion and a lid hinge. The lid hinge may be configured to allow the pivoting portion to open while a remaining portion of the lid body remains closed. The lid may further comprise at least one locking tab having at least one slot disposed on a periphery of the lid body.

There has thus been outlined, rather broadly, certain embodiments of the invention in order that the detailed description of the invention herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as in the abstract, are for the purpose of description and should not be regarded as limiting.

As such, those skilled in the art will appreciate that the concept upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Still other aspects, features and advantages of the present invention are readily apparent from the following detailed description, simply by illustrating a number of exemplary embodiments and implementations, including the best mode contemplated for carrying out the present invention. The present invention also is capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The accompanying drawings, which are incorporated herein and constitute part of this specification, illustrate exemplary embodiments of the invention and, together with the detailed description given below, serve to explain the features of the invention.

DETAILED DESCRIPTION OF THE PREFERRED EMBODIMENTS

Description

Figure 1:
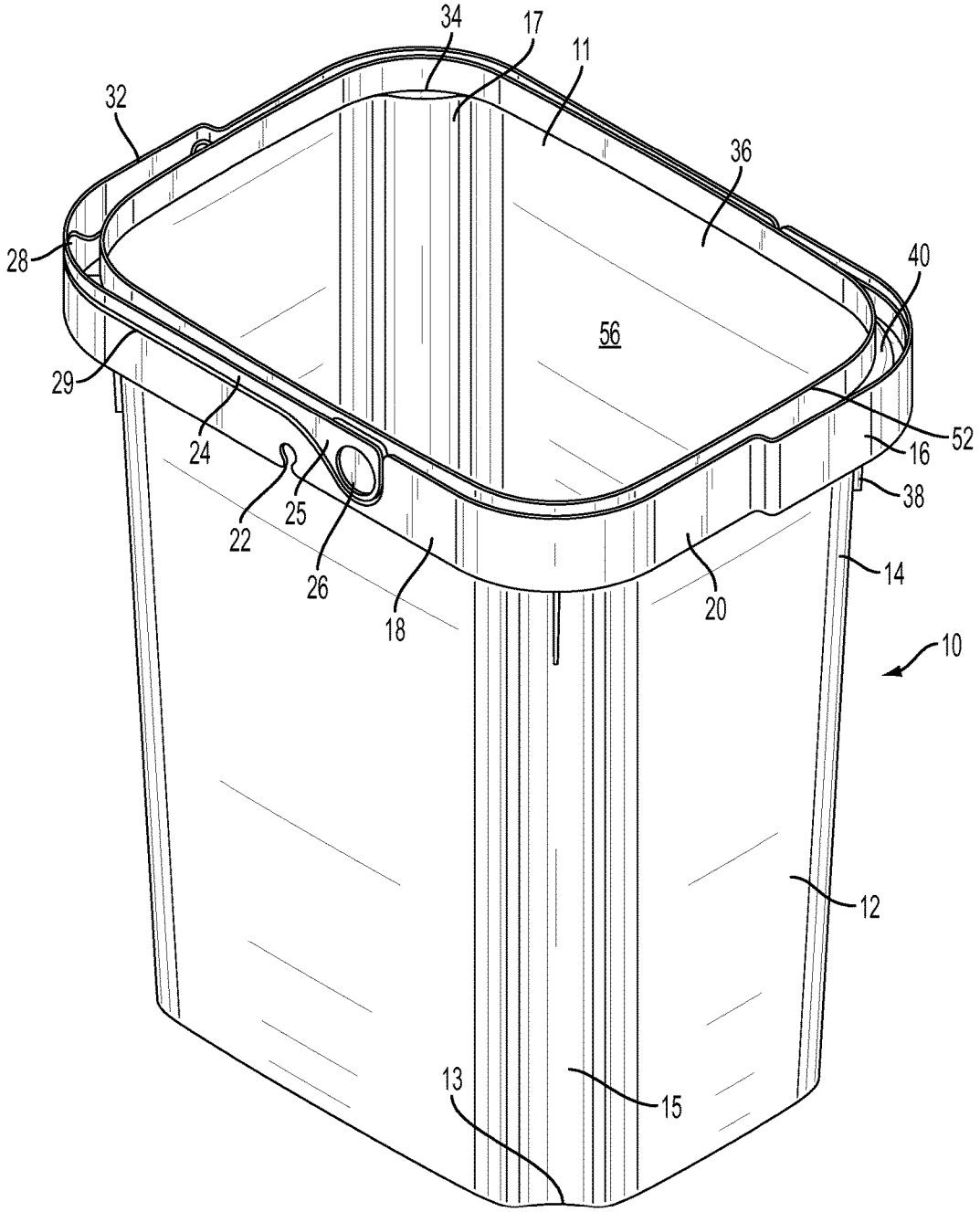
FIG. 1 illustrates a perspective view of a container in accordance with an embodiment of the invention.

The invention will now be described with reference to the drawing figures, in which like reference numerals refer to like parts throughout. The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Containers include a body having an opening through which contents may be added or removed. The containers may have a base and sidewalls extending upwardly therefrom. The sidewalls may include an upper edge defining an opening to the container, or the opening may be at another portion of the container. The sidewalls may be in the shape of a circle, forming a round container. The sidewall may include one or more corners and/or straight sidewall portions, forming a container in the shape of, for example, a triangle, square, rectangle, pentagon, hexagon or octagon. The container may be a round container with a square opening or an oval container with a rectangular opening.

Compared with rectangular or square containers, for example, round containers may take more space on a production line, in a warehouse, in a truck (empty and full) during transportation and on store shelves. Thus, round containers may be more expensive and less environmentally friendly.

Lids include a body configured to cover the opening of the container and may include a skirt around the periphery of the lid body.

The container and lid may be manufactured from any suitable material, such as a strong and resilient plastic, such as polyethylene or polypropylene, and may be manufactured by any suitable method, such as injection molding or blow-molding. The method may include forming a mold having a cavity having the final or near-final shape of the container or lid and injecting a molten material into the cavity of the mold.

Figure 55:
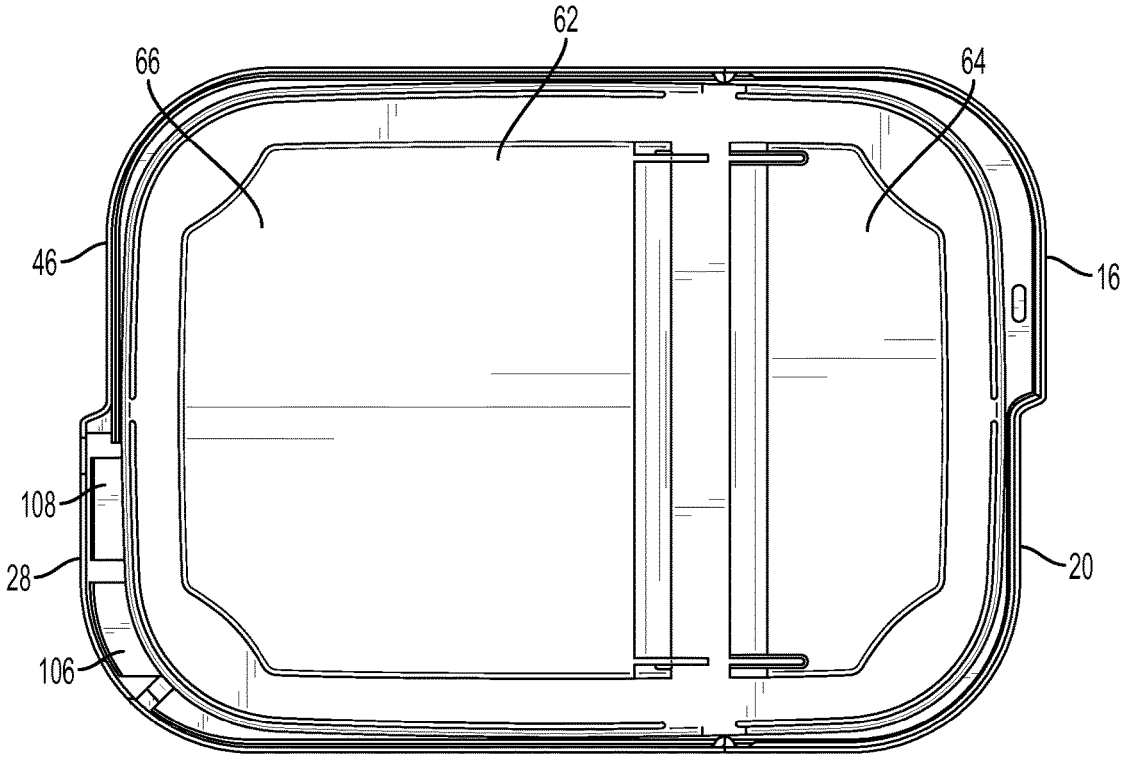
FIG. 55 illustrates a top plan view of the container of FIG. 47 assembled in connection with the lid of FIG. 16 in accordance with an embodiment of the invention.

Additional aspects of illustrated embodiments of the present invention will be described below with reference to FIGS. 1-55.

FIGS. 1-3 and 7-10 illustrate multiple views of a container 10 according to an embodiment of the present invention. Container 10 includes sidewalls 12 for forming an exterior body. Sidewalls 12 taper outwardly as they extend upwardly such that like containers 10 may be nested inside one another through an opening 11 of container 10, as discussed below. Sidewalls terminate at edge 52 extending along a perimeter of container 10 to form opening 11. Edge 52 may be utilized to receive a lid to form an assembly, as detailed below. Bead extensions 48, 49 (FIG. 3) may be formed in an area of edge 52 to interact with a lid of container 10 to lock the lid thereto, as discussed below.

One or more corrugations or fluting members 14 may be provided at the intersection of adjoining sidewalls 12. Among other things, the corrugations or fluting members 14 help strengthen sidewalls 12 of container 10 and thereby the entire container assembly. In disclosed embodiments of the invention, corrugations or fluting members 14 are formed in corner areas 15 of container 10. Corrugations or fluting members 14 can be shaped and located and sized in a wide variety of ways and still provide some of the benefits of the invention. Corrugations or fluting members 14 are illustrated as indentations at each corner of a substantially square or rectangular container 10, and extending substantially the full height of sidewalls 12. Persons of ordinary skill in the art will understand that many factors can be customized to provide a desired balance of strength, weight and performance for a desired application. These include, by way of example and not by way of limitation, the depth of the indentations, the thickness of sidewall 12 at those locations, the sharpness of the angle indentations with respect to the adjacent sidewall areas, the angularity of indentations or smoothness in cross-section, the frequency and regularity of the pattern of the indentations, the spacing between the indentations and other factors. The disclosed embodiment illustrates a curved shape 13 of corrugations or fluting 14. It is noted that an inwardly deformed shape of corrugations or fluting members 14 may displace a corresponding inverted shape of material and shape into the interior 56 of container 10, thereby forming interior corners 17. Accordingly, the wall thickness of interior corners 17 may be thicker than the rest of the interior sidewalls 36.

Figure 14:
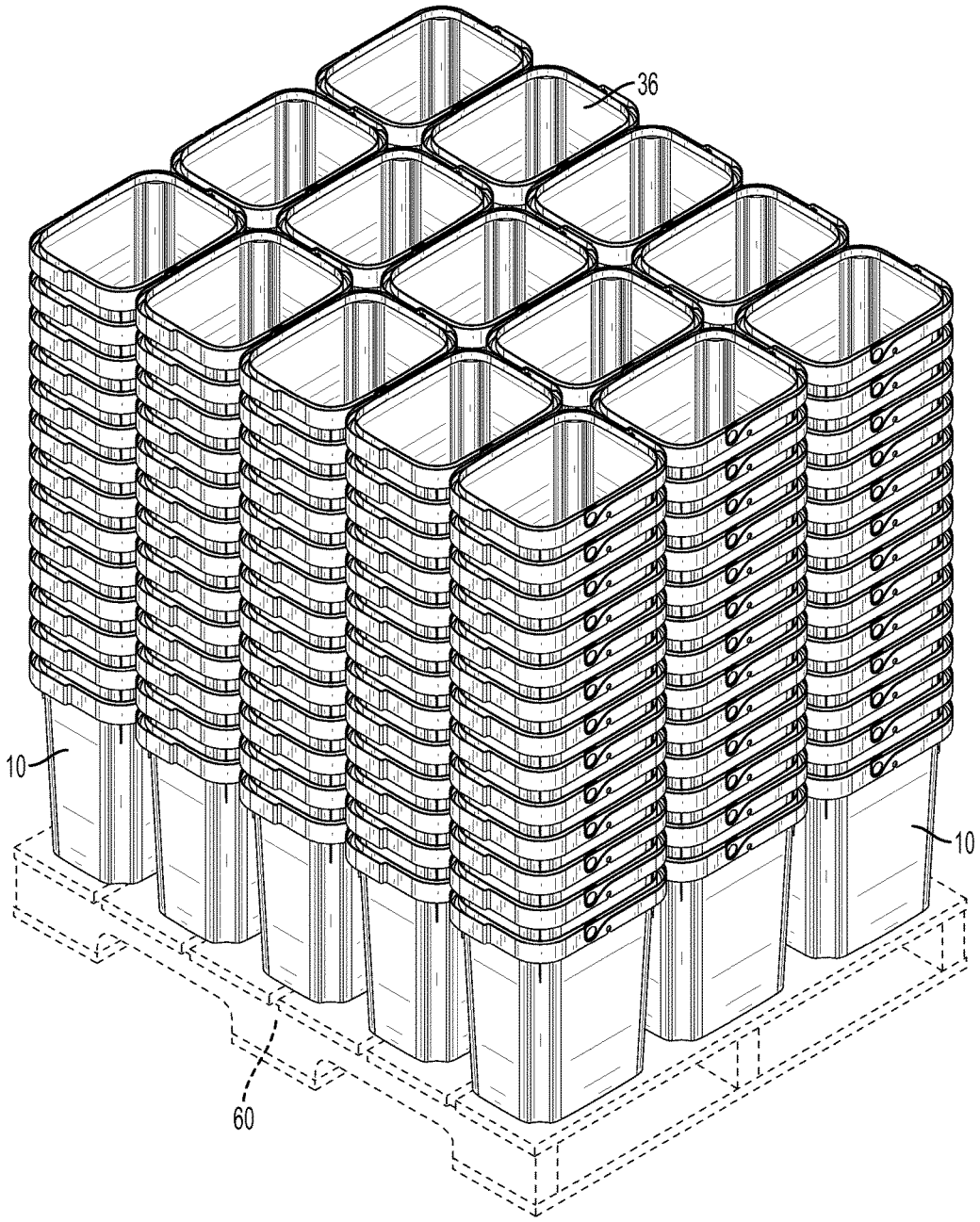
FIG. 14 illustrates a perspective view of multiple stacked containers of the embodiment shown in FIG. 1 in accordance with an embodiment of the invention.
Figure 15:
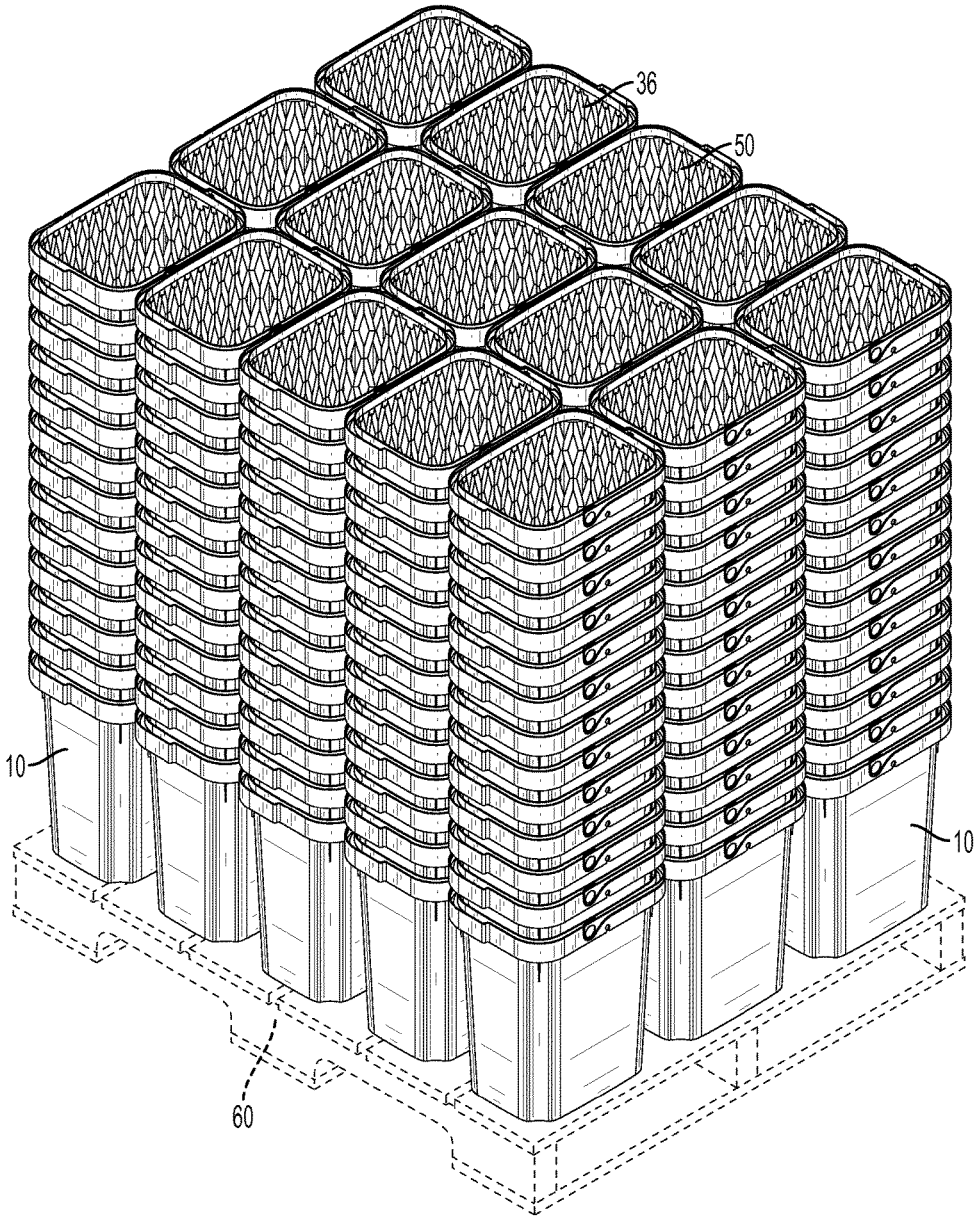
FIG. 15 illustrates a perspective view of multiple stacked containers of the embodiment shown in FIG. 4 in accordance with an embodiment of the invention.

An interior corner step 34 may be formed at each corner of container 10. Interior corner steps 34 serve as a nesting feature for stacking another container 10 within the interior 56 of a first container 10. Ribs 38 are provided at exterior corners of container 10 and generally within corrugations or fluting members 14. In disclosed embodiments, ribs 38 are displaced upwardly along corrugations or fluting members 14 towards opening 11. In an assembled fashion, when one container 10 is placed within opening 11 of another container 10, ribs 38 rest upon corresponding interior corner steps 34. Ribs 38 prevent a complete insertion of one container within another. This prevents a possible vacuum sealing and facilitates easy separation of containers 10 from one another. An example of a stacked configuration of containers 10 is shown in FIGS. 14-15.

A bumper 18 is formed around opening 11 and along an upper perimeter edge of sidewalls 12 and extends generally away from sidewalls 12. Bumper portion 18 may include recessed perimeter edge portions 20 and 46 (FIG. 3) and extended perimeter edge portions 16 and 28 along one length thereof. Extended perimeter edge portions 16 and 28 serve as a handle grip to facilitate movement and/or securing of container 10. As discussed below, extended perimeter edge portions 16 and 28 may also assist in removing a lid from container 10 by providing a grip portion for a user. In addition, extended perimeter edge portions 16 and 28 serve as an interlock feature for securing together abutting containers 10, for example, for the purpose of shipping or storing multiple containers, as discussed below.

Bumper 18 may include a tear strip 24. Disclosed embodiments provide tear strip 24 integrated into the material of bumper 18, yet removably from bumper portion 18 along a tear line 29, as discussed below. In the illustrated embodiment, if an attempt is made to tamper with the contents of container 10, evidence of the tampering would be found in the state of tear strip 24, such as a portion of tear strip 24 being torn or bent. In addition or in place of the tear strip 24, other indicators of tampering may be employed. For example, tape, a shrink wrap or a shrink band may be wrapped around the container periphery.

As illustrated, tear strip 24 of bumper 18 may include a pull ring 25 having an opening 26 for receiving a user's finger in order to grip tear strip 24 to remove it from bumper 18. In a disclosed embodiment, pull ring 25 allows tearing of bumper 18, by removing tear strip 24, from one side to the other of container 10. Opposite pull rings 25 may be provided on opposite sides of bumper 18 to facilitate removal of tear strip 24 from a selection of vantage points. Bumper 18 may also include a tear line 29 to facilitate guidance of the tear strip removal from bumper 18. In general, tear strip 24 may comprise approximately ⅔ A of the circumference of the material of bumper 18.

Figure 3:
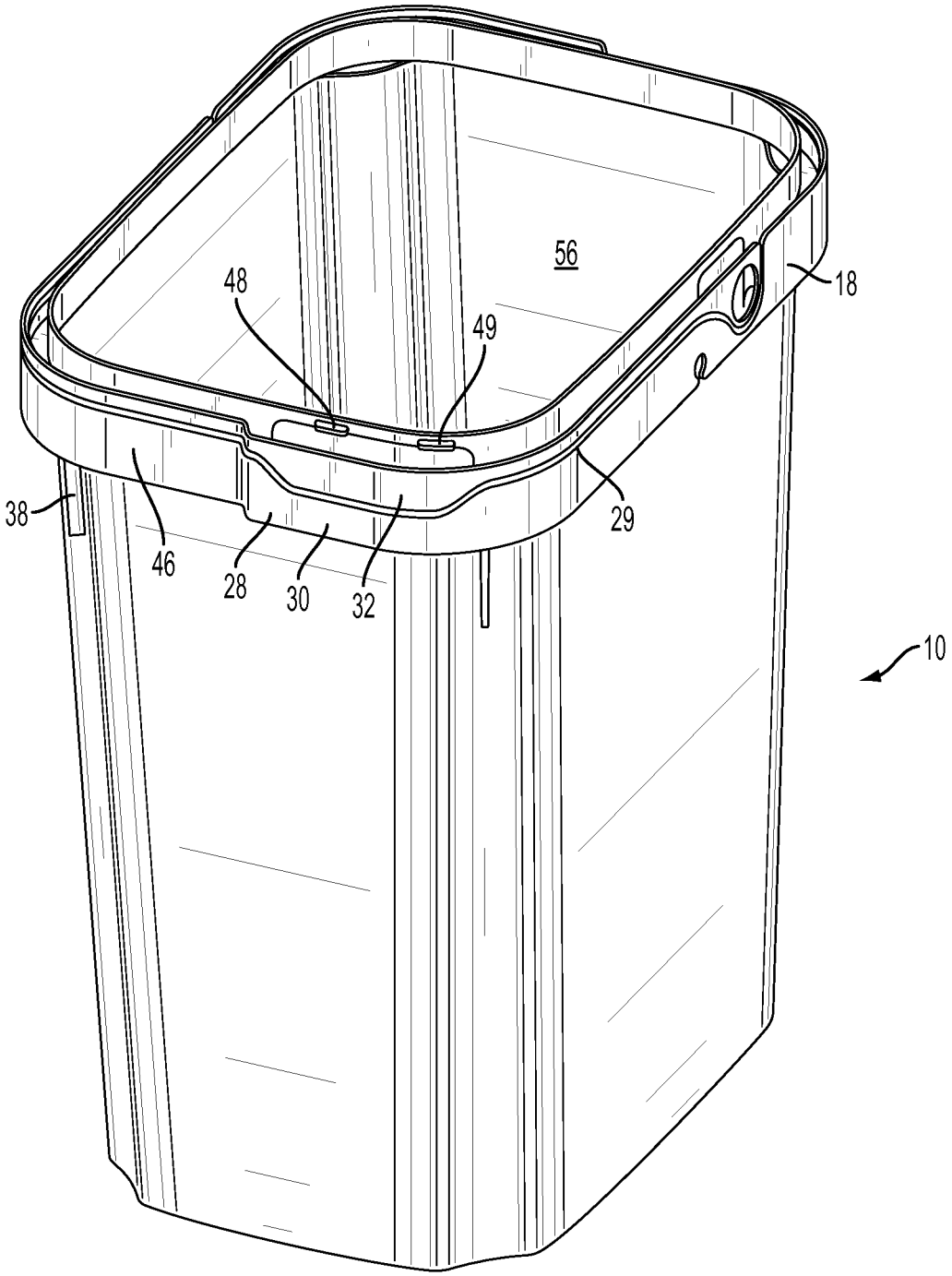
FIG. 3 illustrates another perspective view of the container of FIG. 1 in accordance with an embodiment of the invention.
Figure 4:
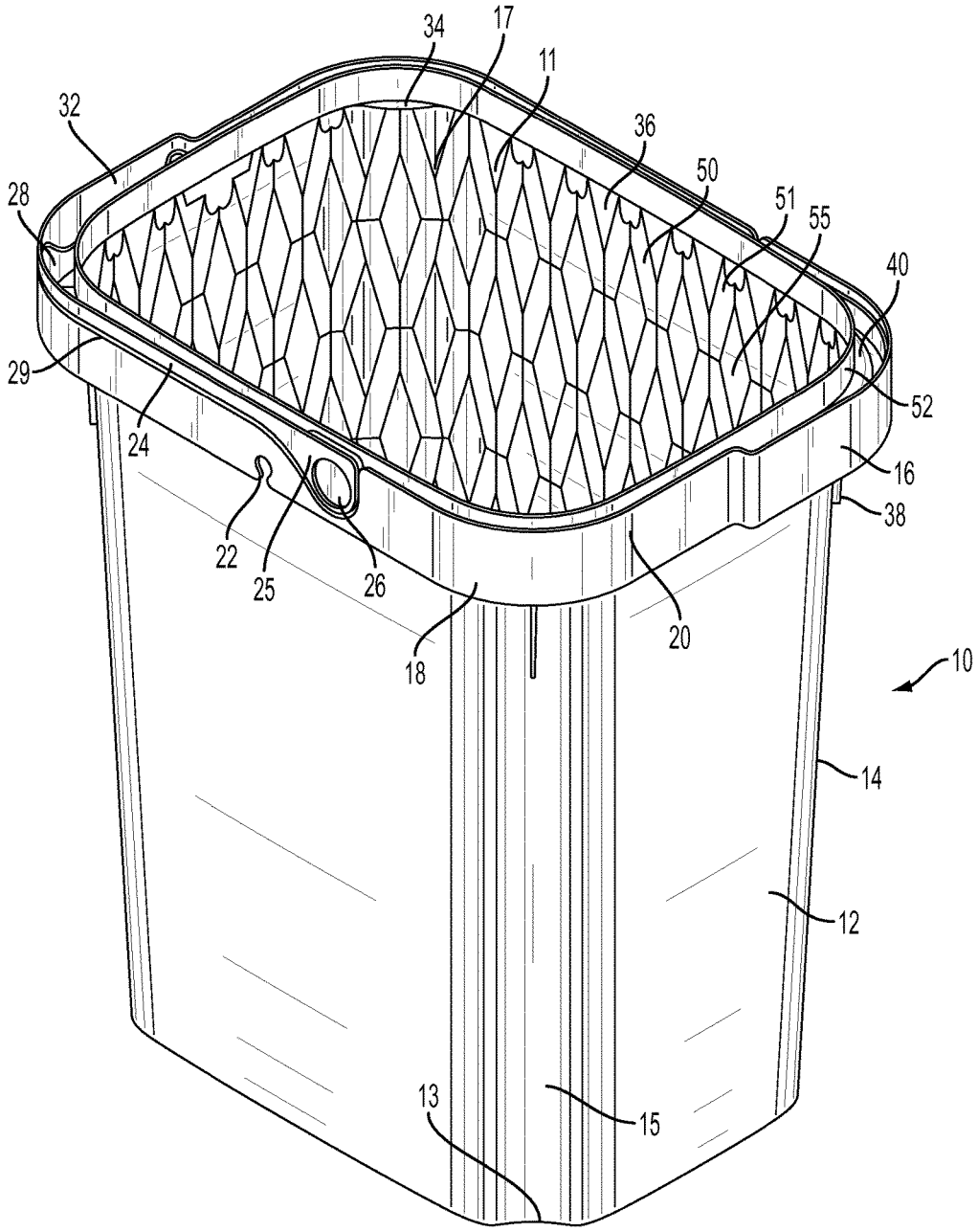
FIG. 4 illustrates a perspective view of a second embodiment of a container in accordance with an embodiment of the invention.
Figure 5:
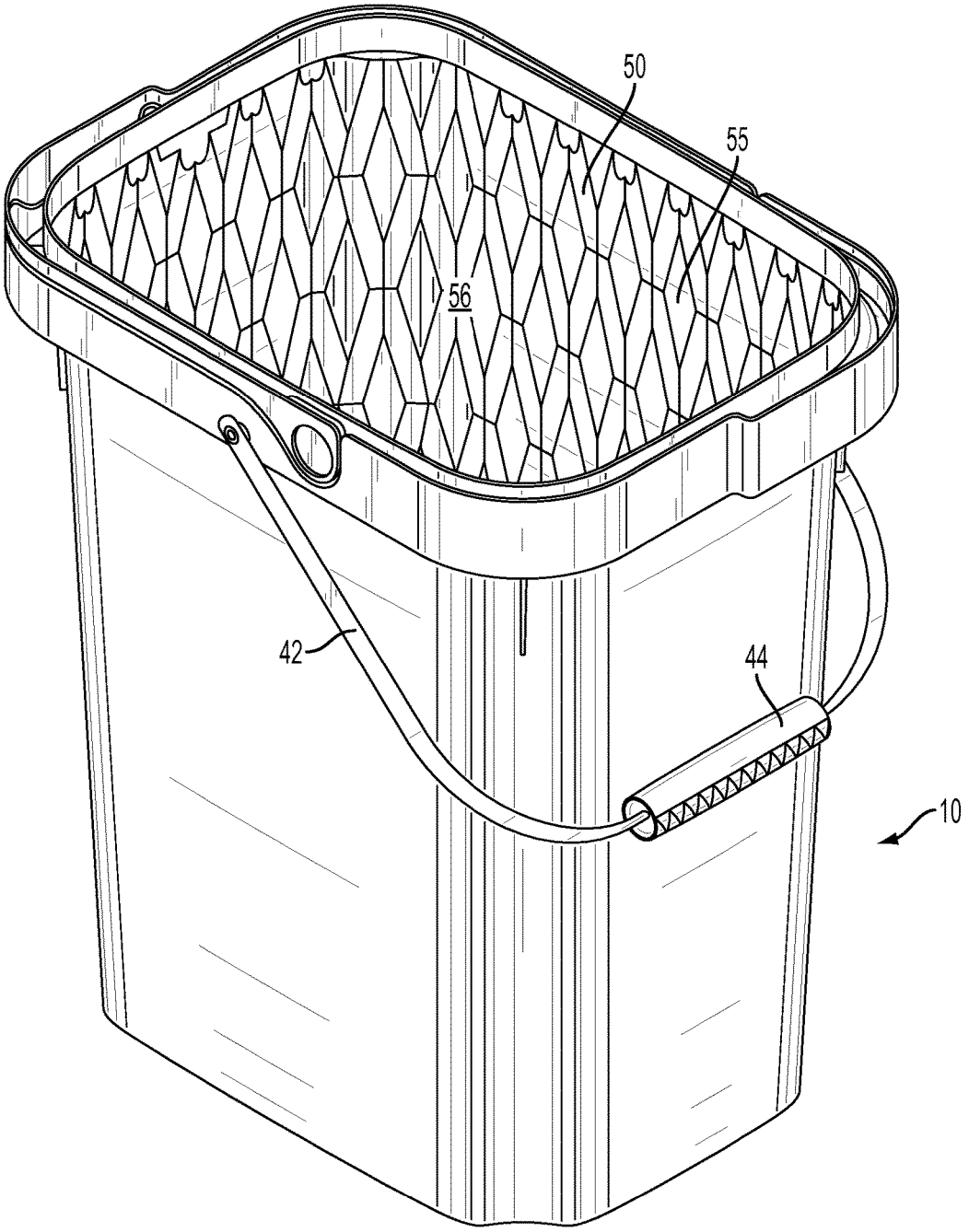
FIG. 5 illustrates a perspective view of the container of FIG. 4 having a handle in accordance with an embodiment of the invention.
Figure 6:
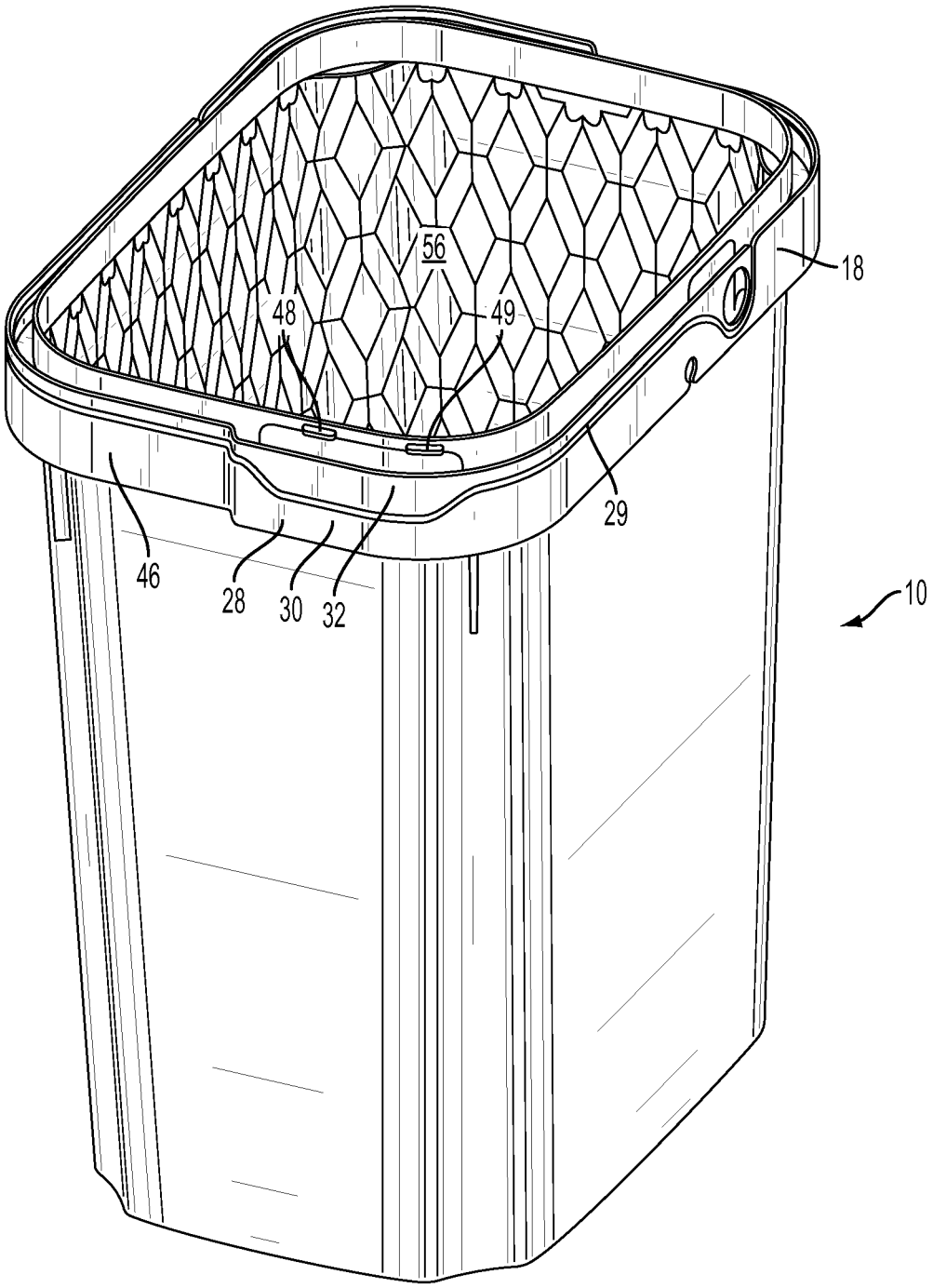
FIG. 6 illustrates another perspective view of the container of FIG. 4 in accordance with an embodiment of the invention.
Figure 7:
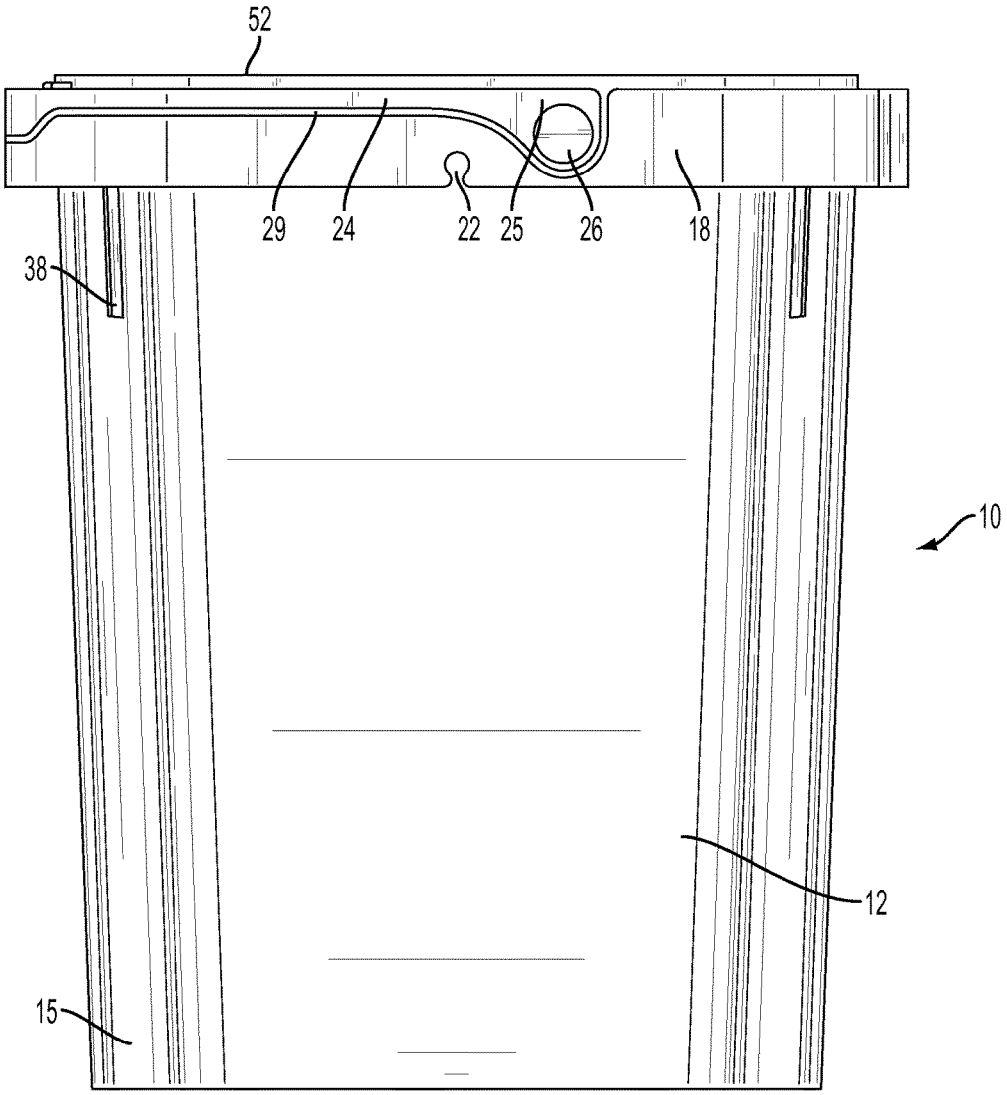
FIG. 7 illustrates a front plan view of the container shown in FIG. 1 in accordance with an embodiment of the invention.
Figure 8:
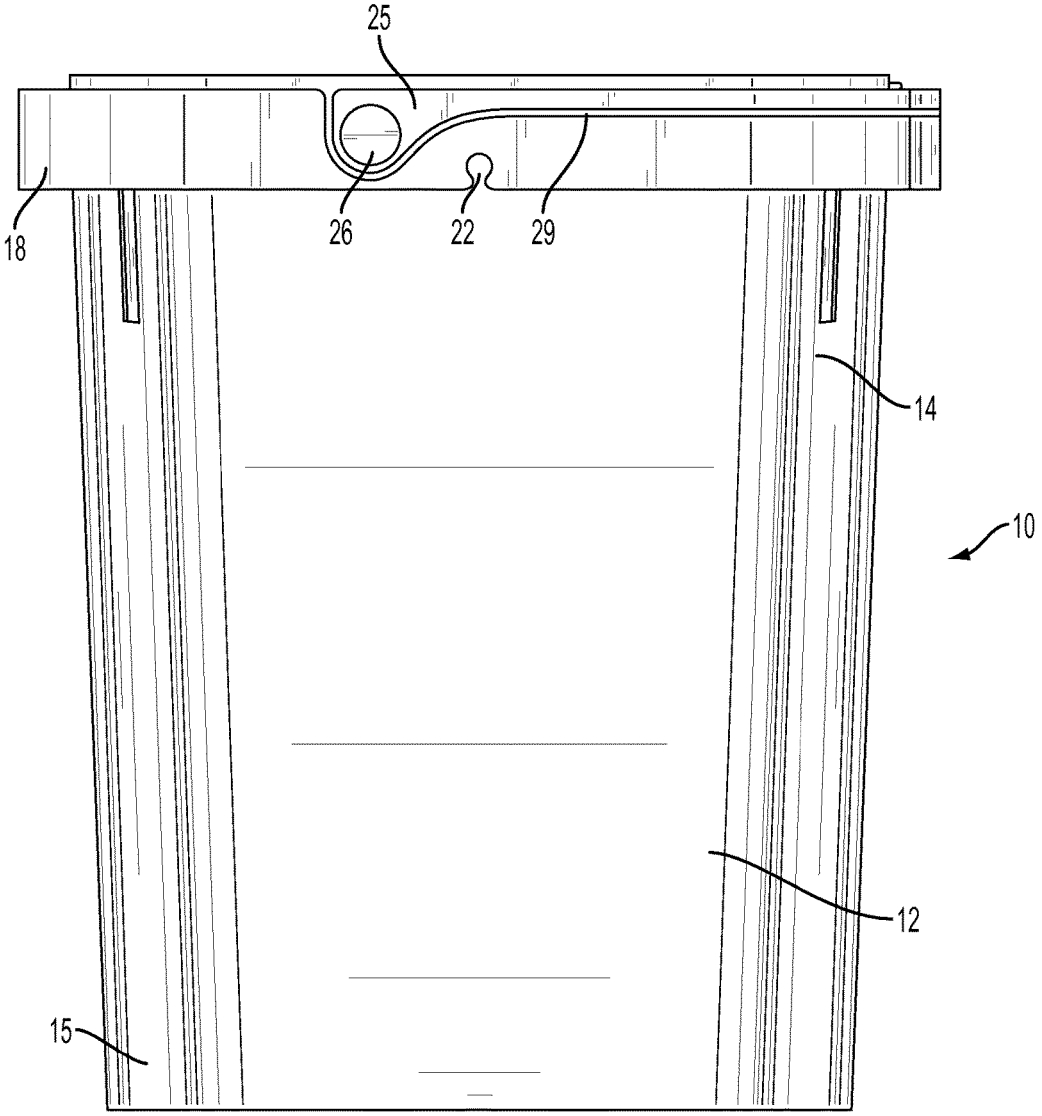
FIG. 8 illustrates a rear plan view of the container shown in FIG. 1 in accordance with an embodiment of the invention.
Figure 9:
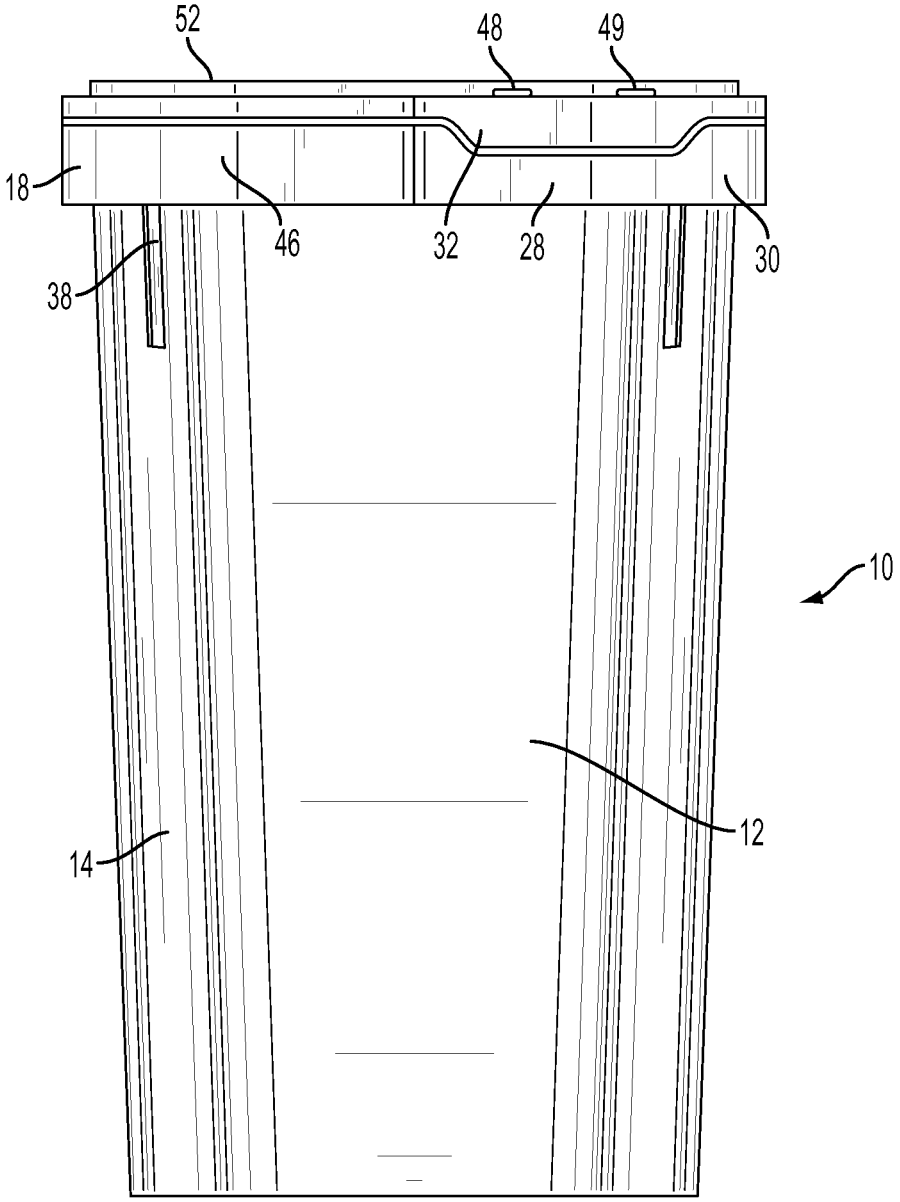
FIG. 9 illustrates a left plan view of the container shown in FIG. 1 in accordance with an embodiment of the invention.
Figure 10:
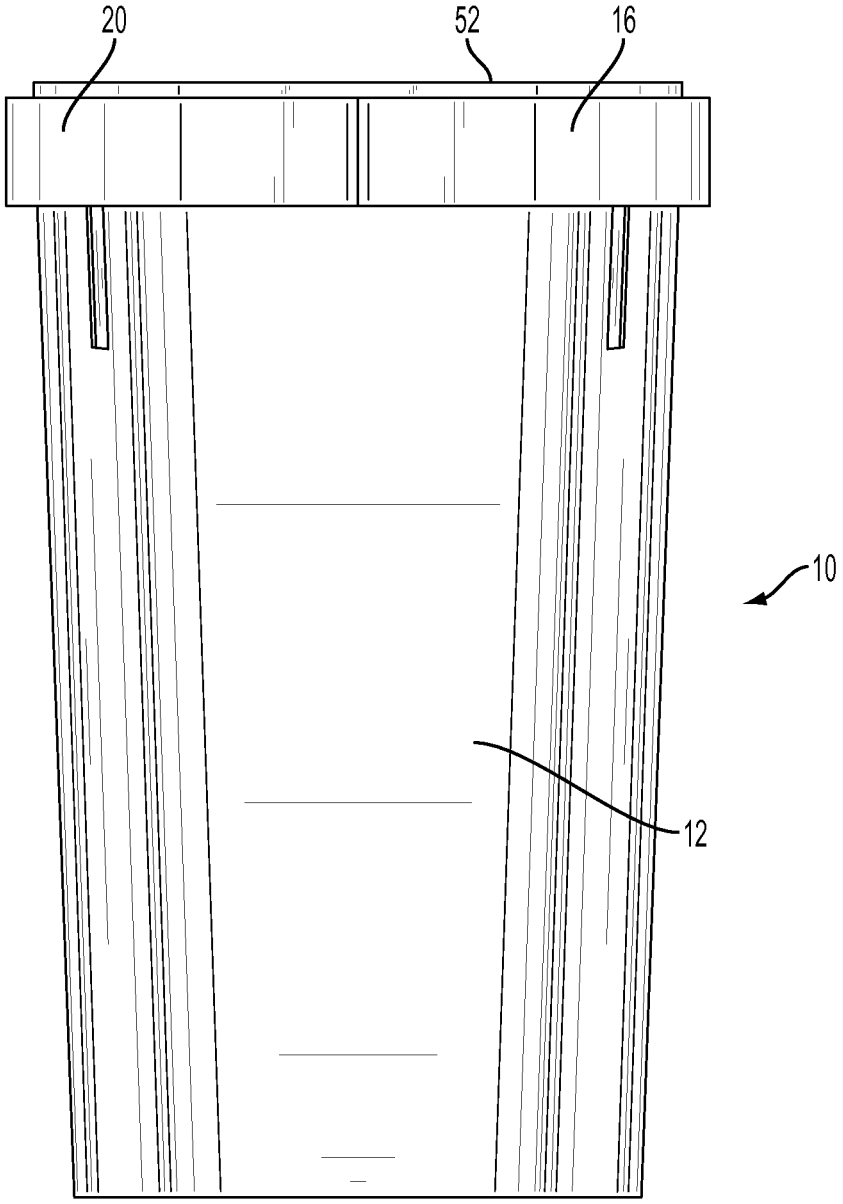
FIG. 10 illustrates a right plan view of the container shown in FIG. 1 in accordance with an embodiment of the invention.

Turning to FIG. 3, an engaging portion 32 of tear strip 24 is substantially shaped such that a bottom of engaging portion 32 traversing along tear line 29 traverses downwardly and then back upwardly (e.g., engaging portion 32 is shaped to have a greater height than a remaining portion of tear strip 24) at an area where a child-resistant feature is disposed. Engaging portion 32 engages the aforementioned child-resistant feature to facilitate securing a lid to the container and to prevent removal of a lid, as discussed below. Tear strip 24 is designed such that once it is removed, engaging portion 32 is also removed together therewith to create an opening or access to the child-resistant feature. FIGS. 38-46 illustrate container 10 having tear strip 24 removed, creating an opening or access area 33 at a location of the child-resistant feature.

Figure 2:
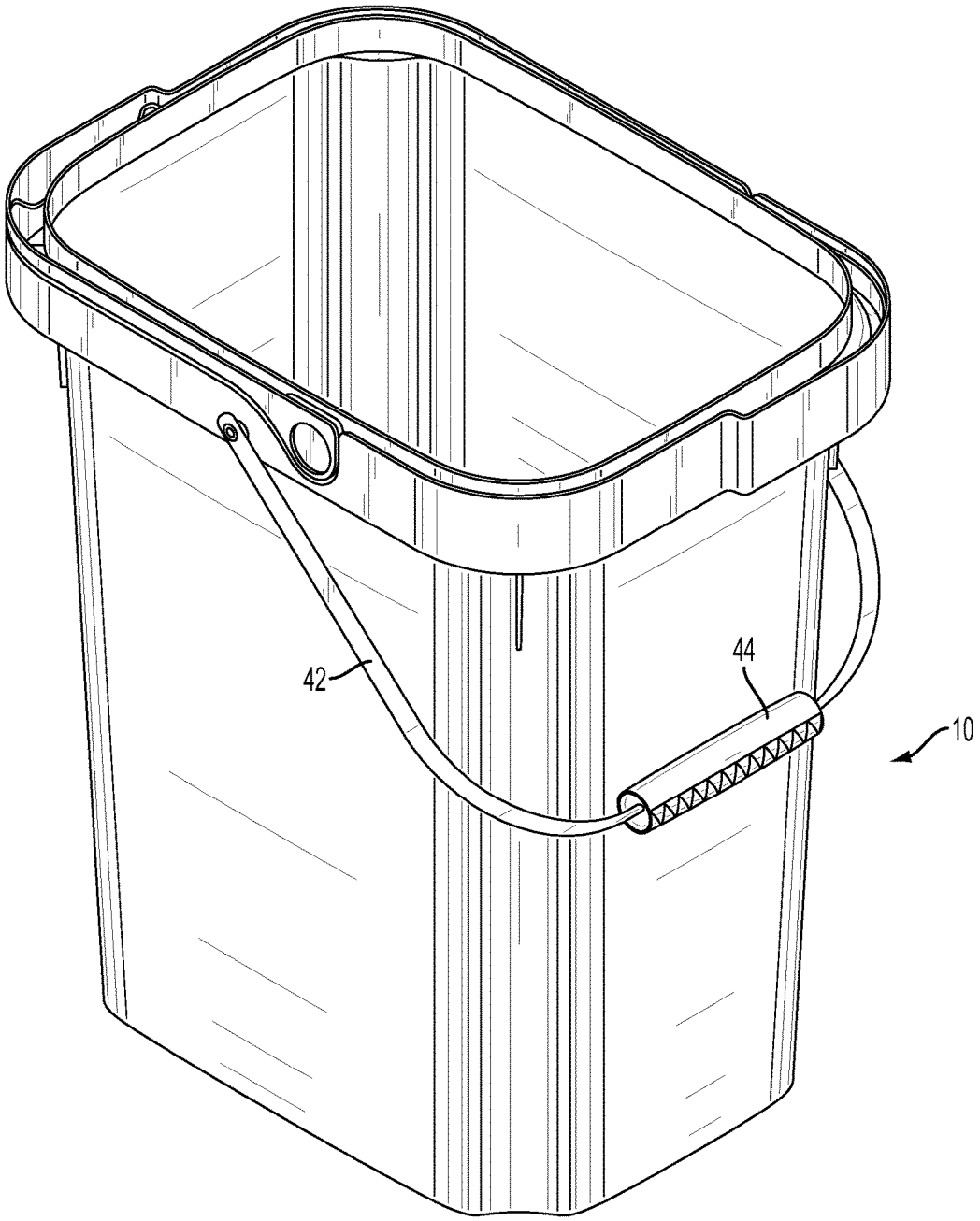
FIG. 2 illustrates a perspective view of the container of FIG. 1 having a handle in accordance with an embodiment of the invention.

Key slot holes or bail ears 22 may be formed in bumper 18 for receiving a handle 42, as shown in FIG. 2. While a key slot hole is illustrated in FIG. 1, any other receiving means for securing a handle to container 10 may be utilized. Handle 42 may comprise a grip 44 to facilitate the carrying of container 10. Embodiments of handle 42 and grip 44 may include plastic or wire materials or any other components and/or materials sufficient for serving as a handle means for the carrying of container 10.

Figure 11:
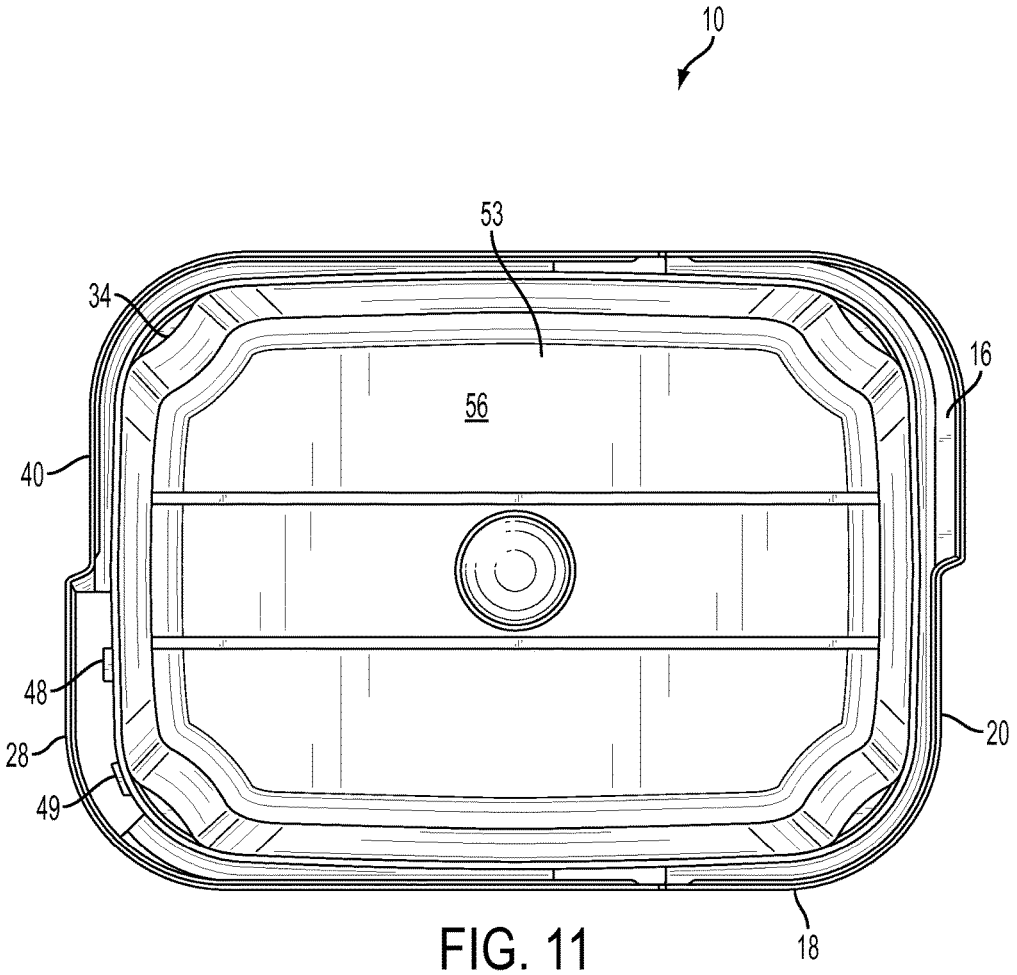
FIG. 11 illustrates a top plan view of the container shown in FIG. 1 in accordance with an embodiment of the invention.
Figure 12:
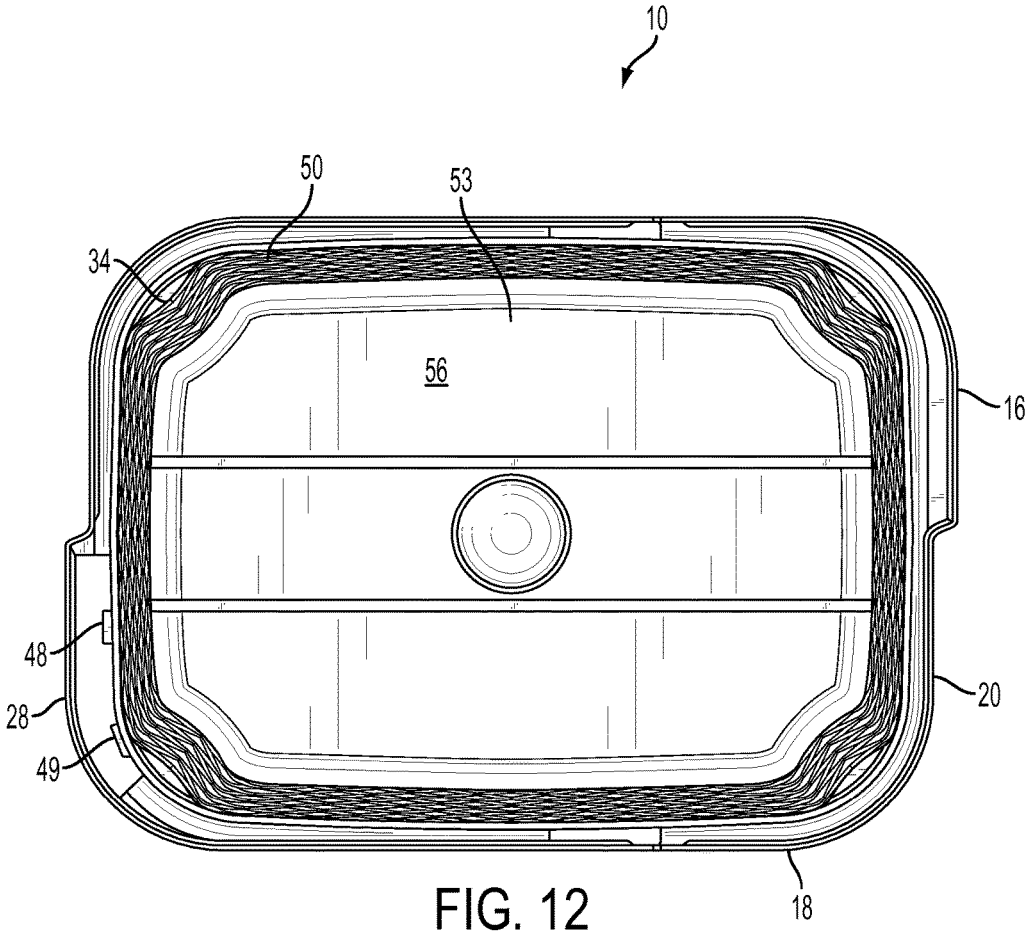
FIG. 12 illustrates a top plan view of the container shown in FIG. 4 in accordance with an embodiment of the invention.

FIG. 11 illustrates a top plan view of the container shown in FIG. 1 in accordance with an embodiment of the invention. Container 10 may include a central base portion 53 and a peripheral base portion 54 to form an interior bottom of the container. Interior sidewalls 36 formed in connection with interior corners 17, central base portion 53 and peripheral base portion 54 form interior 56 of container 10.

FIGS. 4-6 and 12 depict another embodiment of container 10 wherein a reinforcing or strengthening web 50 is incorporated into the design of interior sidewalls 36. Interior sidewalls 36 and interior corners 17 of container 10 include a reinforcing web 50 on their inside surfaces, extending substantially the full height of the interior sidewalls 36 and interior corners 17 and terminating near the top and bottom of interior sidewalls 36. Reinforcing web 50 includes channels 51 having an increased wall thickness as compared to adjacent non-web portions 55. Channels 51 are patterned into a series of rows and columns, and in some embodiments, an upright diamond pattern, when viewed in elevation, may be created. Reinforcing web 50 on interior corners 17 is substantially a continuation of the upright diamond pattern present on the other portions of interior sidewalls 36. As shown, the pattern of reinforcing web 50 is substantially centered along the vertical centerline of interior corners 17.

Figure 13:
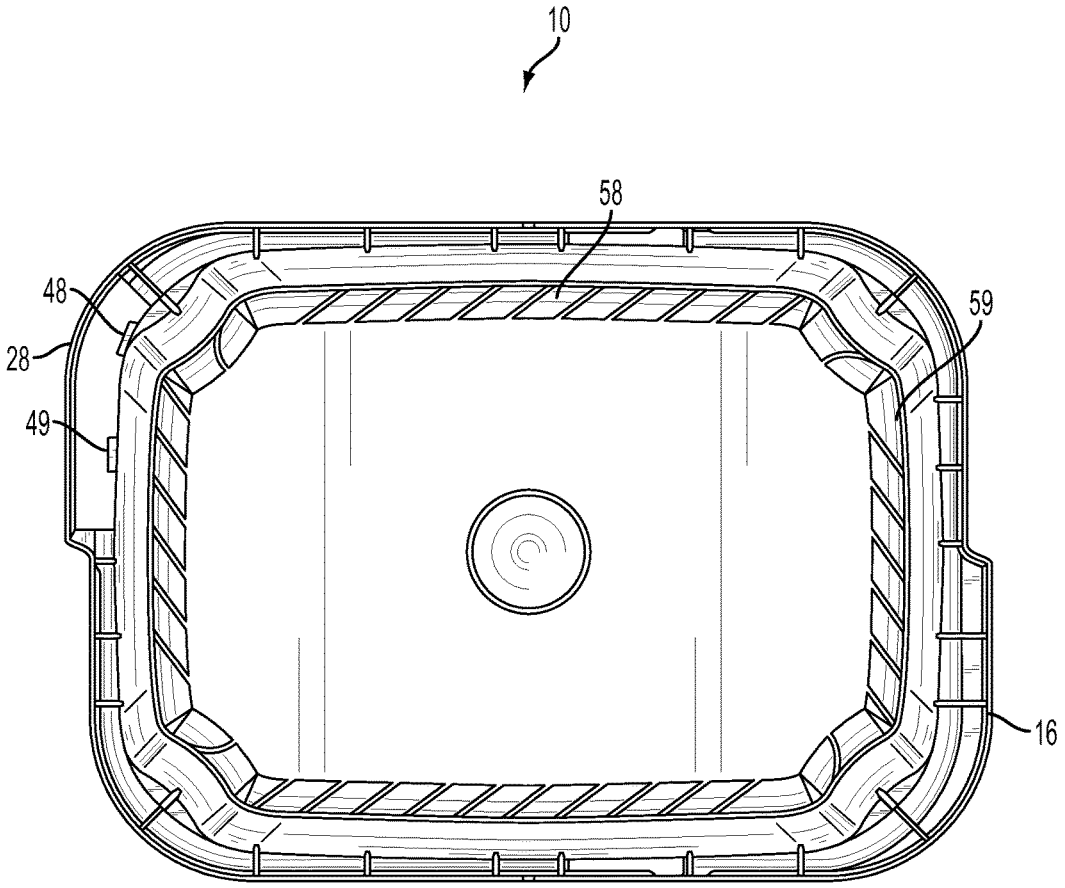
FIG. 13 illustrates a bottom plan view of the container shown in FIG. 1 in accordance with an embodiment of the invention.

FIG. 13 is a bottom view of container 10. Container 10 may include base strengthening ribs 58 at the peripheral base portion 59. Base strengthening ribs 58 may connect to the sidewalls 12, the peripheral base portion 107 and a junction formed by the sidewalls 110 and the peripheral base portion 107. Further, base strengthening ribs 58 may be arranged to be non-perpendicular to the sidewalls 12 of container 10 to facilitate increased strengthening of container 10.

FIGS. 16-23 illustrate alternating views of a lid 62 in accordance with an embodiment of the invention. The body of lid 62 may include a first raised portion 64 and a second raised portion 66 and a valley portion 72 therebetween. As illustrated, first raised portion 64 and second raised portion 66 include substantially horizontal or flat top surfaces 63, 65 so that they will generally resist collecting material such as water or other liquids. First raised portion 64 and second raised portion 66 may also include substantially vertical side surfaces 114 near the periphery of lid 62, and angled surfaces 115 facing each other.

Figure 35:
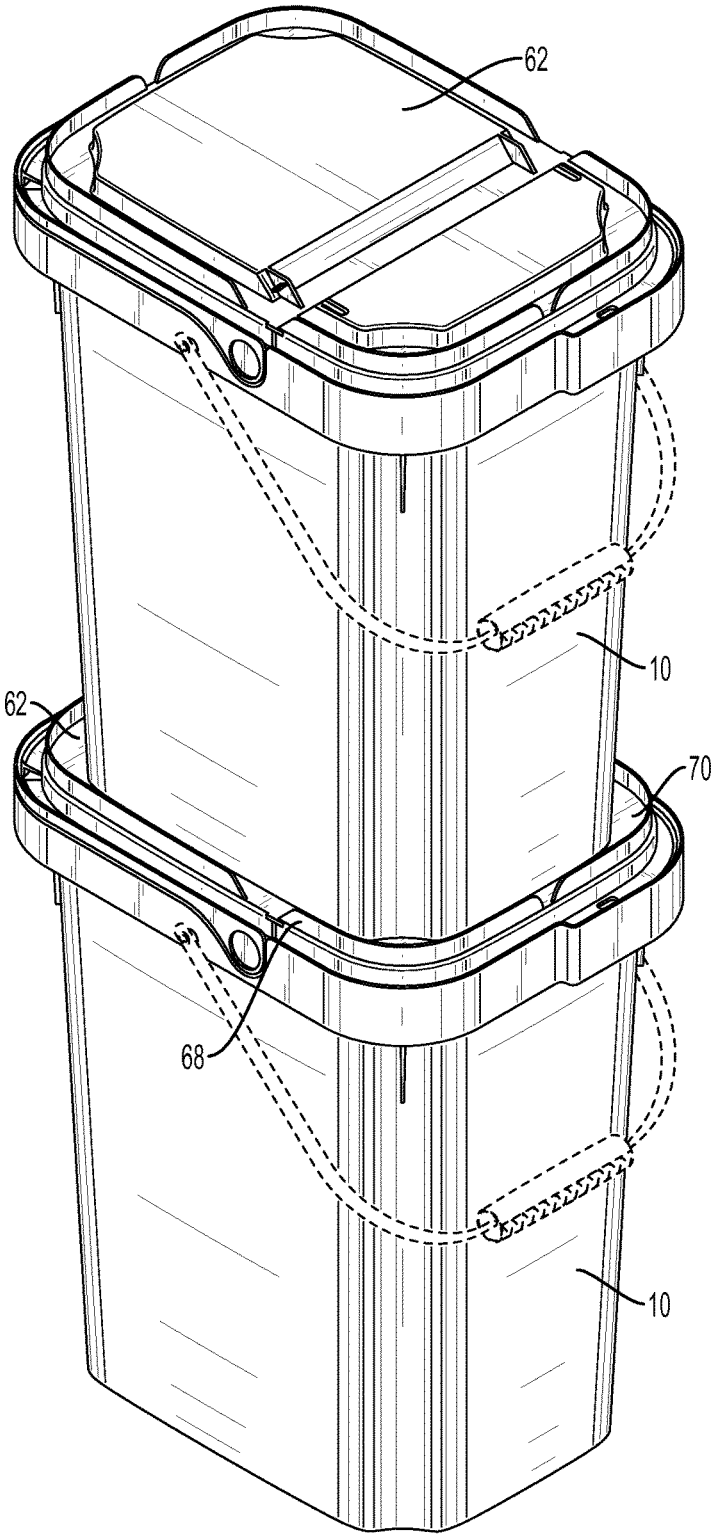
FIG. 35 illustrates a perspective view of multiple stacked container and lid assemblies of the embodiment shown in FIG. 27 in accordance with an embodiment of the invention.

In some aspects, container 10 may be stacked on lid 62. Disclosed embodiments provide for container 10 having an elevated central base portion 53 wherein first raised portion 64 and second raised portion 66 may extend upward toward central base portion 53, as shown, for example, in FIG. 35. With an elevated central base portion 53, sidewalls 12 of container 10 may extend downwardly beyond central base portion 53. In a stacked configuration, sidewalls 12 may extend to fit around first raised portion 64 and second raised portion 66 of lid 62. In this case, side surfaces 114 of first raised portion 64 and second raised portion 66 may be closely adjacent or abut inside surfaces of container sidewalls 12. Corners 112 of first raised portion 64 and second raised portion 66 facing the periphery of lid 62 may be designed in shape to correspond to the shape 13 of corrugations or fluting members 14 of container 10. First raised portion 64, second raised portion 66, corners 112 and vertical side surfaces 114 work cooperatively to be received within raised corresponding spaces of the bottom of container 10. Stacked accordingly, containers 10 resist sliding off of lid 62.

A plurality of openings 74, 76, 78, 80 may be created between stacking guides in order to allow drainage of any materials (e.g., liquids) that may, for example, run off of the top surface area of lid 62. An opening 100 may also be included in an extended lip portion 94 of lid 62 (e.g., see FIGS. 17 and 22-23) for draining materials from a surface thereof. In addition, cutout 102 is provided along a peripheral edge extension 92 of lid 62 to provide an escape for draining materials. Thus, peripheral edge extension 92 may serve as a channel to guide material to cutout 102 for drainage.

Lid 62 may include stacking guides 68. As shown, stacking guides 68 are formed at the four corners of lid 62 but may be formed at fewer than four corners or in at least one location on a non-rectangular lid. Stacking guides 68 are designed to guide a base of container 10 that corresponds to lid 62. When the container base is placed on the lid 62, stacking guides 68 guide the container base such that the sidewalls 12 fit between stacking guides 68 and first and second raised portions 64, 66 of lid 62. Further, stacking guides 68 may include upper surfaces that are sloped downward and inward to assist in guiding containers 10 to an appropriate stacked position. An outer valley portion 70 may also be formed at a perimeter of lid 62, such as between stacking guides 68 and vertical side surfaces 114 of first and second raised portions 64, 66. Thus valley portion 70 is formed substantially at a perimeter of lid 62 and around external perimeters of first and second raised portions 64, 66. Outer valley portion 70 may facilitate stacking of containers 10 on lid 62. For example, when sidewalls 12 extend to fit around first raised portion 64 and second raised portion 66 of lid 62, the sidewalls 12 may rest within outer valley portion 70 to assist stacking. Outer valley portion 70 also provides a pathway for directing material, (e.g., liquid) into openings 74 for drainage.

Lid 62 may include a lid hinge 71, for example, positioned in the vicinity of the valley portion 72 or in another portion. Lid hinge 71 permits pivotal movement of lid 62. This allows second raised portion 66 to be lifted and thereby pivot toward first raised portion 64. When second raised portion 66 is lifted to first raised portion 64, the angled surface 115 of second raised portion 66 is moved toward that of first raised portion 64. In one aspect, the angles of surfaces 115 are between about 30 and 60 degrees. Disclosed embodiments may provide first raised portion 64 as a stationary portion of lid 62. In an alternative embodiment, lid 62 may further include a second hinge, for example, one permitting first raised portion 64 to be lifted and thereby pivot toward second raised portion 66. In one embodiment, lid hinge 71 may be positioned along a length of lid 62 at approximately one-third of the length of a side. As such, two-thirds of lid 62 may pivot or one-third of lid 62 may pivot along lid hinge 71. However, in other embodiments, lid hinge 71 may be located at other positions along lid 62.

Lid 62 may include hinge locking ribs 73 and hinge locking slots 75. In one aspect, hinge locking ribs 73 may have a thickness approximately the same as the thickness of other portions of the lid body. As shown, hinge locking ribs 73 extend from second raised portion 66 into valley portion 72, and hinge locking slots 75 are formed in first raised portion 64. Alternatively, hinge locking ribs 73 may extend from first raised portion 64, and hinge locking slots 75 may be formed in second raised portion 66. When second raised portion 66 is pivoted to first raised portion 64, hinge locking ribs 73 extend into and are held by hinge locking slots 75, and the pivoted portion of lid 62 is held in place until a user pulls the pivoted portion of the lid closed. Disclosed embodiments provide that the raised hinged second raised portion 66 forms approximately a 135-degree opening when locked in place.

Disclosed embodiments provide components of a child-resistant closure at one end of an outer periphery of lid 62. The aforementioned components may include a plurality of slots 88, 90 placed in a corresponding position along the lid periphery to coincide with the alignment of bead extensions 48, 49, respectively, when lid 62 is assembled to container 10. A plurality of flexible tabs 84, 86 is formed and extends from a periphery of lid 62. Flexible tab 84 is formed from a portion 108 extending from a location slightly below slot 88, and a portion 109 extends downwardly therefrom. Flexible tab 86 is formed from a portion 106 extending from a location slightly below slot 90, and a portion 111 extends downwardly therefrom. Disclosed embodiments provide downwardly extending flexible tabs 84, 86 that may be urged to pivot with respect to the main body of lid 62, thereby dislodging bead extensions 48, 49 (received from container 10) from slots 88, 90, respectively, as further explained below.

Figure 16:
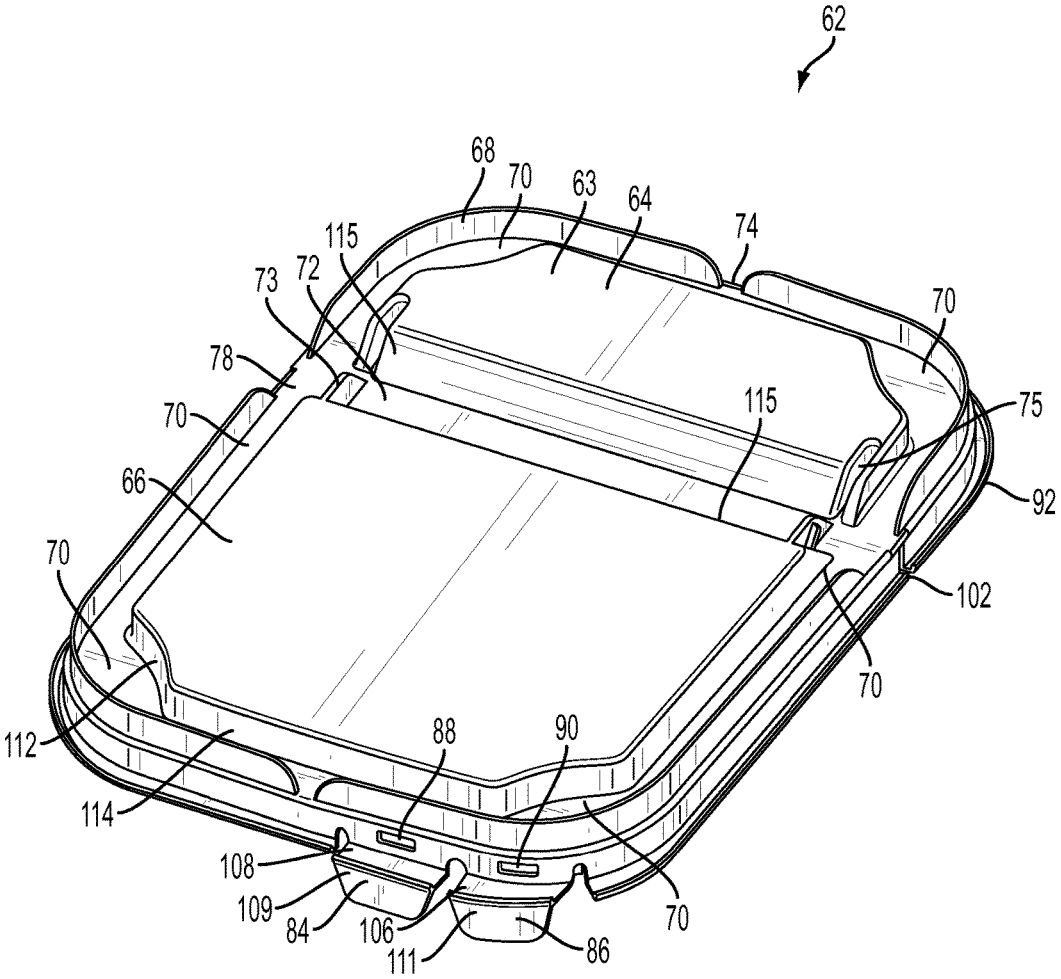
FIG. 16 illustrates a top perspective view of a lid in accordance with an embodiment of the invention.
Figure 17:
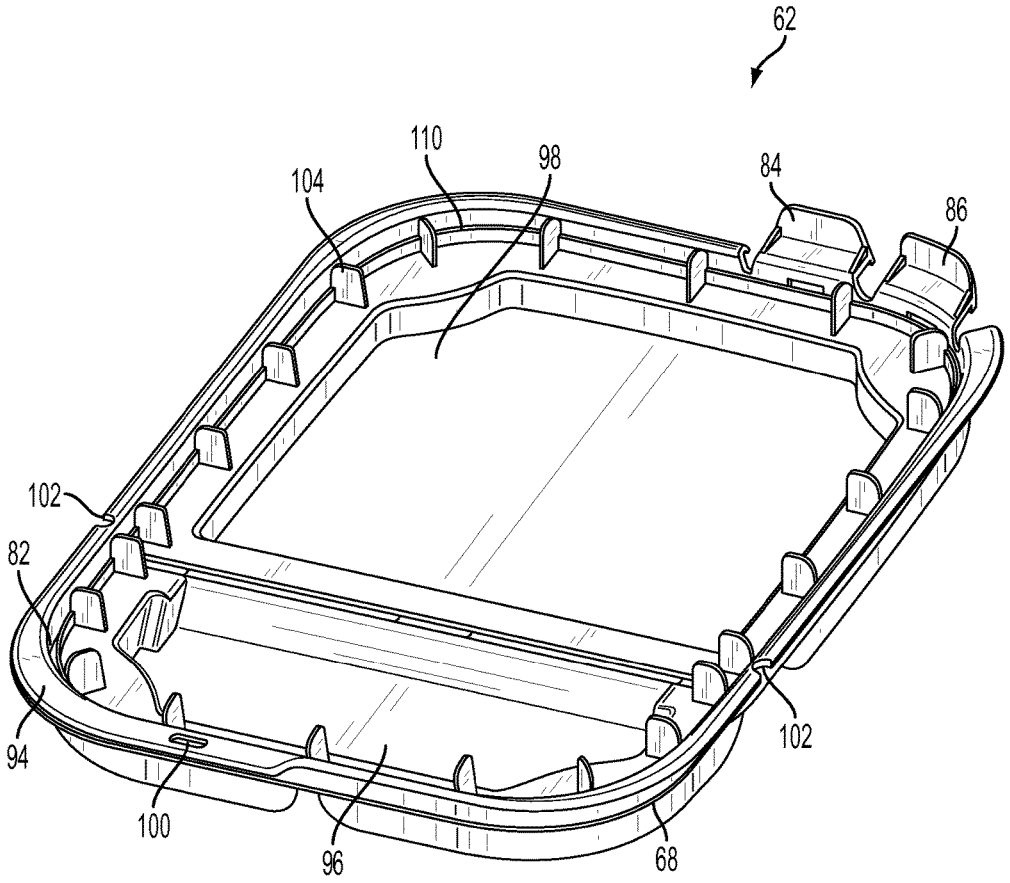
FIG. 17 illustrates a bottom perspective view of the lid of FIG. 16 in accordance with an embodiment of the invention.
Figure 18:
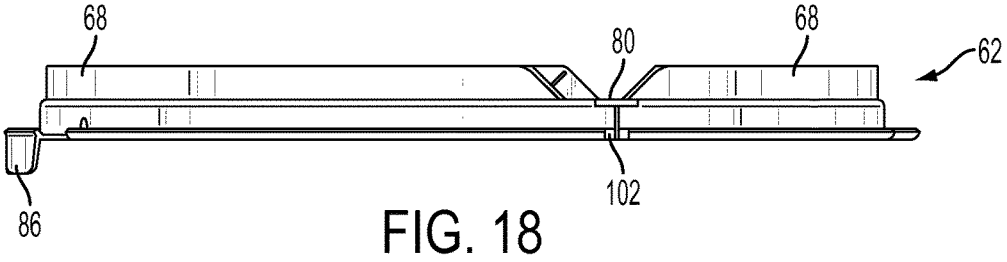
FIG. 18 illustrates a front plan view of the lid of FIG. 16 in accordance with an embodiment of the invention.
Figure 19:
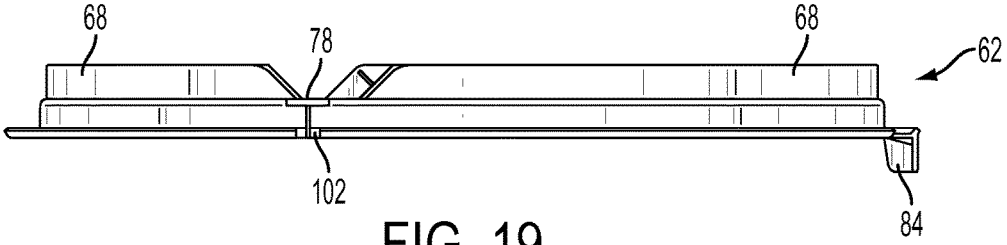
FIG. 19 illustrates a rear plan view of the lid of FIG. 16 in accordance with an embodiment of the invention.
Figure 20:
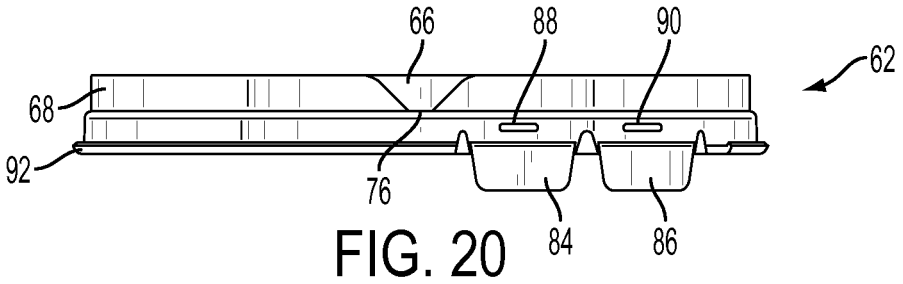
FIG. 20 illustrates a left plan view of the lid of FIG. 16 in accordance with an embodiment of the invention.
Figure 21:
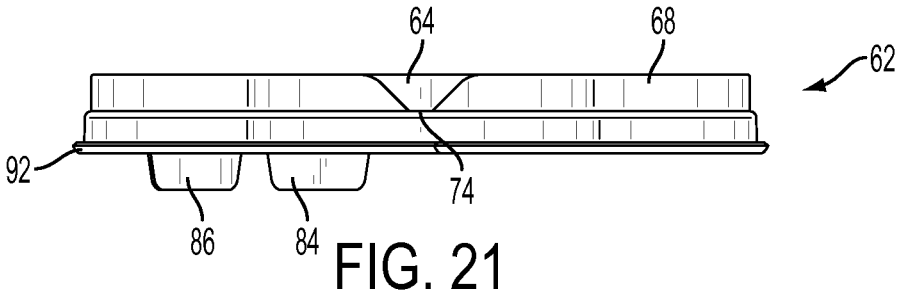
FIG. 21 illustrates a right plan view of the lid of FIG. 16 in accordance with an embodiment of the invention.

FIG. 17 illustrates a bottom perspective view of the lid of FIG. 16 in accordance with an embodiment of the invention. A first recessed portion 96 and a second recessed portion 98 correspond to first raised portion 64 and second raised portion 66. First recessed portion 96 and second recessed portion 98 of one lid 62 may receive first raised portion 64 and second raised portion 66 of another lid 62 to create a stack of lids (e.g., see FIG. 24).

An outer peripheral channel 82 is created between peripheral edge extension 92, and a plurality of reinforcing ridges 104 is formed along an inside periphery of the lid bottom. Edge 52 (FIG. 1), of container 10, is received inside outer peripheral channel 82 to mount lid 62 to container 10 (e.g., see FIGS. 25-32). Reinforcing ridges 104 provide stability and reinforcement to lid 62 and may be shaped to guide edge 52 into outer peripheral channel 82 during assembly.

Figure 26:
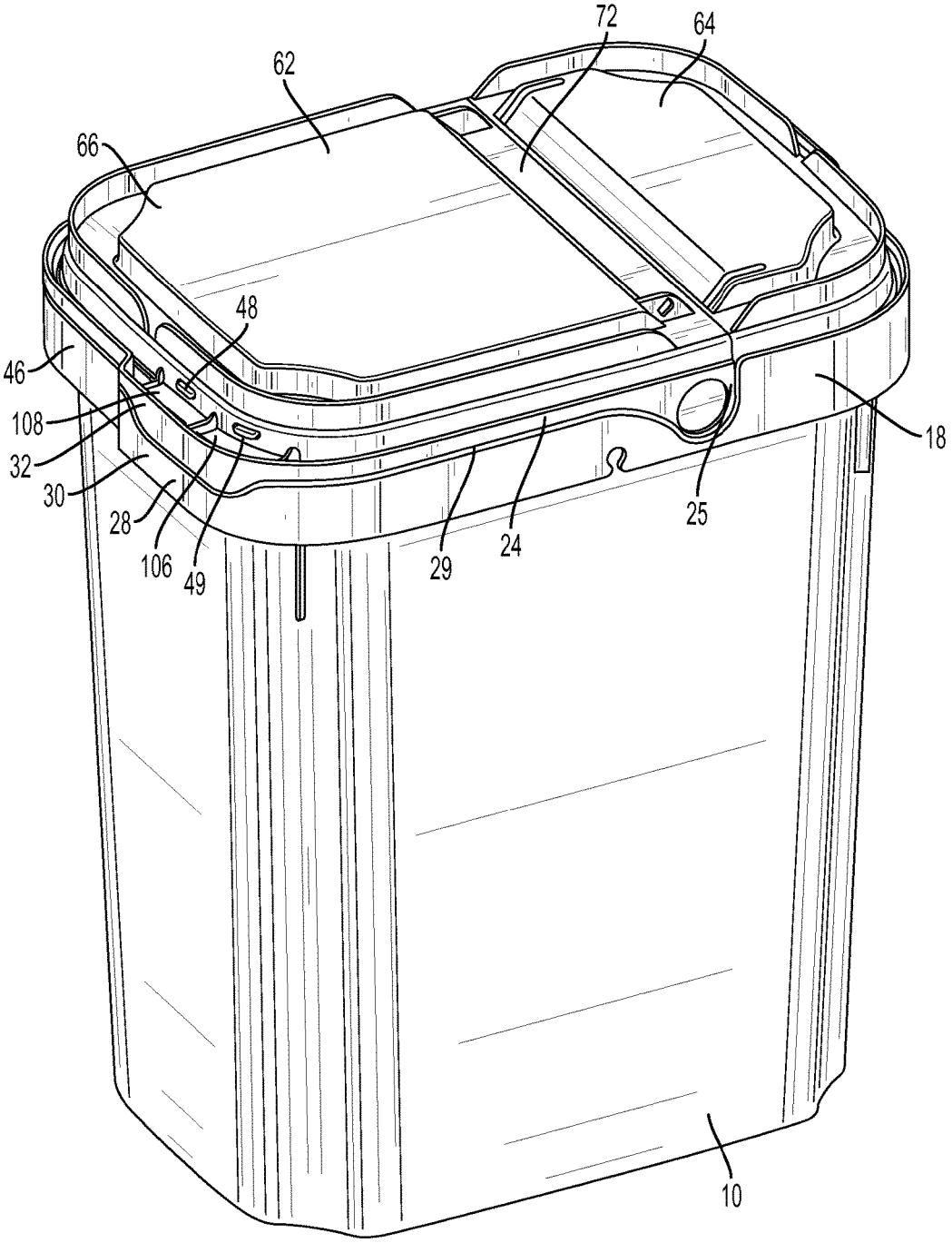
FIG. 26 illustrates another perspective view of the container and lid of FIG. 25 in accordance with an embodiment of the invention.
Figure 27:
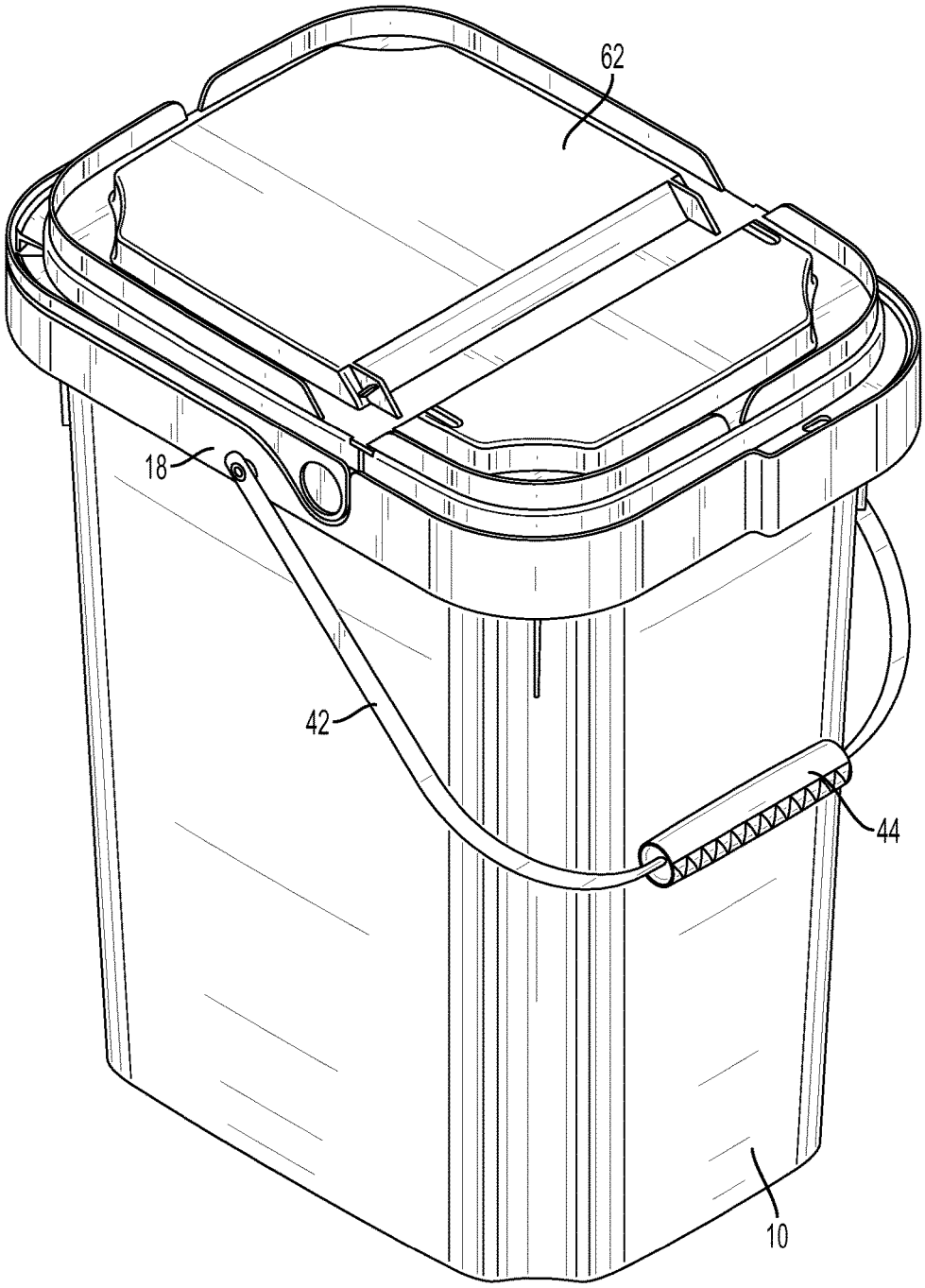
FIG. 27 illustrates a perspective view of the container of FIG. 2 assembled in connection with the lid of FIG. 16 in accordance with an embodiment of the invention.
Figure 28:
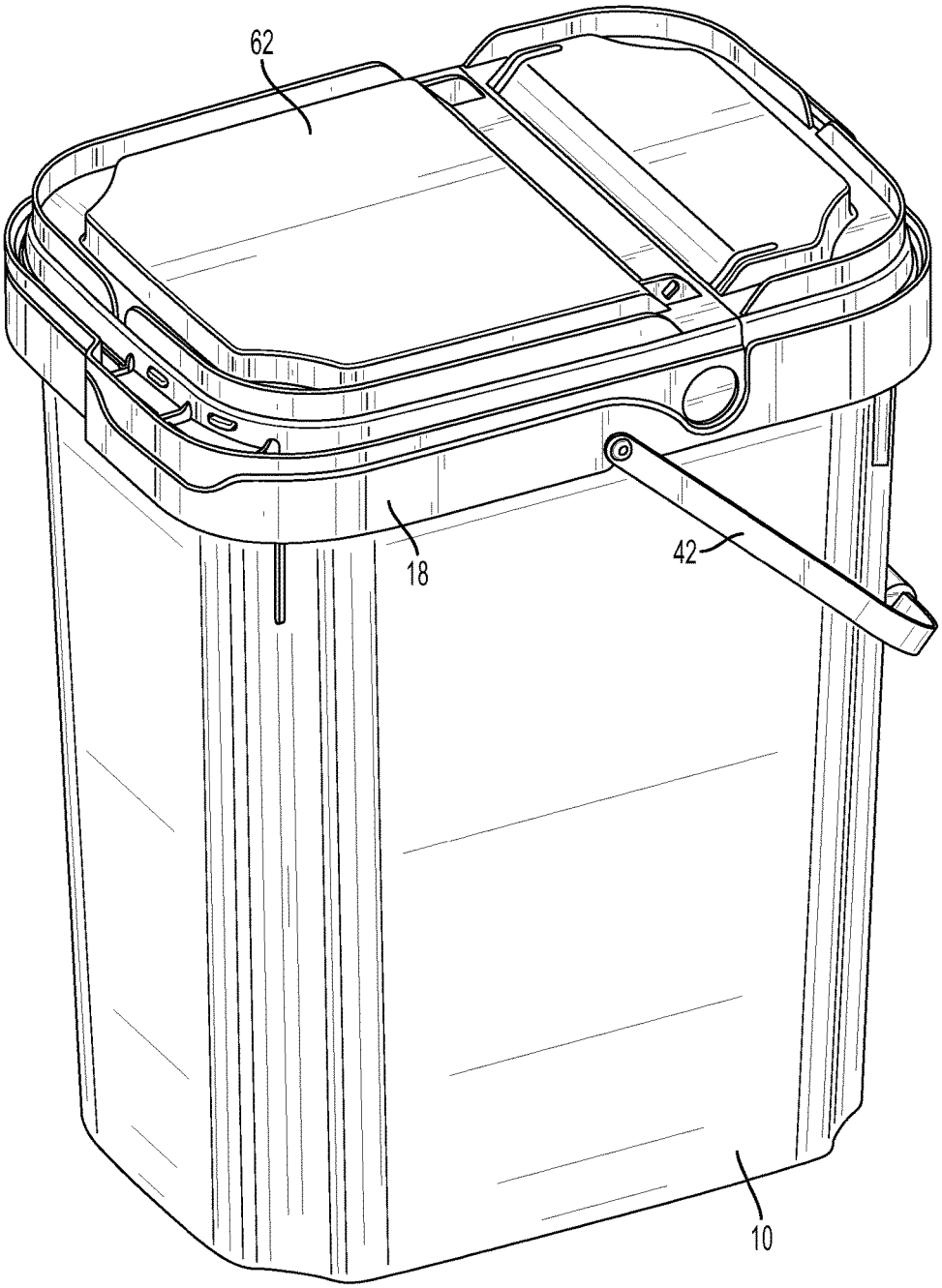
FIG. 28 illustrates another perspective view of the container and lid of FIG. 27 in accordance with an embodiment of the invention.
Figure 29:
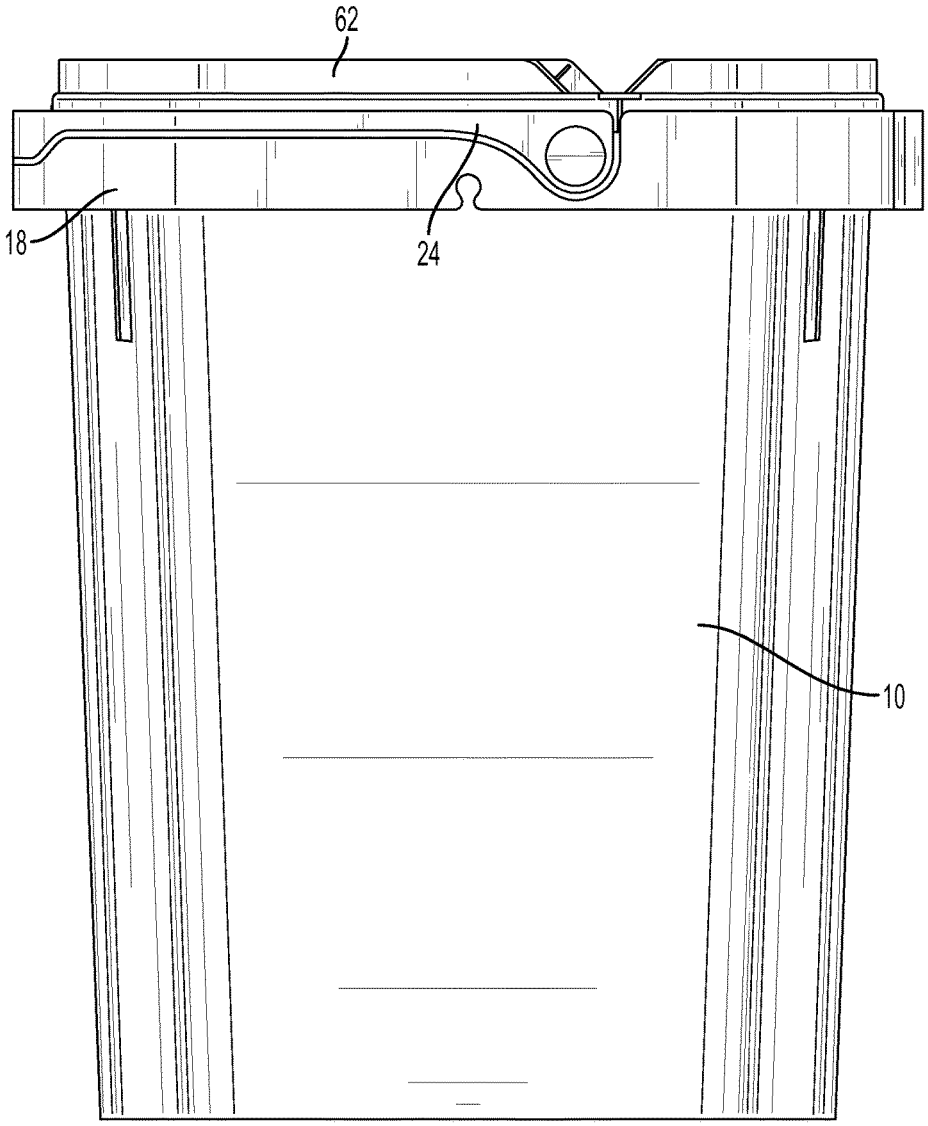
FIG. 29 illustrates a front plan view of the embodiment shown in FIG. 25 in accordance with an embodiment of the invention.
Figure 30:
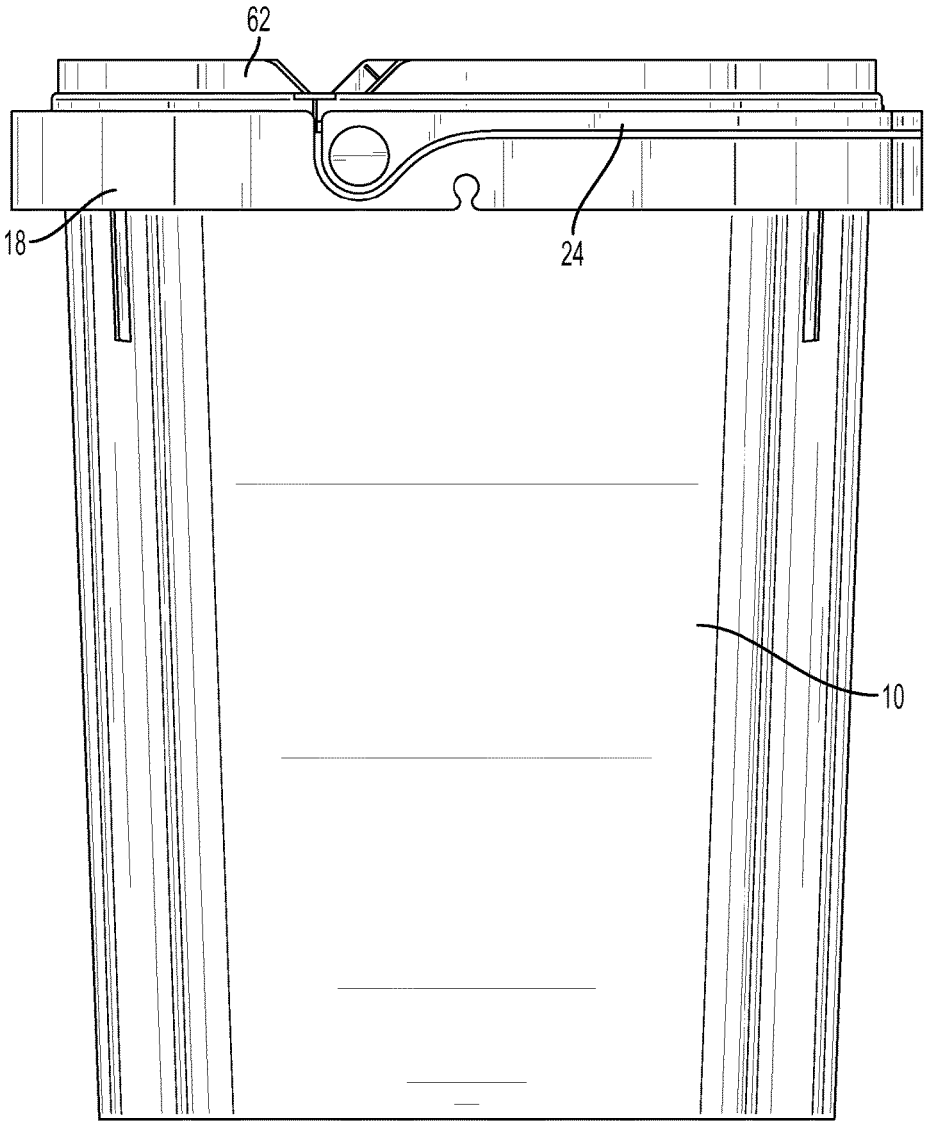
FIG. 30 illustrates a rear plan view of the embodiment shown in FIG. 25 in accordance with an embodiment of the invention.
Figure 31:
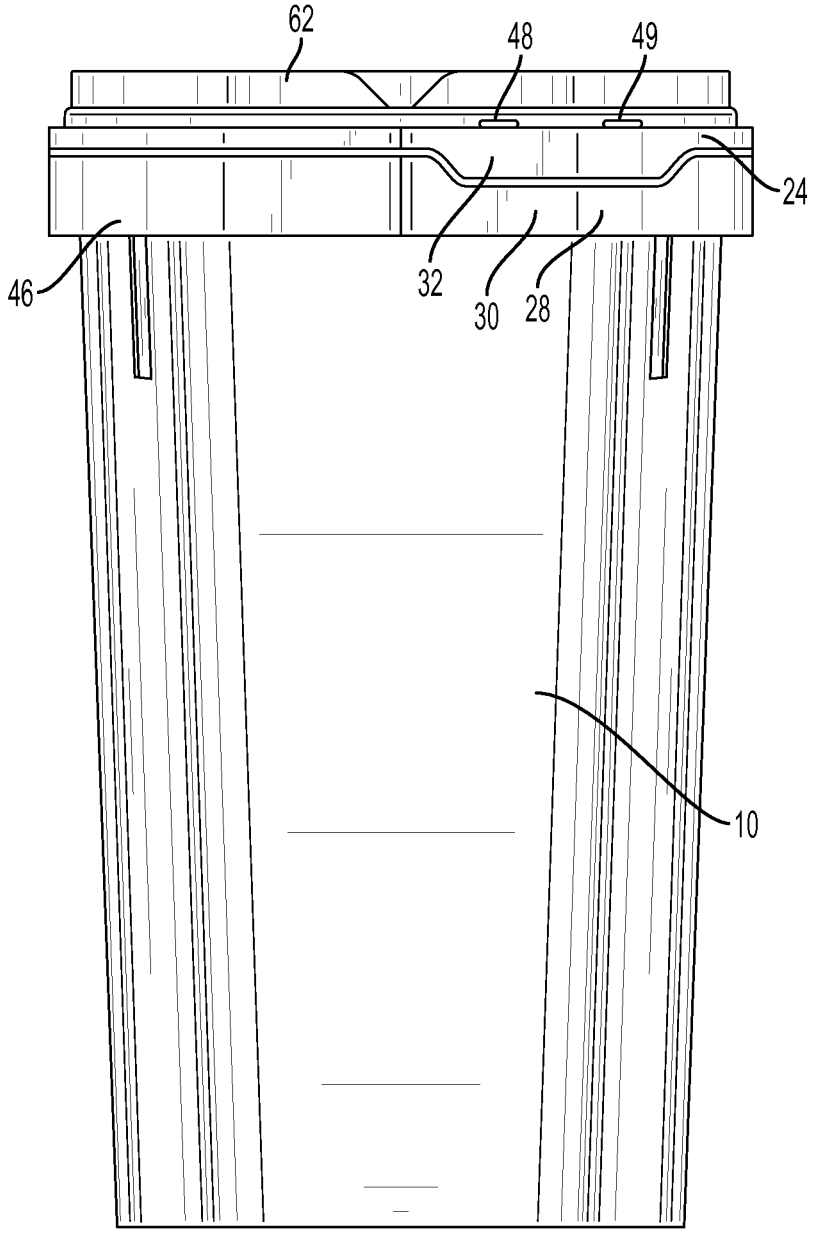
FIG. 31 illustrates a left plan view of the embodiment shown in FIG. 25 in accordance with an embodiment of the invention.
Figure 32:
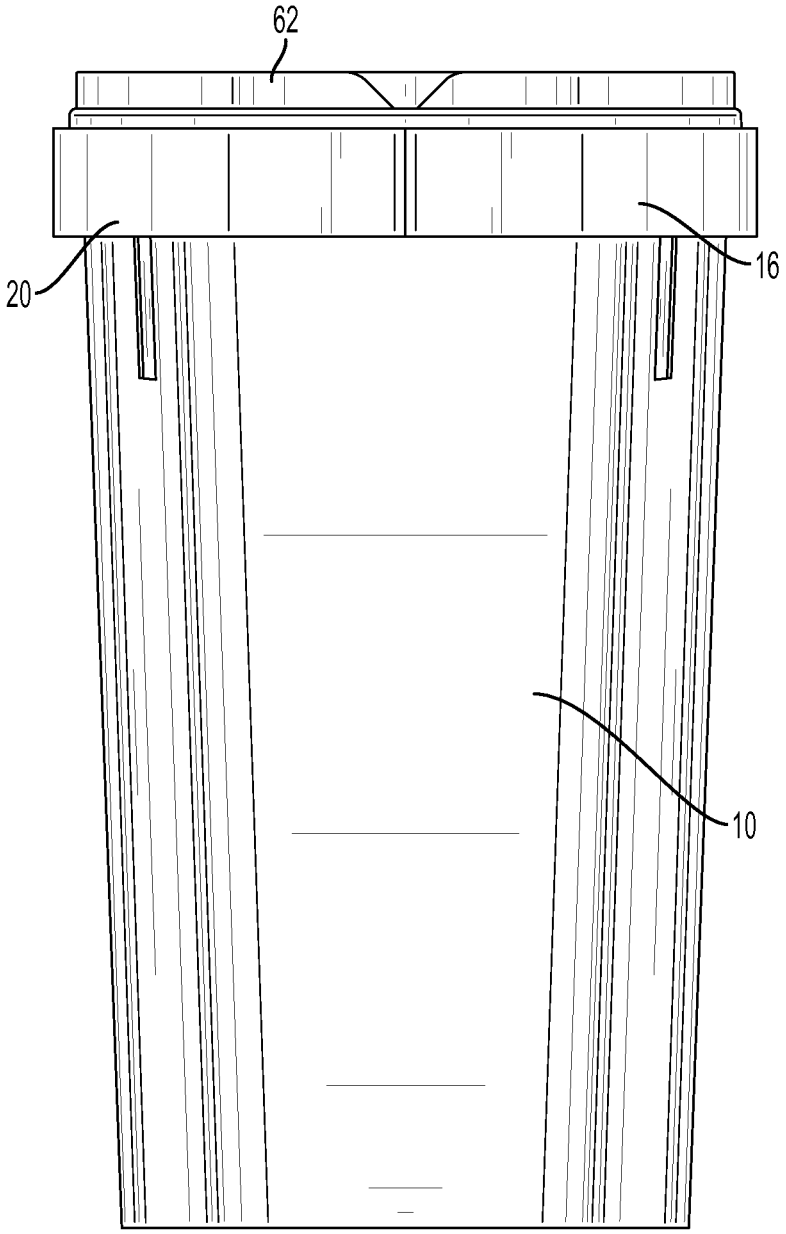
FIG. 32 illustrates a right plan view of the embodiment shown in FIG. 25 in accordance with an embodiment of the invention.
Figure 33:
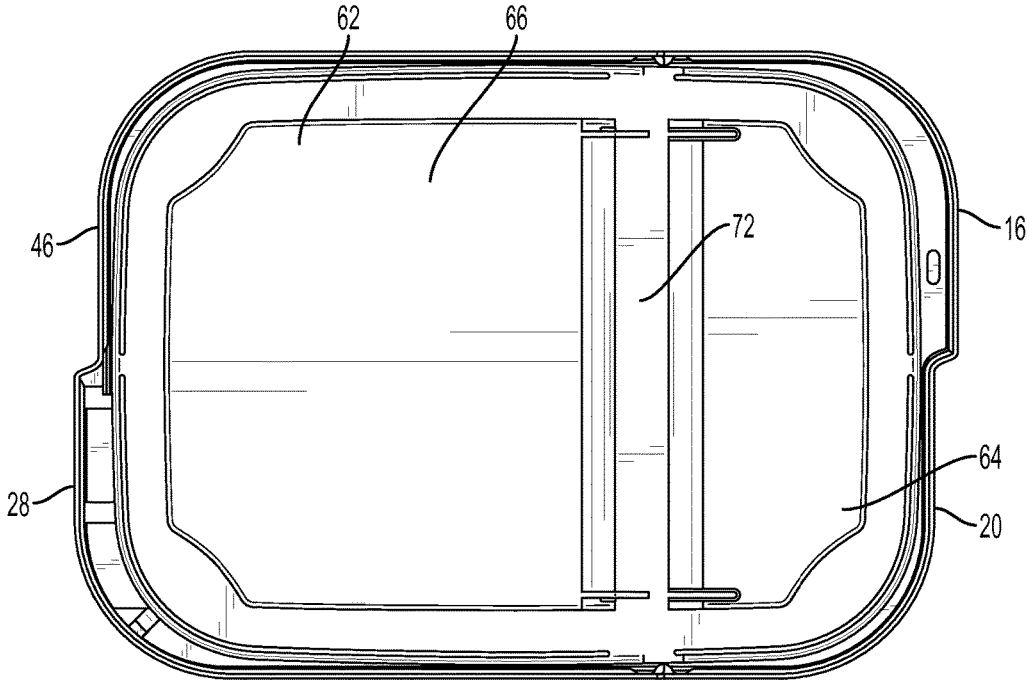
FIG. 33 illustrates a top plan view of the embodiment shown in FIG. 25 in accordance with an embodiment of the invention.
Figure 34:
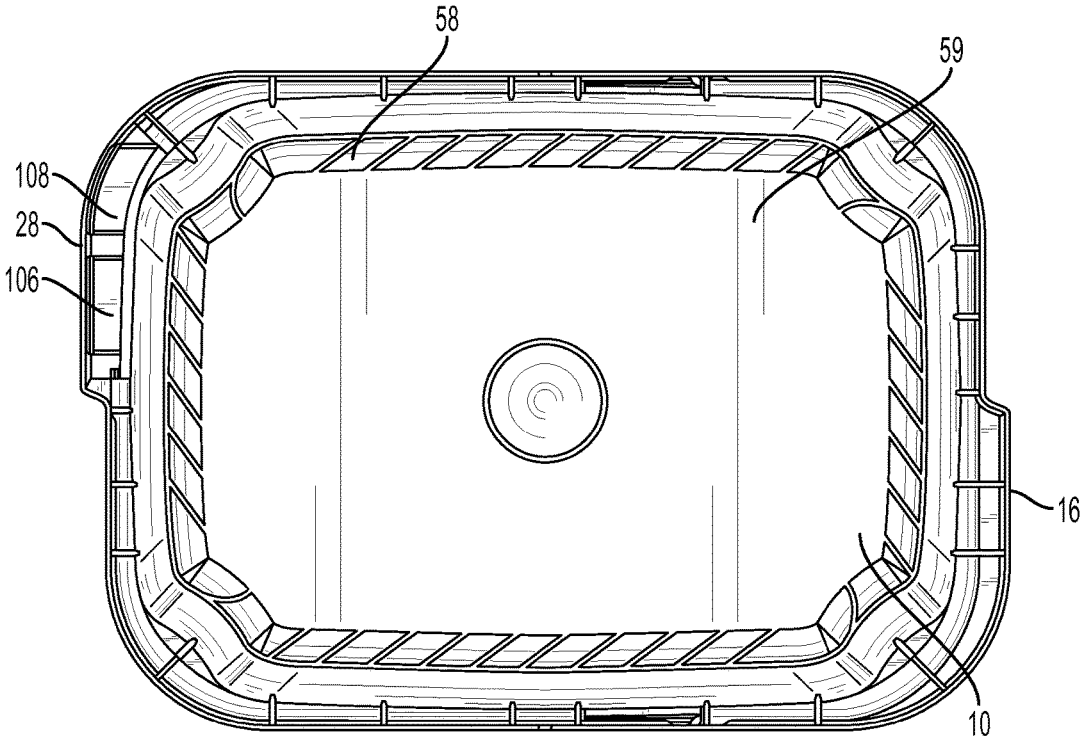
FIG. 34 illustrates a bottom plan view of the embodiment shown in FIG. 25 in accordance with an embodiment of the invention.

FIGS. 25-32 illustrate lid 62 assembled in connection with container 10 with tear strip 24 in place. As shown, lid 62 is mounted to container 10 such that edge 52 is seated within outer peripheral channel 82 and bead extensions 48, 49 are aligned and disposed in respective slots 88, 90 of respective tabs 84, 86. FIGS. 26, 28 and 31 illustrate engaging portion 32 of tear strip 24 covering the child-resistant feature of tabs 84, 86. When tear strip 24 is in place, engaging portion 32 prevents direct access to tabs 84, 86. In addition, engaging portion 32 prevents depressing tabs 84, 86 to allow bead extensions 48, 49 to become dislodged from respective slots 88, 90.

In certain aspects of the invention, when lid 62 is assembled to container 10, lid 62 may be difficult or impossible to pull off container 10 with tear strip 24 in place. In this instance, tear strip 24 may be removed, such as by pulling pull ring 25 to remove tear strip 24 along tear line 29. Turning to FIGS. 48-54, after removal of tear strip 24, engaging portion 32 is also removed together therewith to create an opening or access to the child-resistant feature including, for example, tabs 84, 86. A lid underhang 30 is, therefore, created in an area at or slightly below tabs 84, 86. In a rested state, underhang 30 prevents or blocks access to tabs 84, 86. In order to remove lid 62, underhang 30 is depressed inwardly and/or downwardly to allow enough access for a user to lift upwardly on tabs 84, 86 to deflect them enough to release respective bead extensions 48, 49 from respective slots 88, 90. In a disclosed embodiment, underhang 30 is not only flexible, but resilient to return back to an original state to prevent or block access to tabs 84, 86 upon a reassembly of lid 62 to container 10. As such, removal of the tear strip 24 and subsequent removal of lid 62 may not require any or minimal amount of tools.

Thus a security mechanism of container 10 and lid 62 assembly comprises, at least, tabs 84, 86 and respective slots 88, 90 of lid 62 and bead extensions 48, 49 of container 10. The security mechanism is useful as a child-resistant closure and for preventing easy access to contents of container 10. Security mechanism may also include underhang 30 created when tear strip 24 is removed from bumper portion 18. While two tabs, two respective slots, and two bead extensions are detailed and illustrated in the present disclosure, the invention is not to be limited by the number of tabs, slots, and bead extensions, as deemed necessary for the intended purpose, for example, of securing materials within the container and lid assembly. For example, lid 62 may include a single tab for releasing any number of bead extensions from respective slots.

A feature of the child-resistant closure of the present invention also provides that both tabs 84, 86 must be lifted to disengage respective bead extensions 48, 49 from respective slots 88, 90; otherwise, lid 62 cannot be removed from container 10. Once both bead extensions 48, 49 are disengaged from respective slots 88, 90, lid 62 may be completely removed or simply hinged in order to gain access to contents within container 10, for example, by pouring, scooping or picking content from within.

Figure 41:
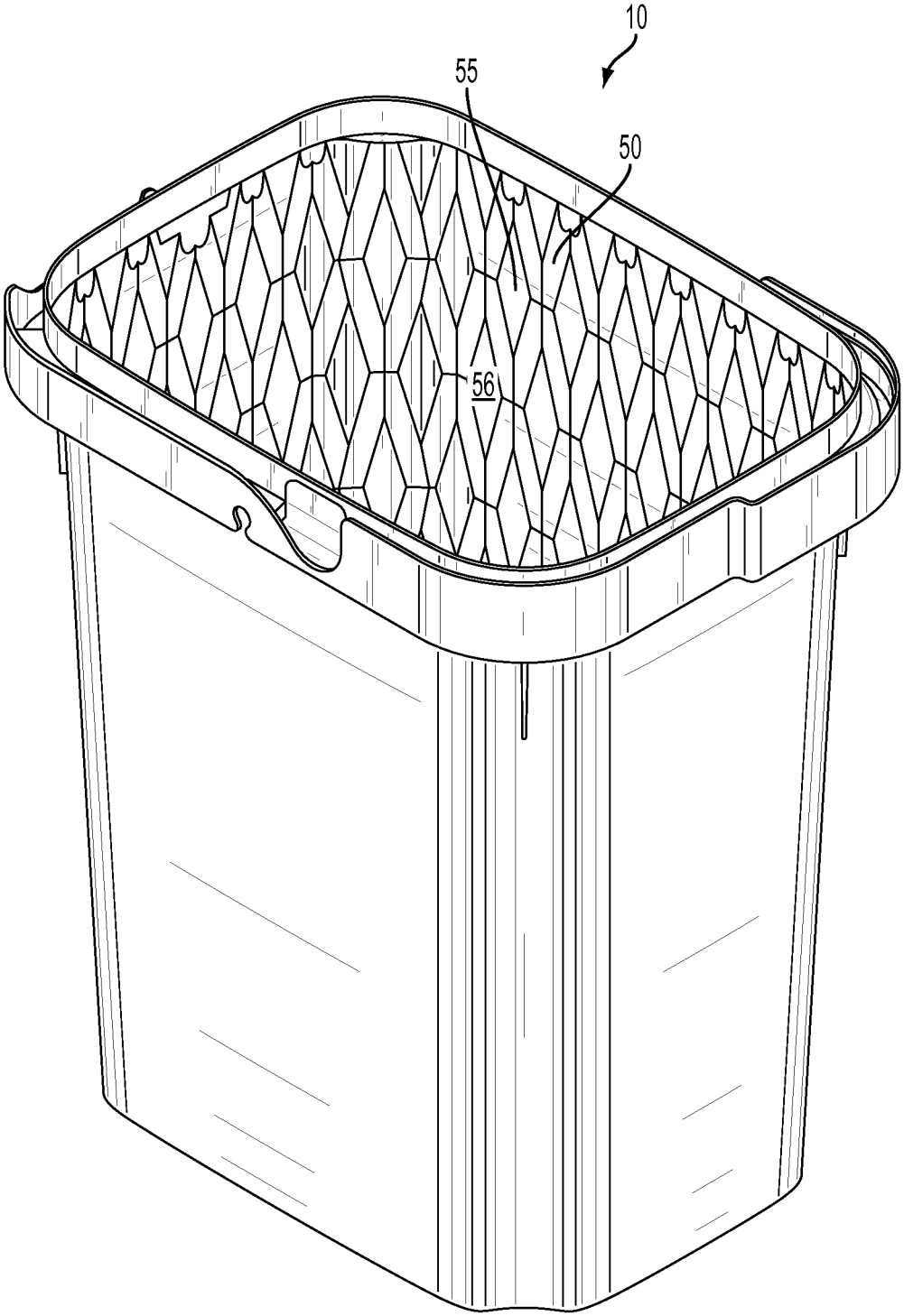
FIG. 41 illustrates a perspective view of the container of FIG. 4 with a tear strip removed in accordance with an embodiment of the invention.
Figure 42:
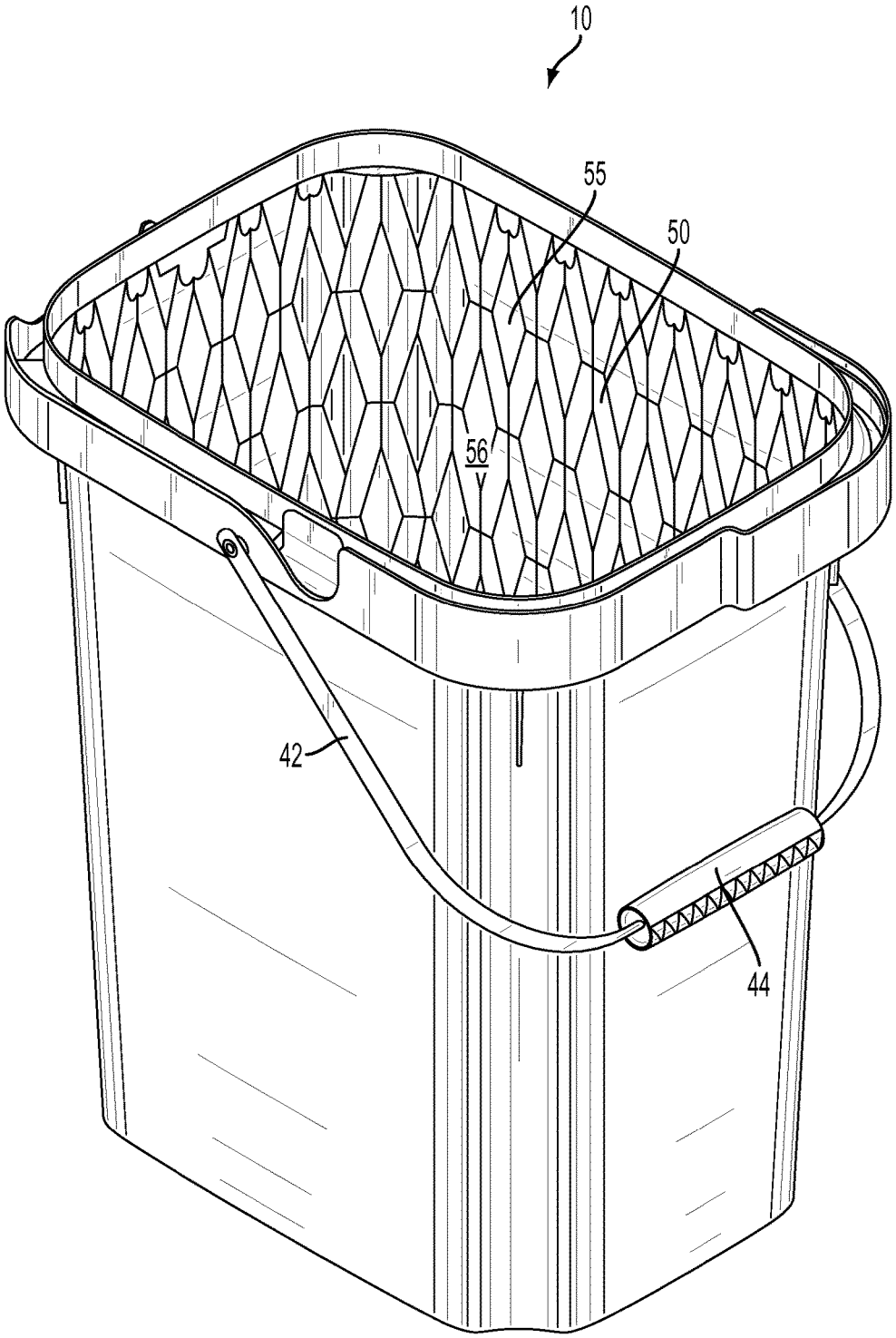
FIG. 42 illustrates a perspective view of the container of FIG. 5 with a tear strip removed in accordance with an embodiment of the invention.
Figure 43:
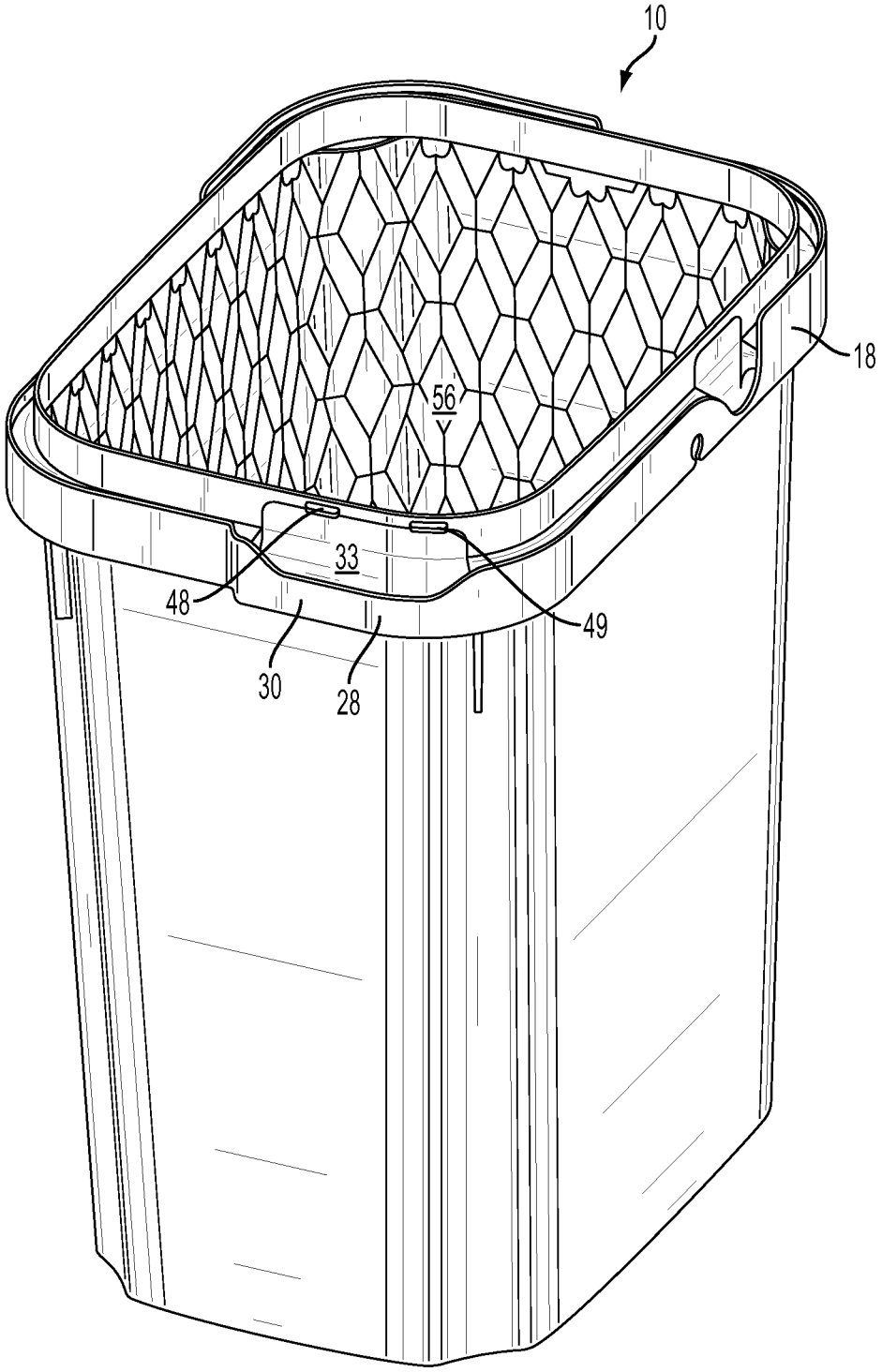
FIG. 43 illustrates a perspective view of the container of FIG. 6 with a tear strip removed in accordance with an embodiment of the invention.
Figure 44:
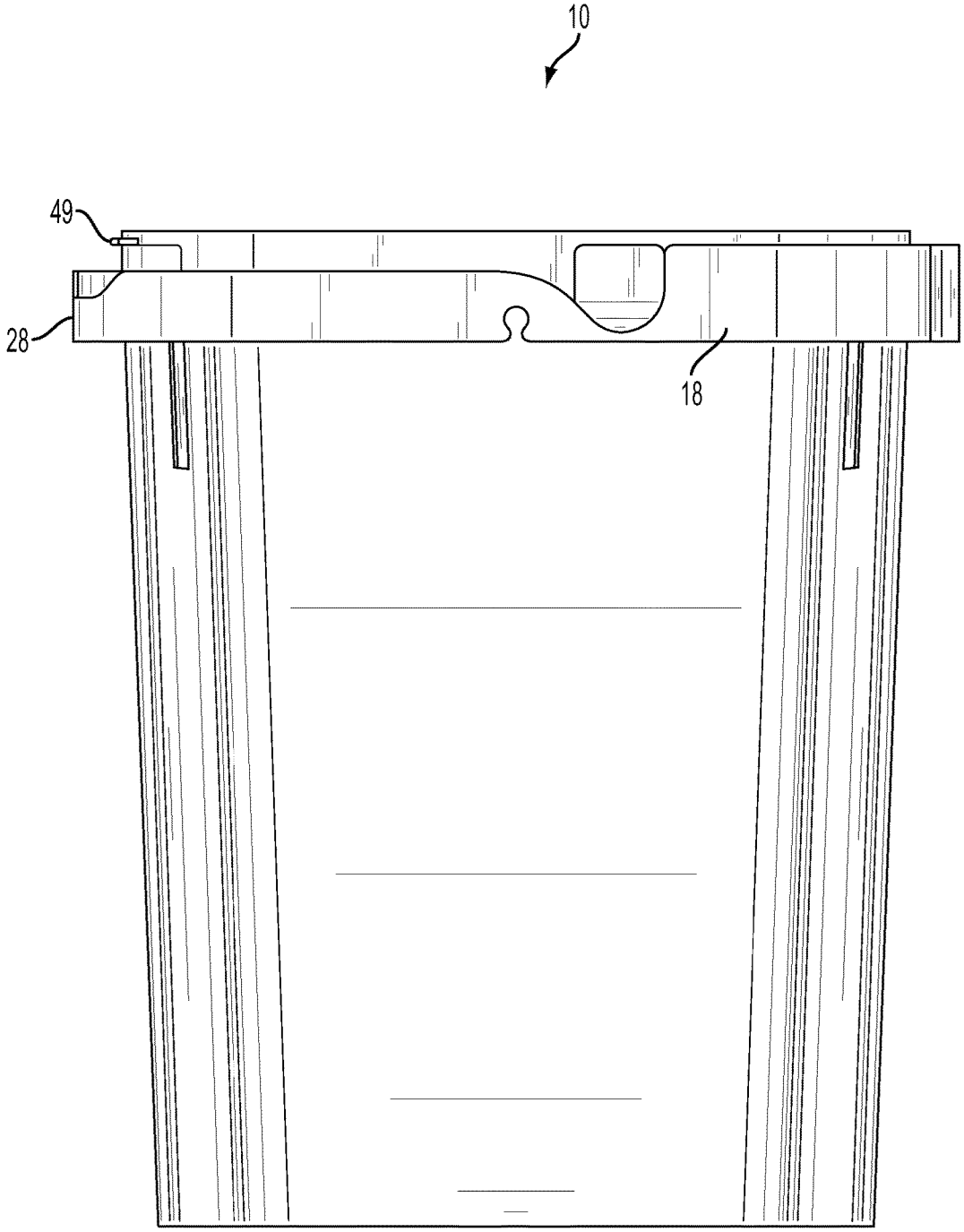
FIG. 44 illustrates a front plan view of the container of FIG. 7 with a tear strip removed in accordance with an embodiment of the invention.
Figure 45:
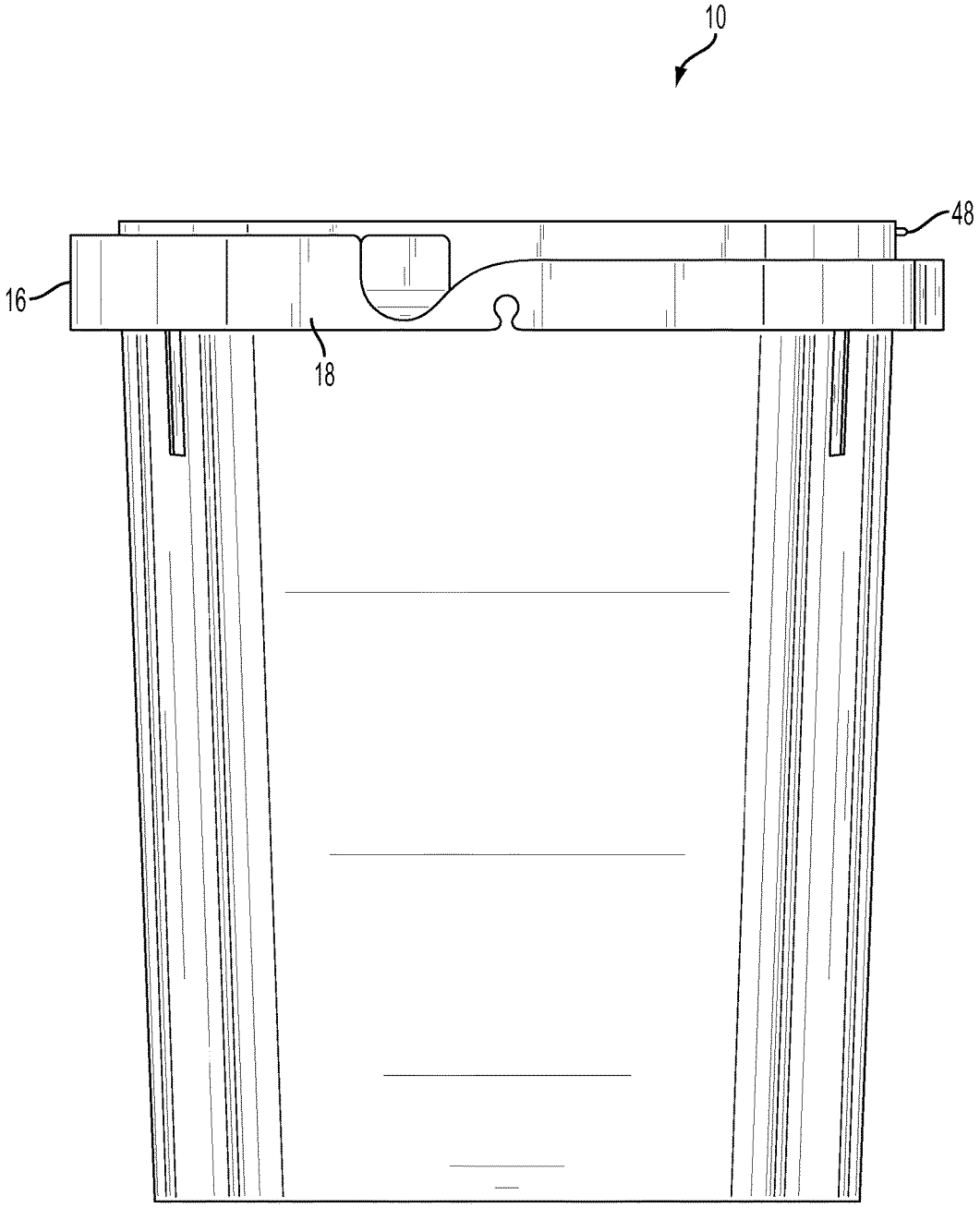
FIG. 45 illustrates a rear plan view of the container of FIG. 8 with a tear strip removed in accordance with an embodiment of the invention.
Figure 46:
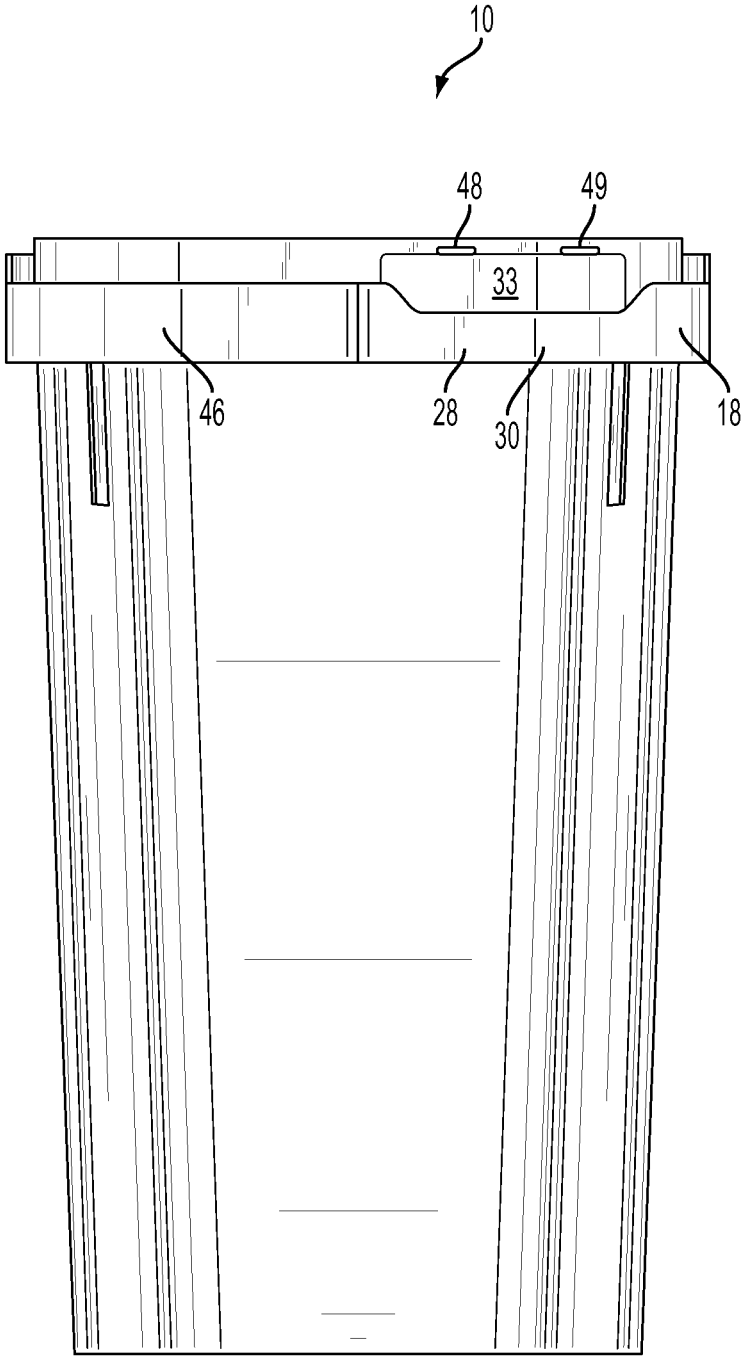
FIG. 46 illustrates a left plan view of the container of FIG. 9 with a tear strip removed in accordance with an embodiment of the invention.
Figure 47:
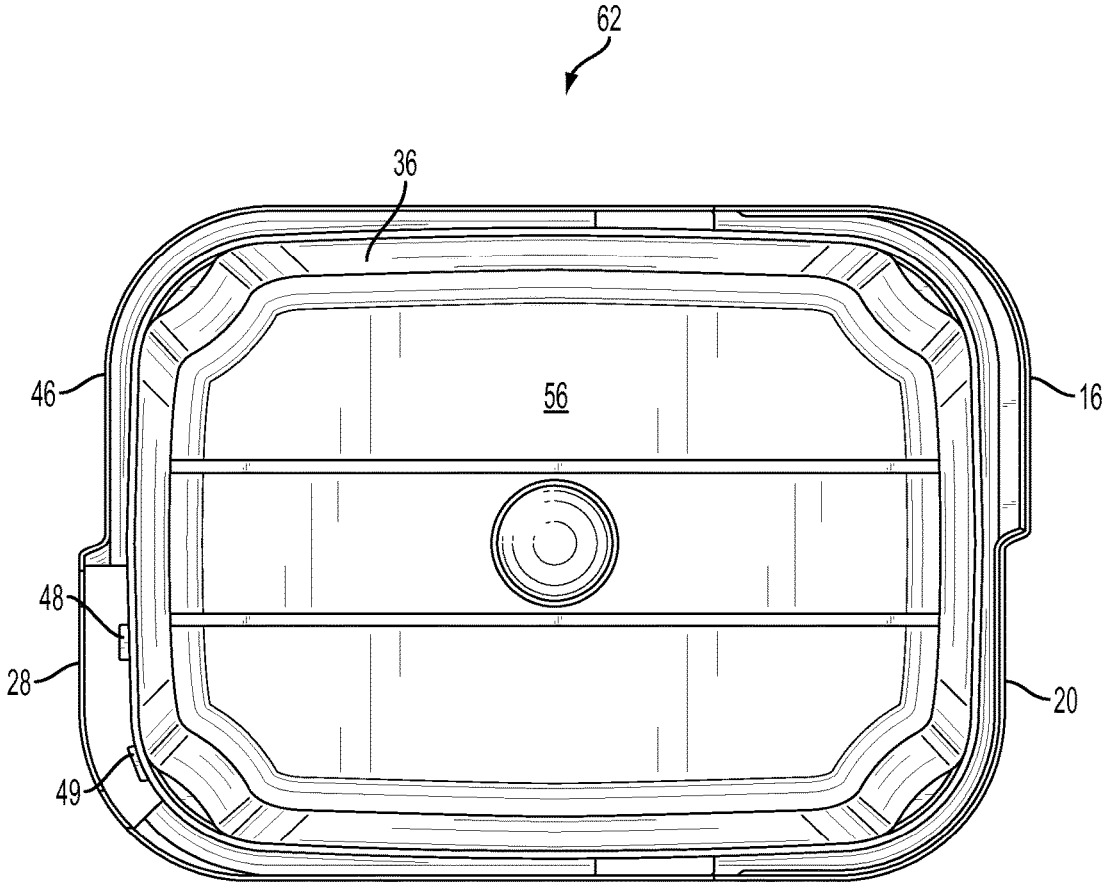
FIG. 47 illustrates a top plan view of the container of FIG. 11 with a tear strip removed in accordance with an embodiment of the invention.
Figure 48:
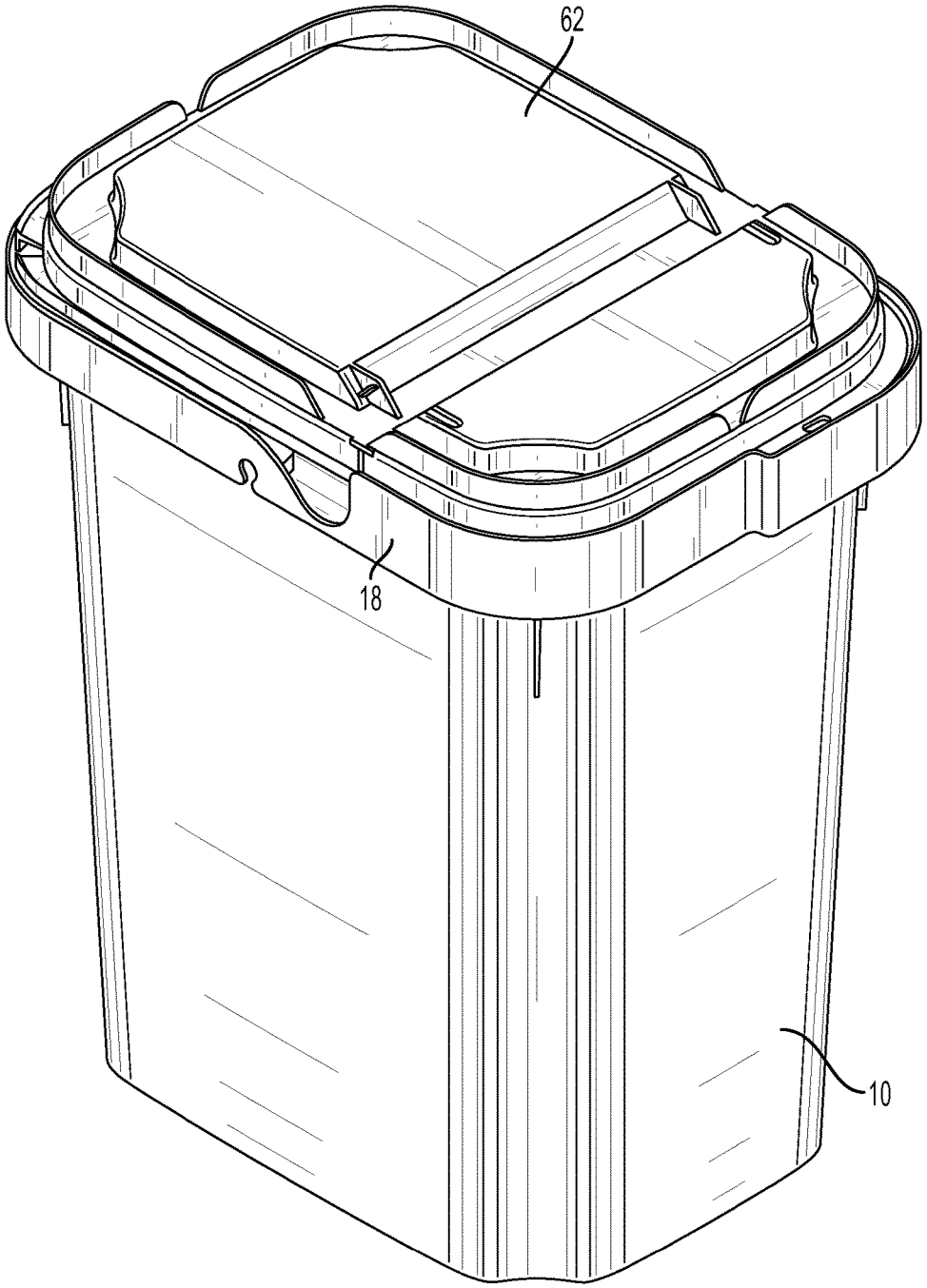
FIG. 48 illustrates a perspective view of the container of FIG. 38 assembled in connection with the lid of FIG. 16 in accordance with an embodiment of the invention.
Figure 49:
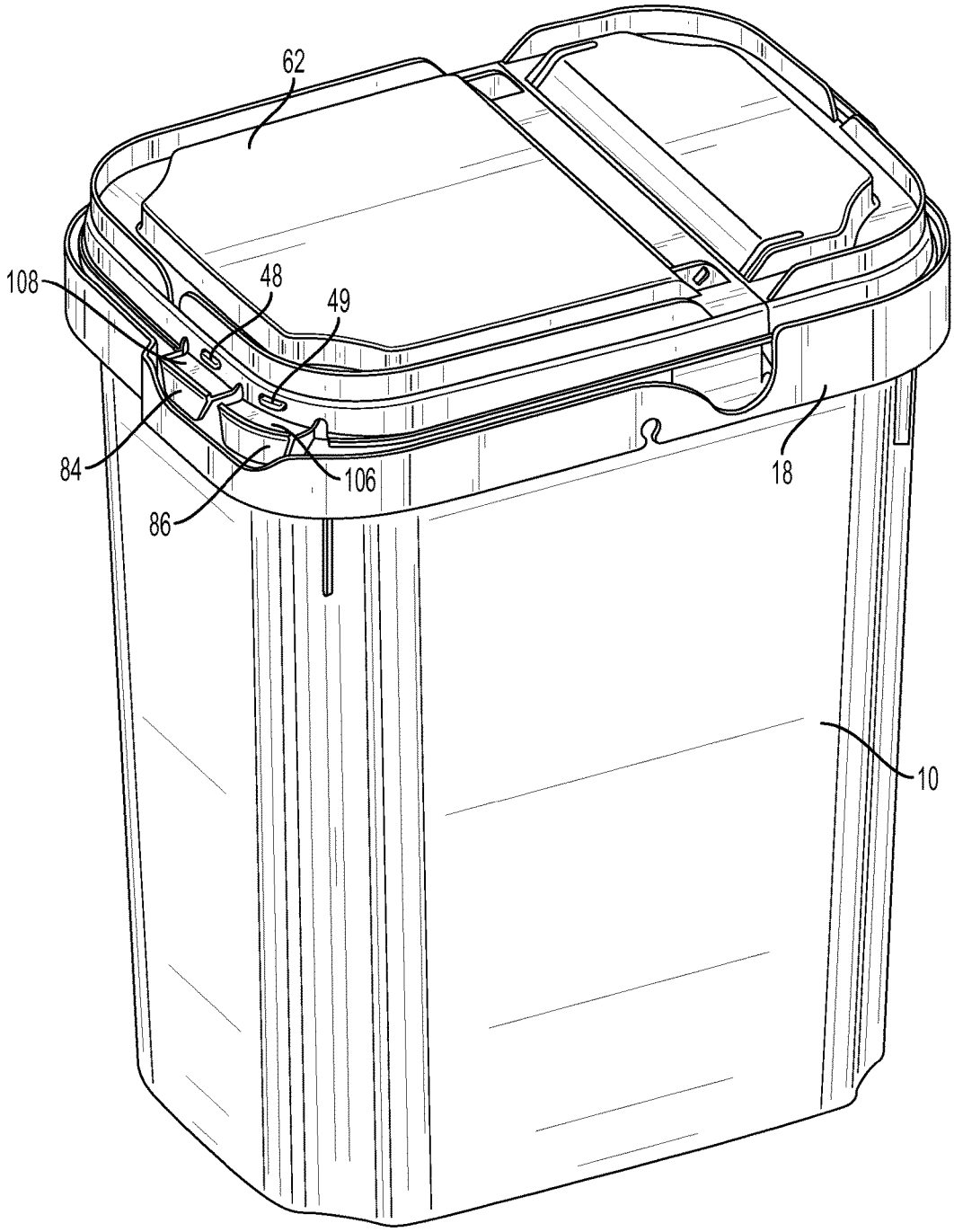
FIG. 49 illustrates another perspective view of the container of FIG. 38 assembled in connection with the lid of FIG. 16 in accordance with an embodiment of the invention.
Figure 50:
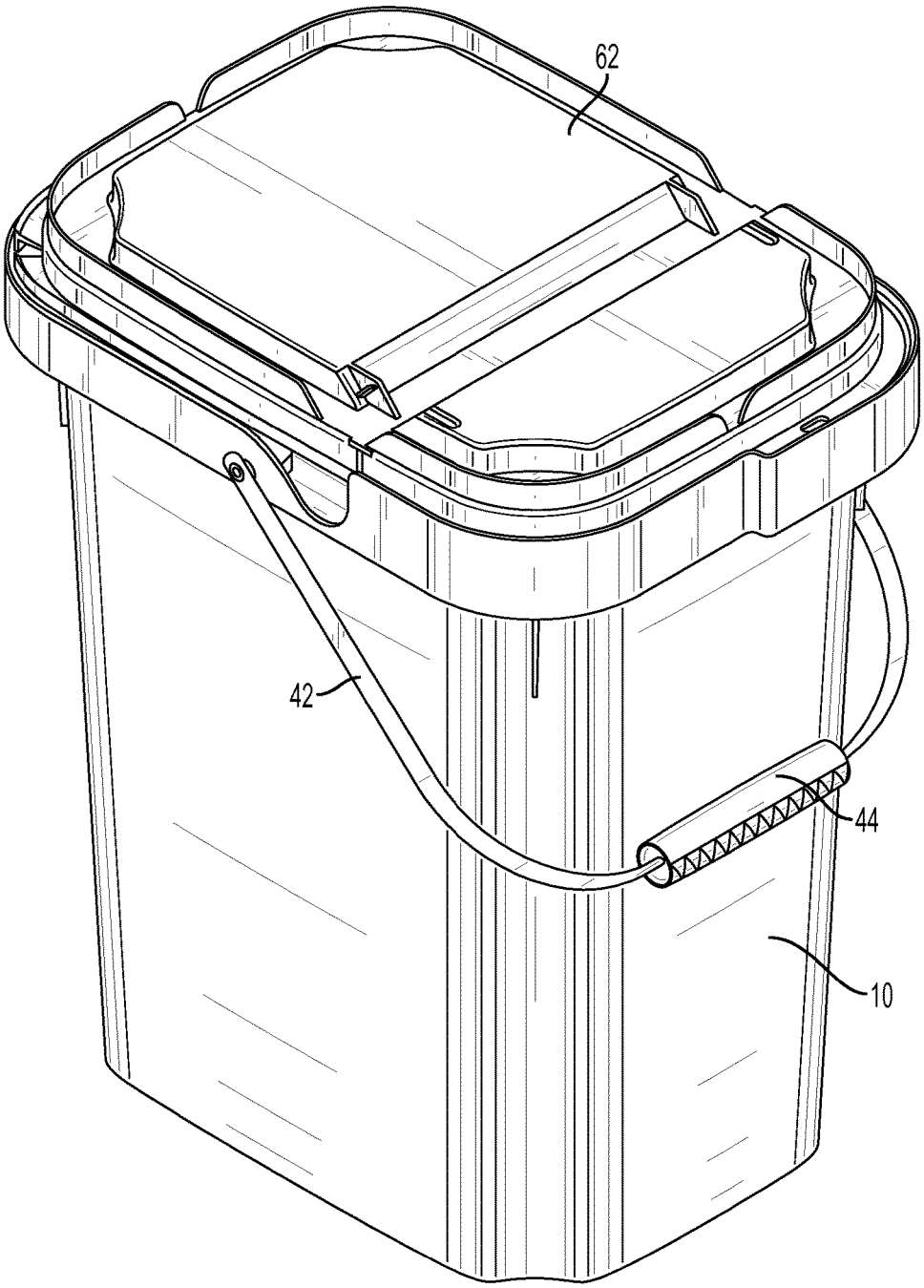
FIG. 50 illustrates a perspective view of the container of FIG. 39 assembled in connection with the lid of FIG. 16 in accordance with an embodiment of the invention.
Figure 51:
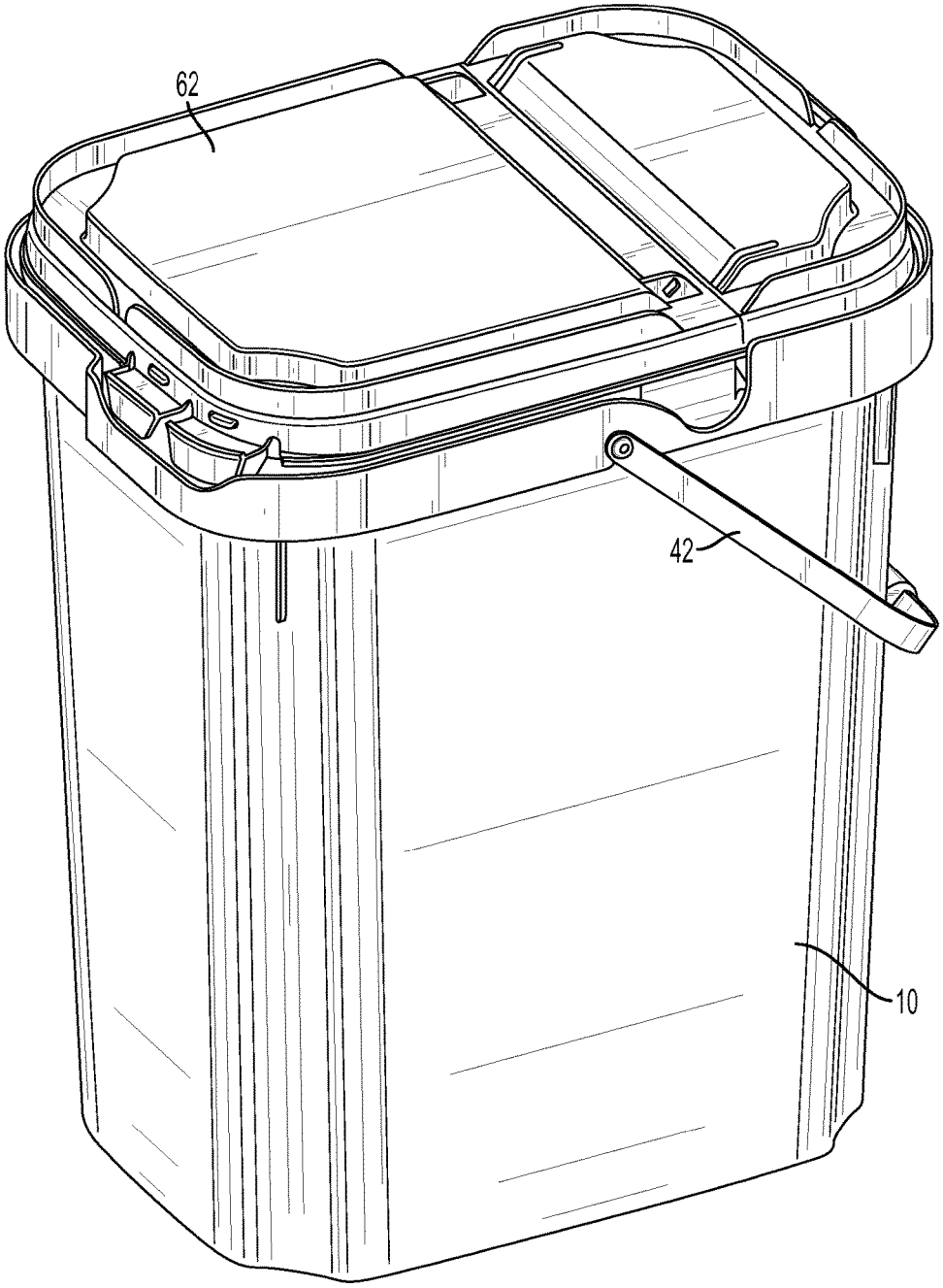
FIG. 51 illustrates another perspective view of the container of FIG. 39 assembled in connection with the lid of FIG. 16 in accordance with an embodiment of the invention.
Figure 52:
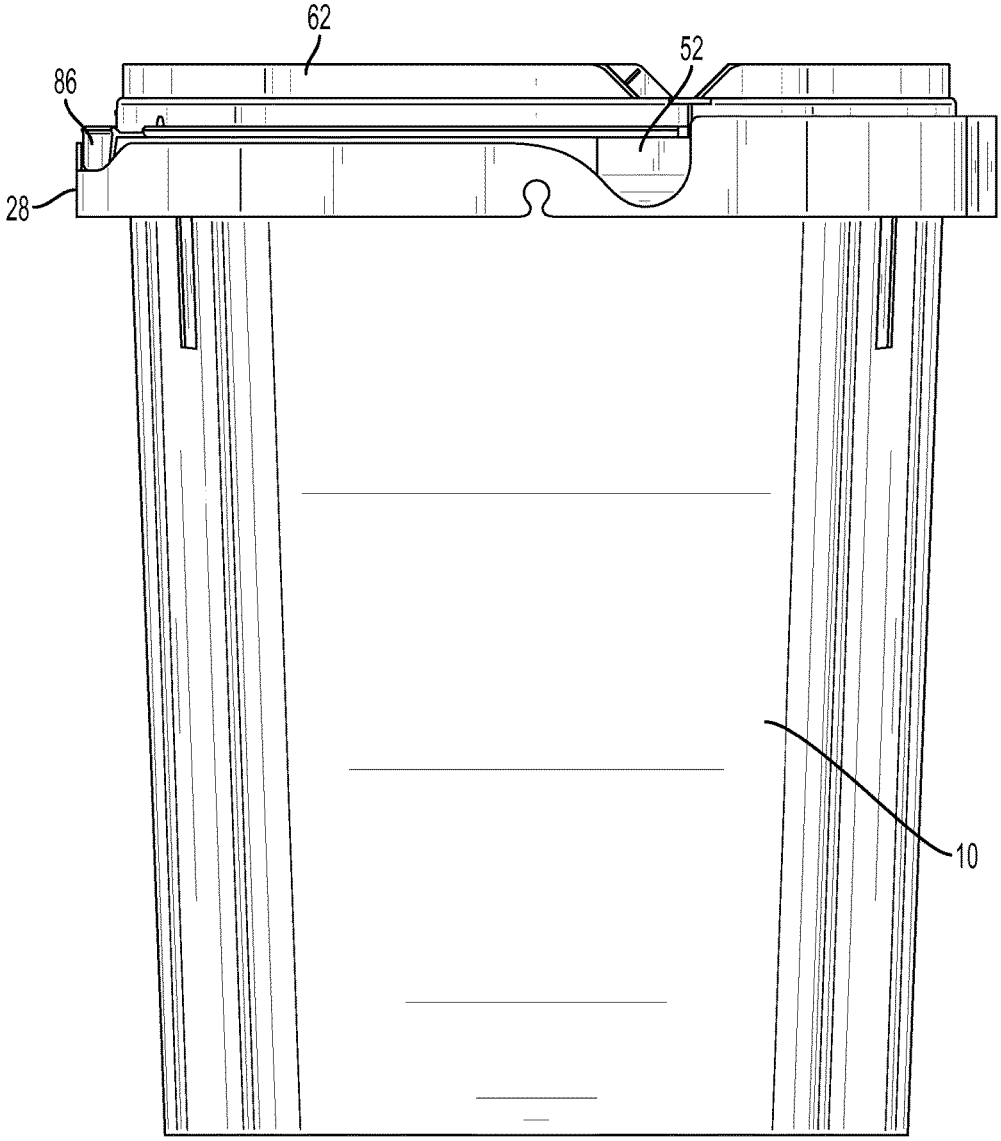
FIG. 52 illustrates a front plan view of the container of FIG. 44 assembled in connection with the lid of FIG. 16 in accordance with an embodiment of the invention.
Figure 53:
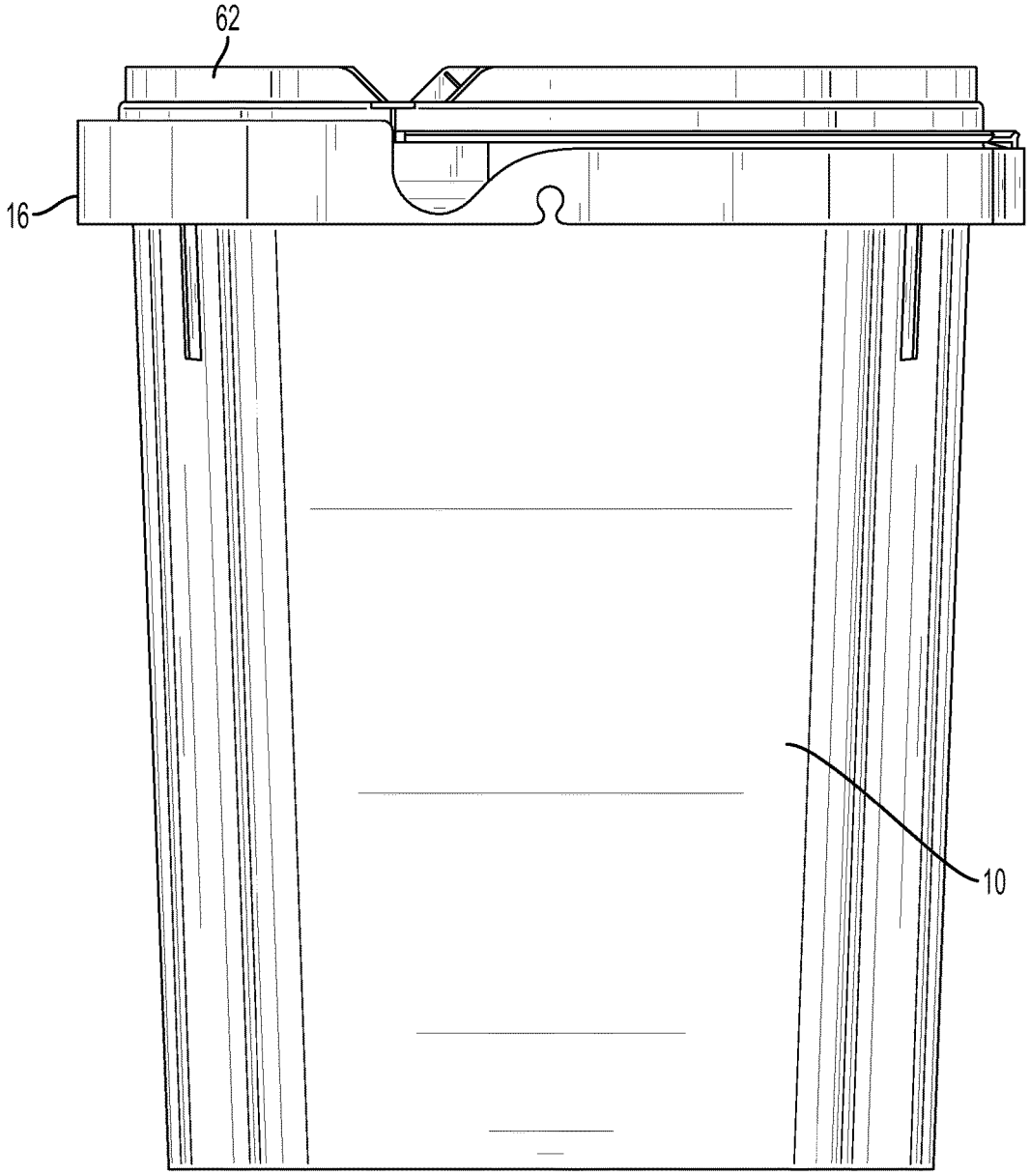
FIG. 53 illustrates a rear plan view of the container of FIG. 45 assembled in connection with the lid of FIG. 16 in accordance with an embodiment of the invention.
Figure 54:
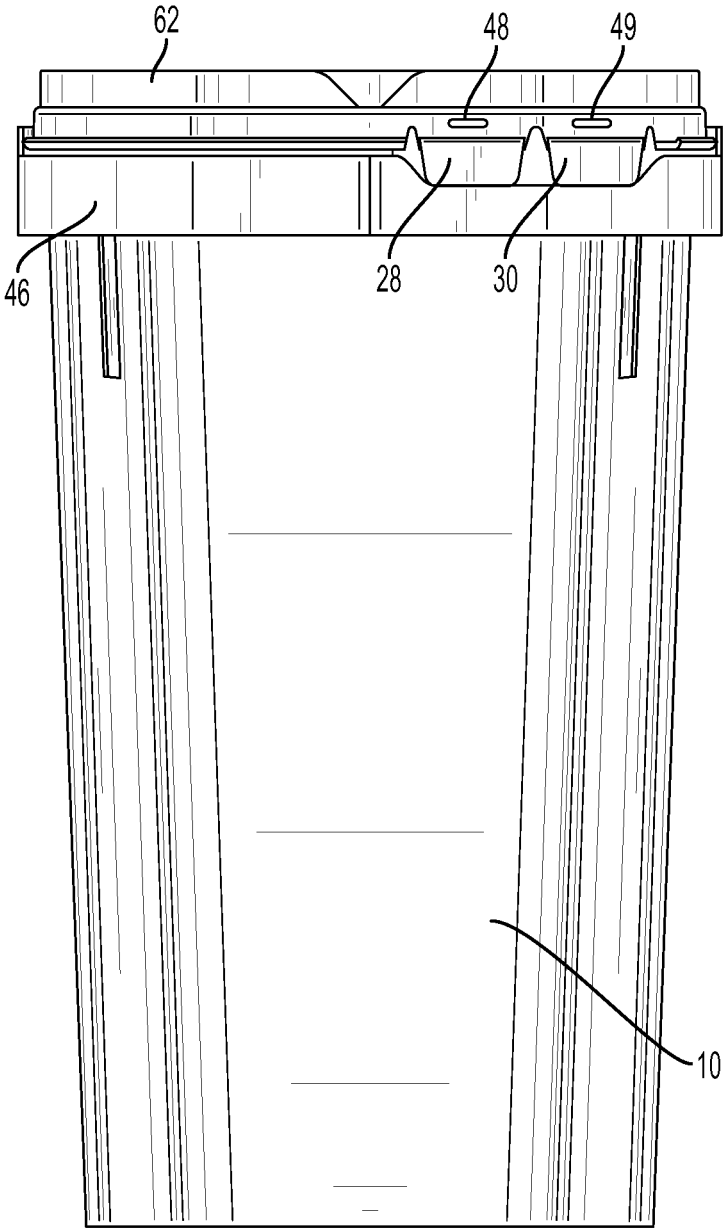
FIG. 54 illustrates a left plan view of the container of FIG. 46 assembled in connection with the lid of FIG. 16 in accordance with an embodiment of the invention.

An embodiment of container 10 having tear strip 24 and lid 62 completely removed is illustrated in FIGS. 38-40 and 44-47. A second embodiment of container 10 with strengthening web 50 and having tear strip 24 and lid 62 completely removed is illustrated in FIGS. 41-43.

Disclosed embodiments of the present invention may provide instructions on one or more surfaces of container 10 and/or lid 62 for obtaining access to the contents of container 10 in assembly with lid 62. In addressing child-resistant protocol, one may appreciate that most children will not be capable of understanding the instructions to open the lid and container of the disclosed invention.

FIGS. 14-15 illustrate a design feature of the present invention including stacking features of container 10 assembled with one another for storage and/or transport, for example, as a stacked assembly along pallet 60. Extended perimeter edge portions 16 and 28 of container 10 may mate with recessed perimeter edge portions 46 and 20, respectively, to interlock a single row or as stacked containers 10 (e.g., see FIG. 37).

Figure 22:
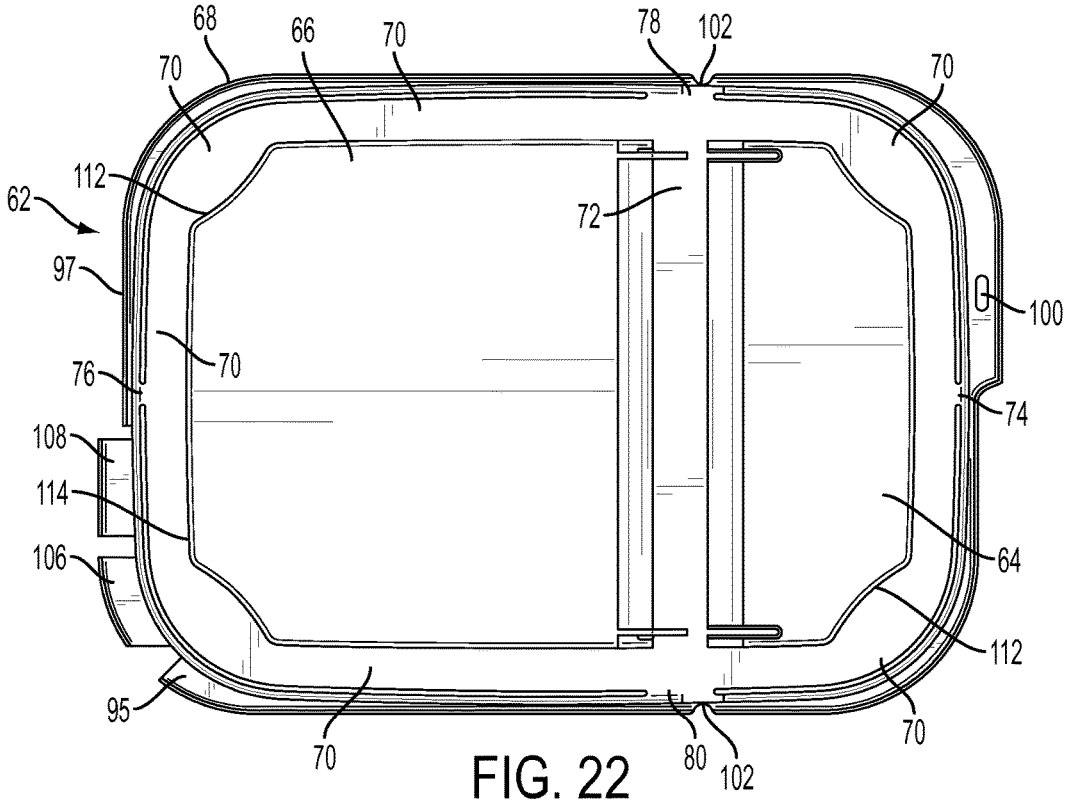
FIG. 22 illustrates a top plan view of the lid of FIG. 16 in accordance with an embodiment of the invention.
Figure 23:
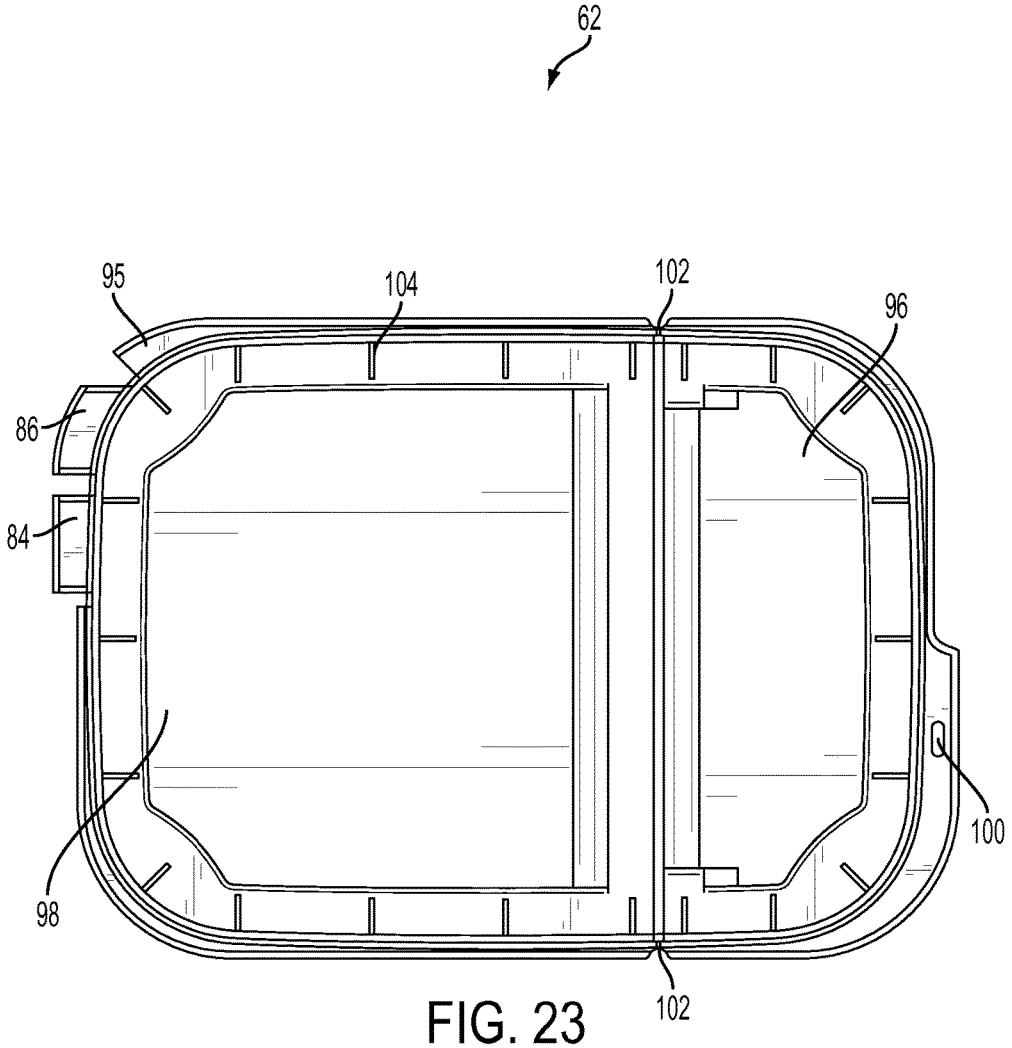
FIG. 23 illustrates a bottom plan view of the lid of FIG. 16 in accordance with an embodiment of the invention.
Figure 24:
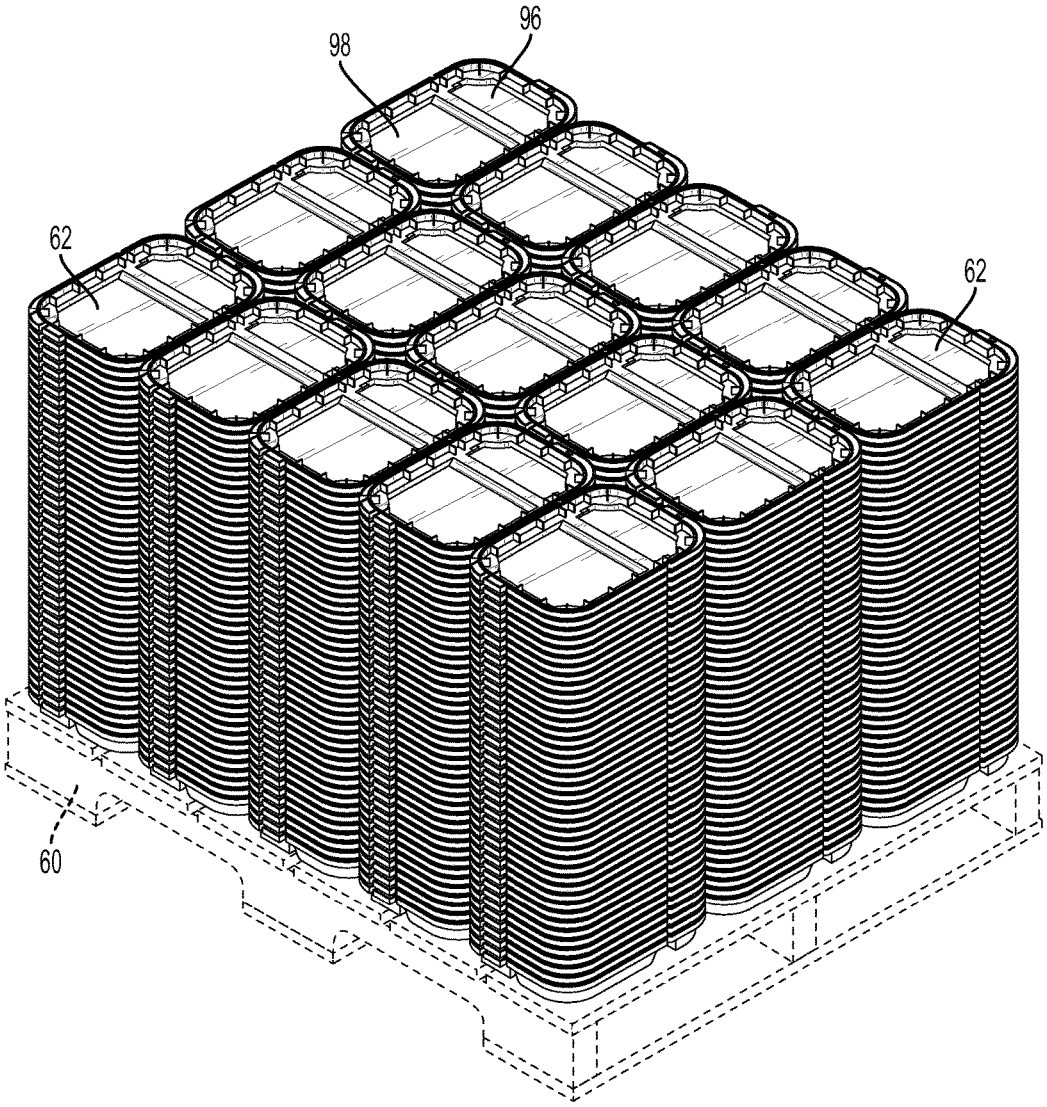
FIG. 24 illustrates a perspective view of multiple stacked lids of the embodiment shown in FIG. 16 in accordance with an embodiment of the invention.
Figure 25:
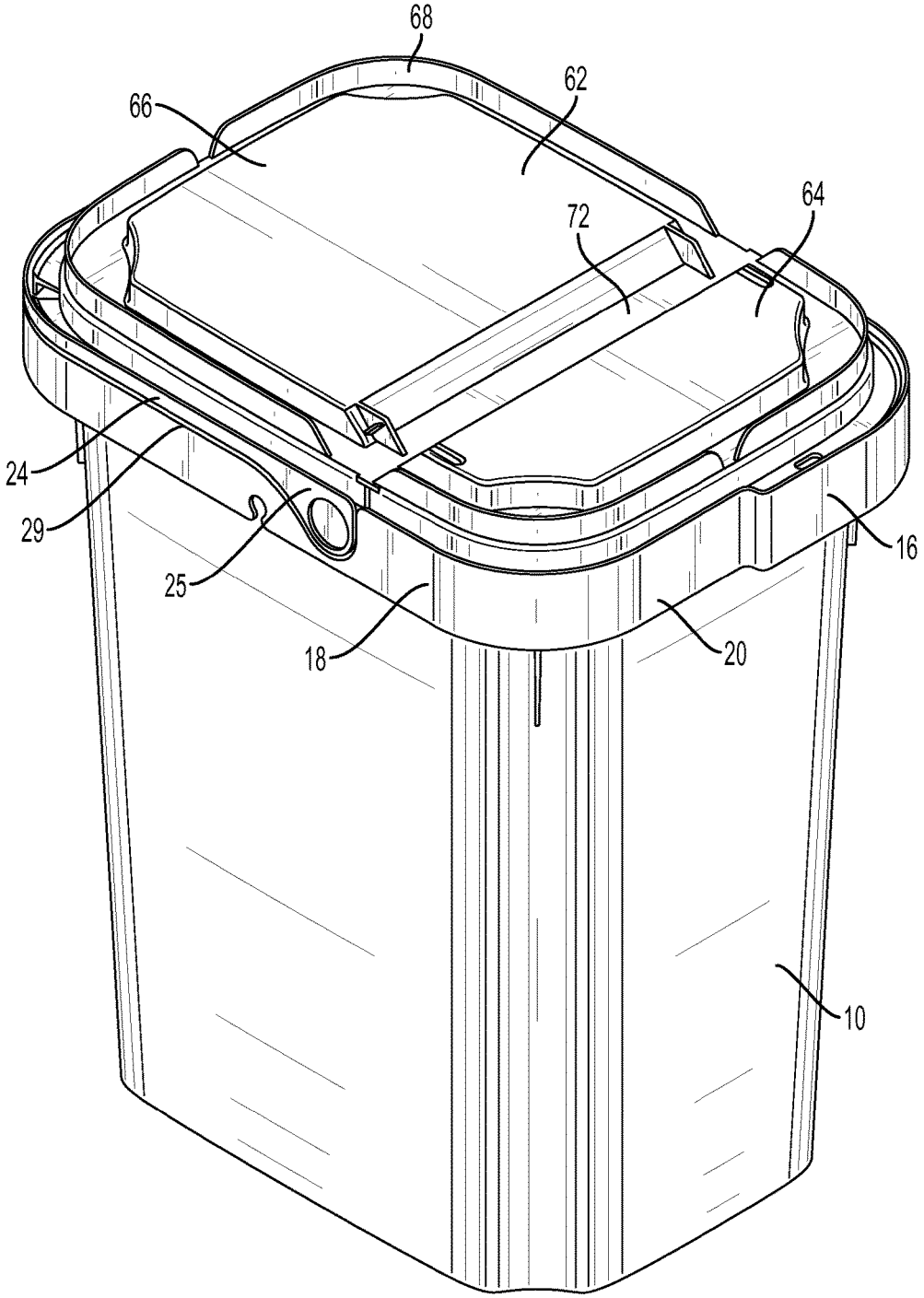
FIG. 25 illustrates a perspective view of the container of FIG. 1 assembled in connection with the lid of FIG. 16 in accordance with an embodiment of the invention.

In FIG. 24, another design feature of the present invention illustrates stacking features of lid 62 assembled with one another for storage and/or transport, for example, as a stacked assembly along pallet 60. FIG. 22 illustrates extended perimeter edge portions 93 and 95 of lid 62. Lid 62 may also include recessed perimeter edge portions 97 and 99. Thus, multiple lids 62 may be configured and stacked such that extended perimeter edge portion 93 corresponds and mates with recessed perimeter edge portion 97. Perimeter edge portions 95 in combination with portions 106 and 108 corresponds and mates with recessed perimeter edge portion 99.

Figure 36:
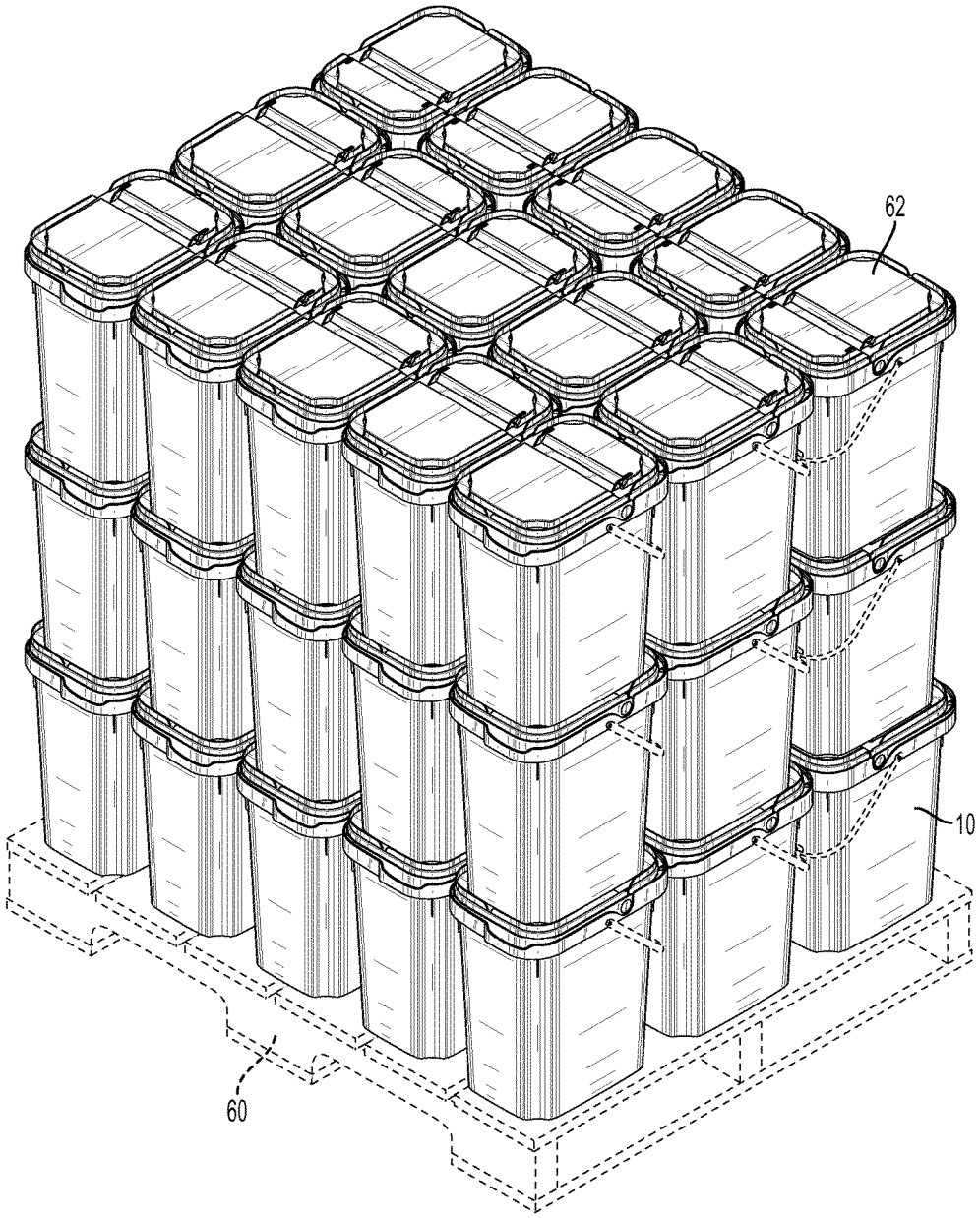
FIG. 36 illustrates another perspective view of multiple stacked container and lid assemblies of the embodiment shown in FIG. 27 in accordance with an embodiment of the invention.
Figure 37:
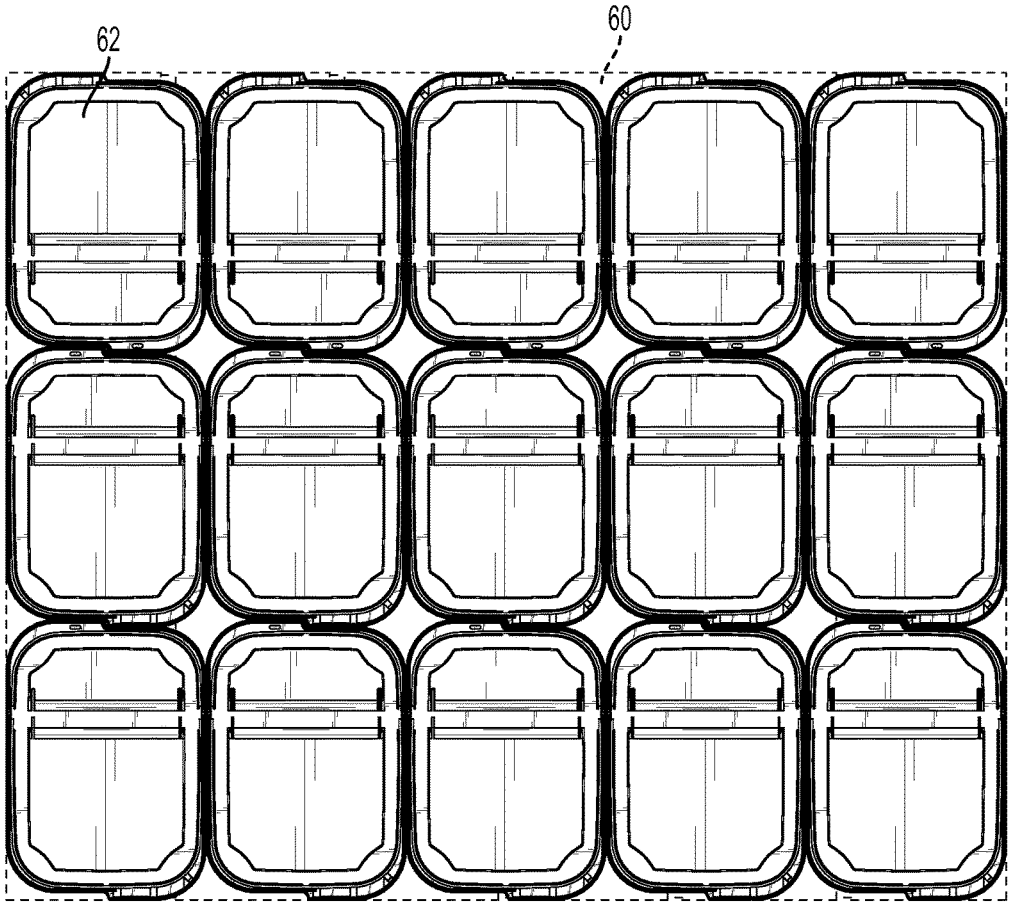
FIG. 37 illustrates a top plan view of multiple container and lid assemblies of the embodiment shown in FIG. 36 in accordance with an embodiment of the invention.
Figure 38:
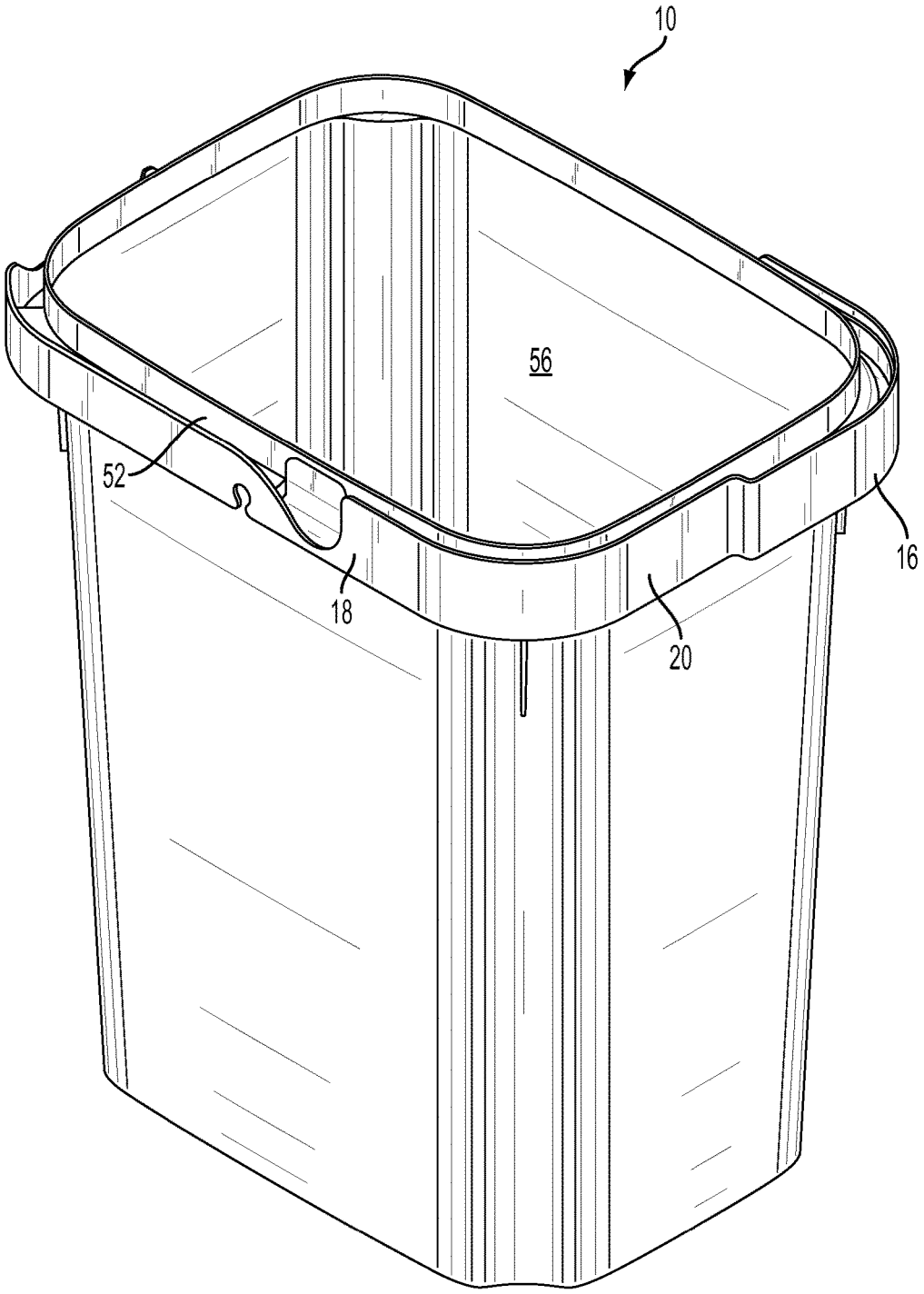
FIG. 38 illustrates a perspective view of the container of FIG. 1 with a tear strip removed in accordance with an embodiment of the invention.
Figure 39:
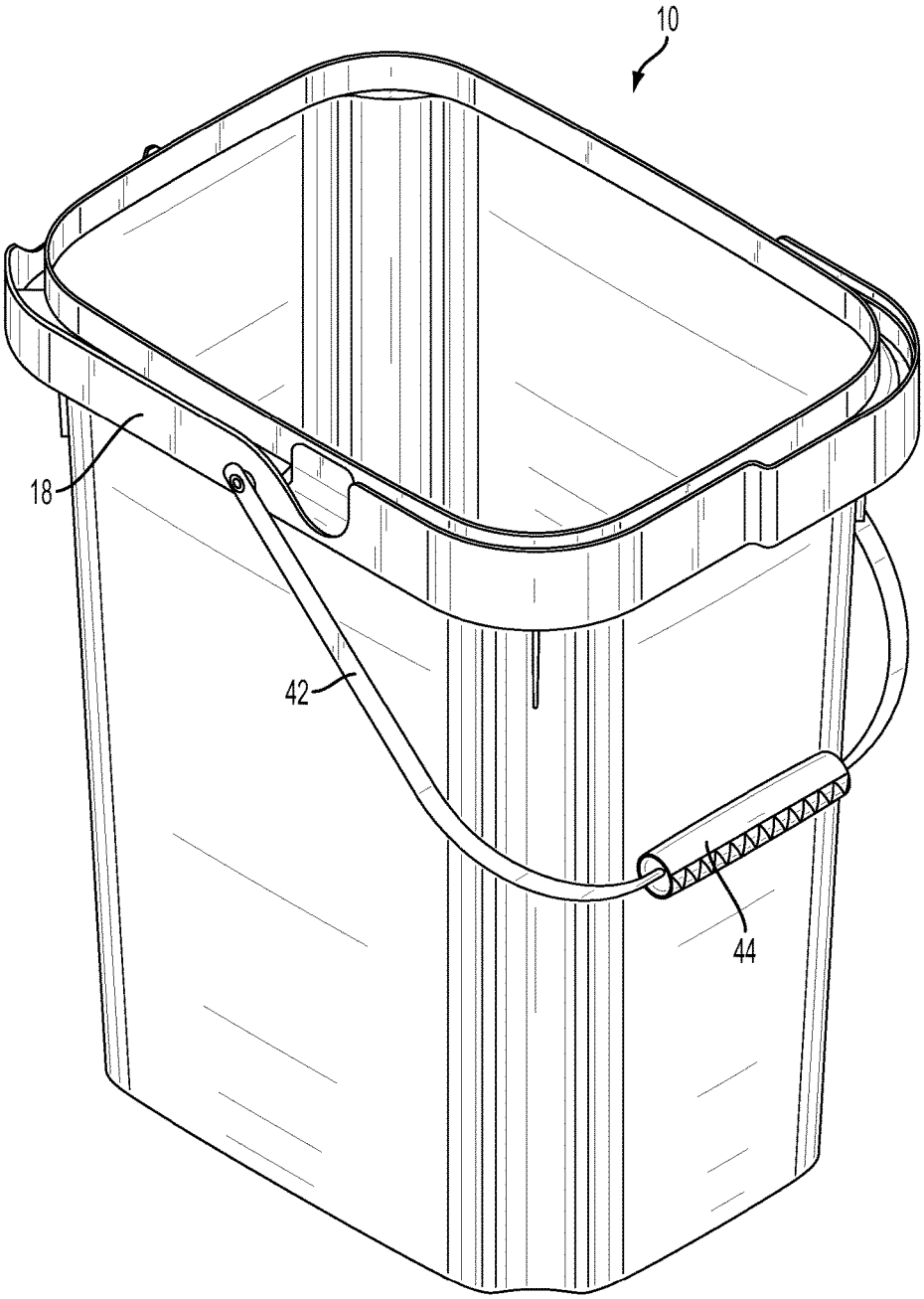
FIG. 39 illustrates a perspective view of the container of FIG. 2 with a tear strip removed in accordance with an embodiment of the invention.
Figure 40:
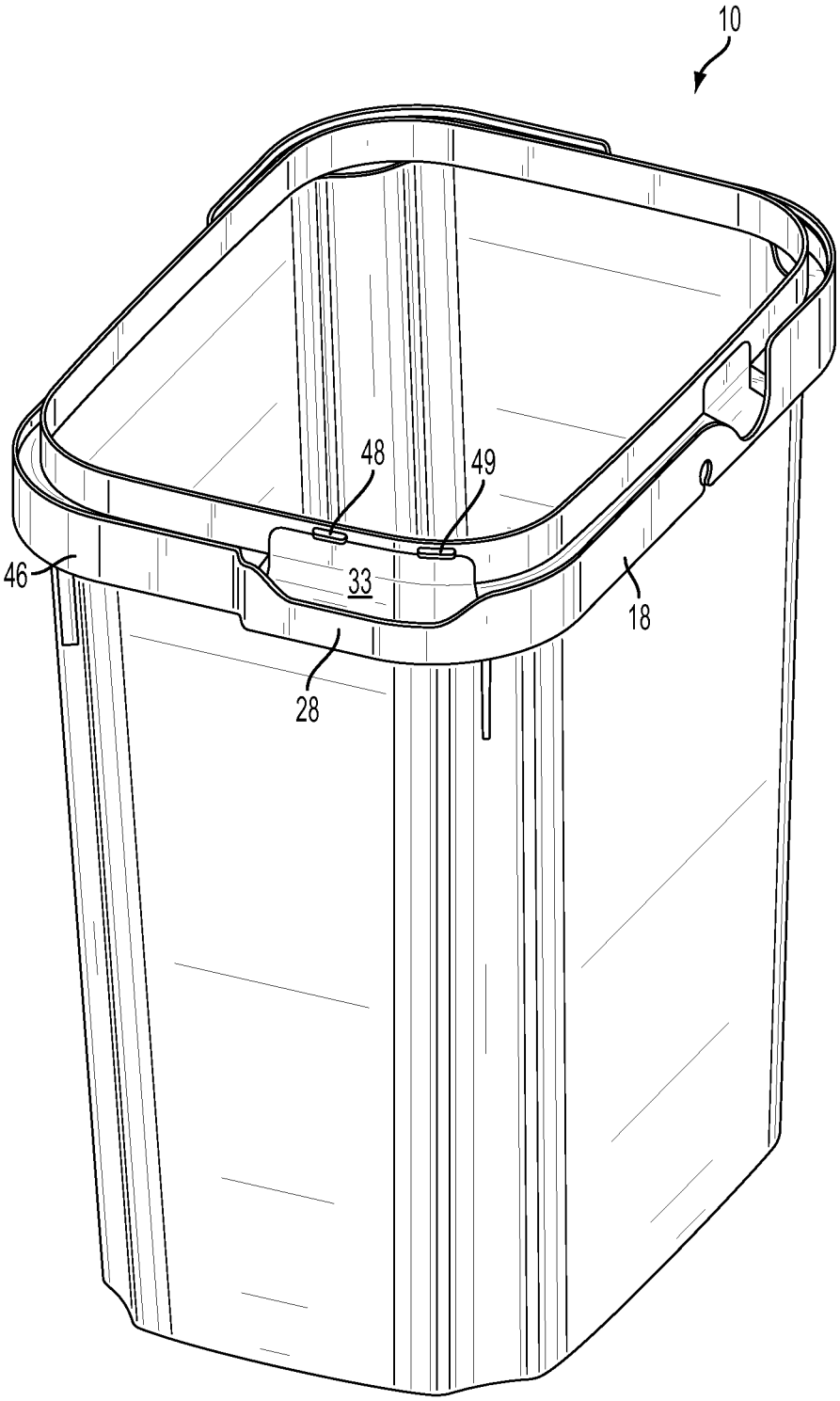
FIG. 40 illustrates a perspective view of the container of FIG. 3 with a tear strip removed in accordance with an embodiment of the invention.

When lid 62 is assembled upon container 10, the peripheral dimensions of lid 62 will substantially match the outer peripheral dimensions of bumper portion 18 of container 10. Thus, turning to FIGS. 36-37, a design feature of the present invention includes stacking and locking features of stacked assemblies of container 10 and lid 62 on pallet 60. FIG. 37, for example, illustrates how the designed shape of outer peripheral edge extension 92 of lid 62 corresponds to the peripheral shape of bumper portion 18 of container 10. Because the dimensions of extended perimeter edge portion 16 of container 10 are substantially the same as that of extended perimeter edge portion 93 of lid 62, both peripheral edge portions 16 and 93 substantially align with one another when lid 62 is mated with container 10. Likewise, because the dimensions of extended perimeter edge portion 95 in combination with portions 106 and 108 of lid 62 are substantially the same as that of extended perimeter edge portion 28 of container 10, the aforementioned components substantially align with one another when lid 62 is mated with container 10. In a similar fashion, because the dimensions of recessed perimeter edge portions 20 and 46 of container 10 are substantially the same as those of recessed perimeter edge portions 99 and 97 of lid 62, the components substantially align when lid 62 is mated with container 10.

Thus, extended perimeter edge portions 16 and 28 of container 10 may mate with recessed perimeter edge portions 46 and 20, respectively, to interlock a single row of stacked containers 10 (with or without lids 62). It is readily appreciated that, because the dimensions of each container 10 are substantially the same as those of other containers 10, and the dimensions of each lid 62 are relatively the same as those of other lids 62, the components of containers 10 and/or lids 62 will substantially align in a stacked 3-dimensional configuration. This provides an interlock feature of container 10 and/or lid 62 that increases stability and greater ease of storage and transport, for example, along pallet 60.

Having described the many embodiments of the present invention in detail, it will be apparent that modifications and variations are possible without departing from the spirit and scope of the invention. Furthermore, it should be appreciated that all examples in the present disclosure, while illustrating many embodiments of the invention, are provided as non-limiting examples and are, therefore, not to be taken as limiting the various aspects so illustrated.

While the present invention has been disclosed with references to certain embodiments, numerous modifications, alterations and changes to the described embodiments are possible without departing from the spirit and scope of the present invention, as defined in the appended claims. Accordingly, it is intended that the present invention not be limited to the described embodiments, but that it have the full scope defined by the language of the following claims and equivalents thereof.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless such changes and modifications depart therefrom.

What is claimed is:

1. A container and lid, comprising:

a container body having an opening;

an extended bumper at a periphery of the container body and substantially at the opening, wherein the extended bumper comprises a non-removable bumper portion and a removable tear strip portion integrated into the material of the bumper, wherein the removable tear strip portion includes a pull tab such that the non-removable bumper portion underlies a lower edge of the pull tab; and a lid body configured to cover the opening of the container body to form an assembly wherein the removable tear strip portion is configured to prevent access to a security mechanism of the assembly, the security mechanism comprising:

one or more flexible tabs extending radially outwardly from a peripheral edge of the lid body to form a ledge, each of the one or more flexible tabs having a lift tab depending downwardly from the ledge towards the container body, wherein the one or more flexible tabs comprise discrete protrusions extending from the lid body that may be operated independently of the lid body; and one or more bead extensions disposed on the container body in a position to engage with one or more engagement slots on the one or more flexible tabs positioned above the ledge and the one or more lift tabs, wherein the removable tear strip portion of the extended bumper directly contacts and covers at least a portion of the outermost periphery of the ledge and prevents access to and disengagement of the one or more lift tabs from the one or more engagement slots while the lid body covers the container body until the removable tear strip portion is removed.

2. The container and lid of claim 1, wherein the lid comprises:

a pivoting portion; and a lid hinge, wherein the lid hinge is configured to allow the pivoting portion to open while a remaining portion of the lid body remains closed.

3. The container and lid of claim 1, wherein the pull tab comprises a pull ring.

4. The container and lid of claim 1, wherein the container is reinforced at exterior corners via corrugations or fluting members.

5. The container and lid of claim 4, wherein inside corners of the container substantially reflect an inverted shape of the corrugations or fluting members.

6. The container and lid of claim 1, wherein the container body comprises interior side walls having reinforcing webbing material.

7. The container and lid of claim 1, wherein the container body comprises interior corner members for supporting an inserted container within the opening at external corners of the inserted container.

8. The container and lid of claim 2, wherein the remaining portion comprises a first raised portion and the pivoting portion comprises a second raised portion on a surface of the lid.

9. The container and lid of claim 8, wherein the lid further comprises:

a valley portion between the first raised portion and the second raised portion; and an outer valley portion formed substantially at a perimeter of the lid and around external perimeters of the first raised portion and the second raised portion.

10. The container and lid of claim 9, wherein the lid further comprises stacking guides along the perimeter of the lid, wherein the outer valley portion is configured between the stacking guides and the first raised portion and the second raised portion.

11. The container and lid of claim 1, wherein one or more drainage holes are provided on the lid.

12. The container and lid of claim 11, wherein the drainage holes are generally located at a perimeter of the lid.

13. The container and lid of claim 10, wherein a bottom of the container is configured to be received and generally aligned with the outer valley portion of the lid to create a stack of container and lid assemblies.

14. The container and lid of claim 8, wherein the lid comprises a first recessed portion and a second recessed portion along a bottom of the lid corresponding to the first raised portion and the second raised portion.

15. The container and lid of claim 14, wherein one or more lids are stackable by aligning the first recessed portion and a second recessed portion of a lid with a corresponding first raised portion and the second raised portion of another lid, respectively.

16. The container and lid of claim 1, wherein the bumper comprises:

extended perimeter edge portions at alternate opposite ends of the bumper; and recessed perimeter edge portions at alternate opposite ends of the bumper, wherein an extended perimeter edge portion and recessed perimeter edge portion of the container is configured to mate with an adjacent container having a corresponding recessed perimeter edge portion and extended perimeter edge portion.

17. The container and lid of claim 1, wherein the peripheral edge of the lid comprises:

extended perimeter edge portions at alternate opposite ends of the bumper;

recessed perimeter edge portions at alternate opposite ends of the bumper, wherein an extended perimeter edge portion and recessed perimeter edge portion of the lid is configured to mate with an adjacent lid having a corresponding recessed perimeter edge portion and extended perimeter edge portion.

18. The container and lid of claim 16, wherein the peripheral edge of the lid comprises:

extended perimeter edge portions at alternate opposite ends of the bumper;

recessed perimeter edge portions at alternate opposite ends of the bumper portion, wherein an extended perimeter edge portion and recessed perimeter edge portion of the lid is configured to mate with an adjacent lid having a corresponding recessed perimeter edge portion and extended perimeter edge portion, wherein the dimensions of the extended perimeter edge portions and recessed perimeter edge portions of the container are substantially the same as the extended perimeter edge portions and recessed perimeter edge portions of the lid.

19. A container, comprising:

a container body having an opening; and an extended bumper at a periphery of the container body and substantially at the opening, wherein the extended bumper is configured to receive a lid body configured to cover the opening of the container body to form an assembly, wherein the extended bumper comprises a non-removable bumper portion and a removable tear strip portion integrated into the material of the bumper, wherein the removable tear strip portion includes a pull tab such that the non-removable bumper portion underlies a lower edge of the pull tab wherein the removable tear strip portion is configured to prevent access to a security mechanism of the assembly, the security mechanism comprising:

one or more flexible tabs extending radially outwardly from a peripheral edge of the lid body to form a ledge, each of the one or more flexible tabs having a lift tab depending downwardly from the ledge towards the container body, wherein the one or more flexible tabs comprise discrete protrusions extending from the lid body that may be operated independently of the lid body; and one or more bead extensions disposed on the container body in a position to engage with one or more engagement slots on the one or more flexible tabs positioned above the ledge and the one or more lift tabs, wherein the removable tear strip portion of the extended bumper directly contacts and covers at least a portion of the outermost periphery of the ledge and prevents access to and disengagement of the one or more lift tabs from the one or more engagement slots while the lid body covers the container body until the removable tear strip portion is removed.

20. The container and lid of claim 1, wherein the one or more flexible tabs comprise two or more flexible tabs extending radially outwardly from the peripheral edge of the lid body.

21. The container and lid of claim 1, wherein the one or more engagement slots comprise holes that pass completely through the one or more flexible tabs, wherein the one or more bead extensions poke through the holes when engaged with the one or more engagement slots.

22. The container and lid of claim 1, wherein the one or more flexible tabs extend radially outwardly beyond the peripheral edge of the lid body.

* * * * *